US008391741B2

(12) United States Patent
Fujii et al.

(10) Patent No.: US 8,391,741 B2
(45) Date of Patent: Mar. 5, 2013

(54) IMAGE FORMING SYSTEM

(75) Inventors: Shuhji Fujii, Osaka (JP); Kouji Miyake, Osaka (JP); Takateru Yamamoto, Osaka (JP); Takeshi Nakamura, Osaka (JP)

(73) Assignee: Sharp Kabushiki Kaisha, Osaka-Shi, Osaka (JP)

( * ) Notice: Subject to any disclaimer, the term of this patent is extended or adjusted under 35 U.S.C. 154(b) by 210 days.

(21) Appl. No.: 12/805,207

(22) Filed: Jul. 19, 2010

(65) Prior Publication Data

US 2011/0020025 A1 Jan. 27, 2011

(30) Foreign Application Priority Data

Jul. 21, 2009 (JP) ..... 2009-170056
Jul. 24, 2009 (JP) ..... 2009-173646

(51) Int. Cl.
*G03G 15/00* (2006.01)
*G03G 21/00* (2006.01)

(52) U.S. Cl. ..... 399/82; 399/43; 399/71; 399/75; 399/81; 399/88; 399/92

(58) Field of Classification Search ..... 399/88, 399/75, 43, 81, 82, 76, 77, 92, 98, 71, 1
See application file for complete search history.

(56) References Cited

U.S. PATENT DOCUMENTS

| | | | | |
|---|---|---|---|---|
| 5,692,232 | A * | 11/1997 | Okano et al. | 399/53 |
| 2003/0072675 | A1 | 4/2003 | Takeda et al. | |
| 2005/0180772 | A1 * | 8/2005 | Dergham et al. | 399/92 |
| 2007/0009283 | A1 * | 1/2007 | Shirakata et al. | 399/92 |

FOREIGN PATENT DOCUMENTS

| | | | |
|---|---|---|---|
| JP | H07-104617 | | 4/1995 |
| JP | 08137343 | A | 5/1996 |
| JP | 3059719 | U | 7/1999 |
| JP | 2000047536 | A | 2/2000 |
| JP | 2001117415 | A | 4/2001 |
| JP | 2006-343491 | | 12/2006 |
| JP | 2008112064 | A | 5/2008 |

* cited by examiner

*Primary Examiner* — Sophia S Chen

(74) *Attorney, Agent, or Firm* — Edwards Wildman Palmer LLP; David G. Conlin; David J. Silvia

(57) ABSTRACT

An image forming system is provided with an Image Forming Operation Unit, an Air Cleaning Operation Unit, a power source, and a Control Unit. The Control Unit has a coordinated OFF control function of coordinating a first power supply OFF control for turning off power supply from the power source to the Image Forming Operation Unit and a second power supply OFF control for turning off power supply from the power source to the Air Cleaning Operation Unit, and the coordinated OFF control function is configured to execute the second power supply OFF control when a preset time period elapses after executing the first power supply OFF control. Also, in the image forming system, an air cleaning operation of an air cleaning apparatus is stopped when an image forming apparatus is set to an a night mode or when a fixed time period elapses after the night mode is set. The air cleaning operation of the air cleaning apparatus is restarted when the image forming apparatus is resumed from the night mode.

11 Claims, 34 Drawing Sheets

FIG.14

| Name | Sign | Content | |
|---|---|---|---|
| | | 0 | 1 |
| Image forming power ON/OFF instruction flag | F1 | Power-OFF state instruction | Power-ON state instruction |
| Air cleaning power ON/OFF instruction flag | F2 | Power-OFF state instruction | Power-ON state instruction |
| Image forming power saving state flag | F3 | Normal state | Power saving state |
| Iimage forming in-progress flag | F4 | Not in-progress | In-progress |

FIG.15

| Name | Sign | Content | |
|---|---|---|---|
| | | 0 | 1 |
| Image forming auto power-ON determination | D1 | Not auto | Auto |
| Image forming auto power-OFF determination | D2 | Not auto | Auto |
| Air cleaning coordinated power-ON determination | D3 | Not coordinated | Coordinated |
| Air cleaning coordinated power-OFF determination | D4 | Not coordinated | Coordinated |
| Air cleaning advanced power-ON determination | D5 | Not advanced | Advanced |
| Air cleaning delayed power-OFF determination | D6 | Not delayed | Delayed |

| Name | Sign | Content |
|---|---|---|
| Image forming power-ON time | t1 | ON time |
| Image forming power-OFF time | t2 | OFF time |
| Air cleaning advanced power-ON time period (min.) | T1 | Advance time period |
| Air cleaning delayed power-OFF time period (min.) | T2 | Delay time period |
| Air cleaning power-ON time | t3 | ON time |
| Air cleaning power-OFF time | t4 | OFF time |

FIG.20

Air cleaning apparatus power settings 1-1 [Back]

Power-ON in coordination with power-ON of the image forming apparatus?

[Do not coordinate]

[Coordinate] → Further settings required

[Modify] [OK]

FIG.21

Air cleaning apparatus power settings 1-2 [Back]

Power-ON at the same time as power-ON of the image forming apparatus, or in advance?

[At the same time]

[In advance] → Advance time period [ ] Min.

(Numerical keypad input, 120 min. max.)

[Modify] [OK]

FIG.26

Image forming apparatus power settings 1 [Back]

Power-ON/OFF of the image forming apparatus

[Manual ON/OFF]

[Auto ON/OFF] → Further settings required

[Modify] [OK]

FIG.27

Image forming apparatus power settings 2 [Back]

Power-ON/OFF settings of the image forming apparatus?

| | Mon | Tues | Wed | Thurs | Fri | Sat | Sun |
|---|---|---|---|---|---|---|---|
| ON | : | : | : | : | : | : | : |
| OFF | : | : | : | : | : | : | : |

(Numerical keypad input, 24 hr display)

[Modify] [OK]

FIG.33A

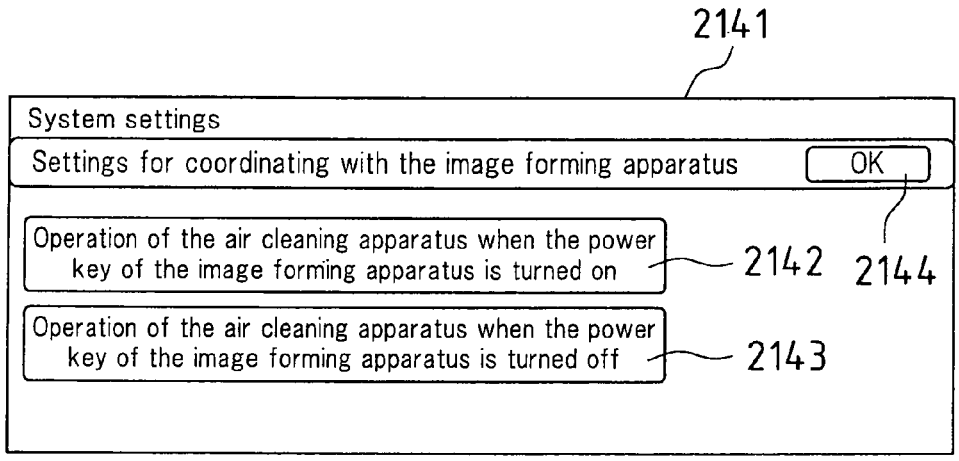

FIG.33B

| Input type | Name | Display method | Description |
|---|---|---|---|
| Key 2142 | Operation of the air cleaning apparatus when the power key of the image forming apparatus is turned on | Always selectable | Transitions to air cleaning apparatus operation setting screen when power key of image forming apparatus is turned on. |
| Key 2143 | Operation of the air cleaning apparatus when the power key of the image forming apparatus is turned off | Always selectable | Transitions to air cleaning apparatus operation setting screen when power key of image forming apparatus is turned off. |
| Key 2144 | OK | Always selectable | Returns to air cleaning apparatus settings. |

FIG.34A

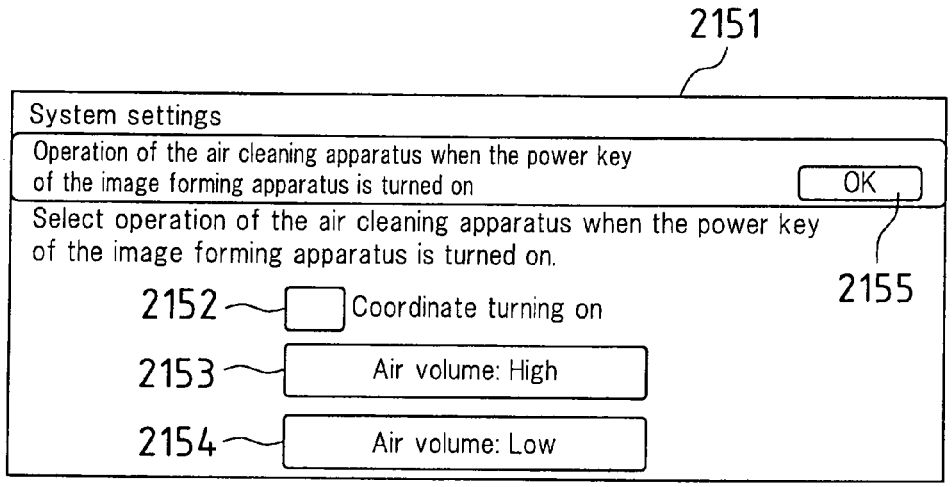

FIG.34B

| Input type | Name | Display method | Description |
|---|---|---|---|
| Checkbox 2152 | Coordinate turning on | Always selectable | Used when operation of air cleaning apparatus is turned on in coordination with power key of image forming apparatus. |
| Key 2153 | Air volume: High | Gray out when "Coordinate turning on" is unchecked | Air volume default is set when operation of air cleaning apparatus is turned on in coordination with power key of image forming apparatus. |
| Key 2154 | Air volume: Low | | |
| Key 2155 | OK | Always selectable | Returns to first input setting screen. |

FIG.36A

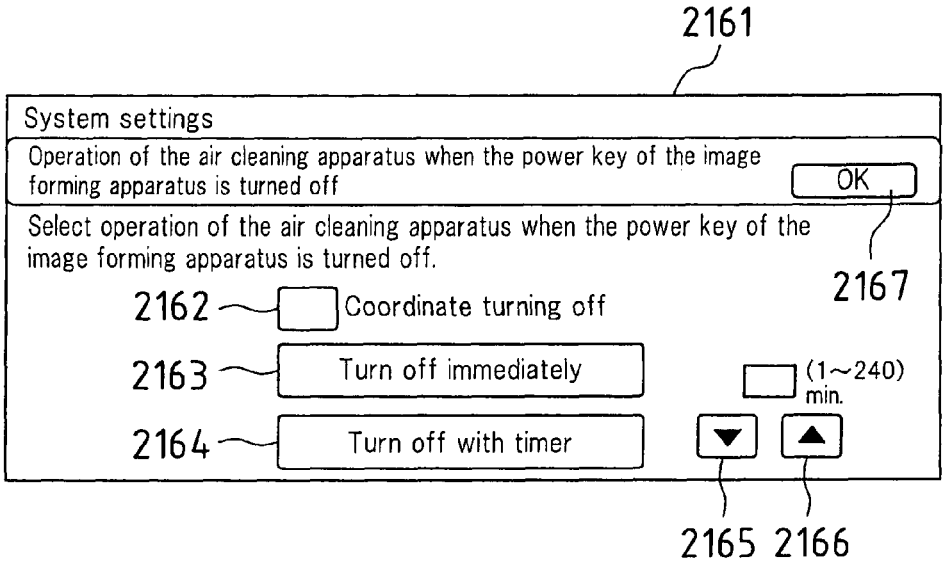

FIG.36B

| Input type | Name | Input value | Display method | Description |
|---|---|---|---|---|
| Checkbox 2162 | Coordinate turning off | — | Always selectable | Used when operation of air cleaning apparatus turned on in coordination with power key of image forming apparatus. |
| Key 2163 | Turn off immediately | — | Gray out when "Coordinate turning off" is unchecked | "Turn off immediately" or "Turn off with timer" is set when operation of air cleaning apparatus is turned on in coordination with power key of the image forming apparatus. |
| Key 2164 | Turn off with timer | | | |
| Up/down keys 2165/2166 of numeric input portion | — | Settable default (1 - 240 min.): 120 min. | Active only when "Turn off with timer" is selected | Timer is set to show how many minutes until operation of air cleaning apparatus is turned off after power key of image forming apparatus is turned off when "Turn off with timer" is selected. |
| Key 2167 | OK | — | Always selectable | Returns to first input setting screen. |

FIG.38B

| Input type | Name | Input value/Key name | Display method | Description |
|---|---|---|---|---|
| Checkbox 2172 | Operation of the air cleaning apparatus when the power key of the image forming apparatus is turned on | Coordinate turning on<br>Default: Checked | Always selectable | Used when operation of air cleaning apparatus turned on in coordination with power key of image forming apparatus |
| Selection box 2174 | | 1 Air volume: Low<br>2 Air volume: High<br>Default: "Air volume: Low" | Gray out when "Coordinate turning on" is unchecked | Default air volume is set when operation of air cleaning apparatus turned on in coordination with power key of image forming apparatus |

FIG.38C

| Input type | Name | Input value/Key name | Display method | Description |
|---|---|---|---|---|
| Checkbox 2173 | Operation of the air cleaning apparatus when the power key of the image forming apparatus is turned off | Coordinate turning off<br>Default: Checked | Always selectable | Used when operation of air cleaning apparatus turned off in coordination with power key of image forming apparatus |
| Selection box 2175 | | 1 Turn off immediately<br>2 Turn off with timer<br>Default: "Turn off immediately" | Gray out when "Coordinate Turning off" is unchecked | "Turn off immediately" or "Turn off with timer" is set when operation of air cleaning apparatus turned on in coordination with power key of image forming apparatus |
| Input box 2176 | | Input numerical value from 1 - 240 min.<br>Default: 120 min. | Active only when "Turn off with timer" is selected | Timer is set to show how many minutes until operation of air cleaning apparatus is turned off after power key of image forming apparatus is turned off when "Turn off with timer" is selected. If numerical value other than 1 - 240 is input, error message is displayed when OK key is pressed. |

IMAGE FORMING SYSTEM

BACKGROUND OF THE INVENTION

This application claims priority under 35 U.S.C. §119(a) on Patent Application No. 2009-170056 filed in Japan on Jul. 21, 2009, and Patent Application No. 2009-173646 filed in Japan on Jul. 24, 2009, the entire contents of which are herein incorporated by reference.

The present invention relates to an image forming system constituted by an image forming apparatus that performs an image forming process, such as a copier, a printer or a facsimile machine, for example, and an air cleaning apparatus.

In recent years, image forming apparatuses using an electrophotographic system, which enabled image forming, such as copiers, printers and facsimile machines, have been developed. Image forming apparatuses perform a so-called image forming process on recording paper that, for example, involves forming an electrostatic latent image on the surface of a photosensitive drum, developing the electrostatic latent image using toner to form a toner image on the surface of the photosensitive drum, transferring this toner image from the photosensitive drum to recording paper, and applying heat and pressure to this recording paper to fix the toner image to the recording paper.

While such image forming apparatuses are typically installed in a room such as an office, invisible fine particles, fumes and the like may occur with these image forming apparatuses during the image forming process on recording paper, and these may be discharged into the room from the image forming apparatus.

Also, in a room such as an office in which an image forming apparatus is installed, fine particles invisible to the eye such as house dust, fumes and the like typically occur for various reasons.

In view of this, air cleaning apparatuses have been proposed as apparatuses that eliminate these fine particles such as house dust, fumes and the like in a room (e.g., see JP 2002-58731A). The air cleaning apparatus disclosed in JP 2002-58731A simultaneously generates positive and negative ions, and effectively eliminates airborne bacteria in the air using the positive and negative ions.

Providing such an air cleaning apparatus in a room where an image forming apparatus is installed enables invisible fine particles, fumes and the like discharged into the room from the image forming apparatus to be removed.

Incidentally, when power supply to an image forming apparatus has been turned on and the image forming apparatus is operational, the person using this image forming apparatus is typically present in the room or the like where the image forming apparatus is installed.

For this reason, purifying the air in the room is thus preferable when the image forming apparatus is operational, in order to remove invisible fine particles, fumes and the like discharged into the room from the image forming apparatus. Therefore, it makes sense to turn on power supply to the air cleaning apparatus in the room or the like where the image forming apparatus is installed and clean the air.

On the other hand, power supply to the image forming apparatus will have been turned off and the image forming apparatus will be nonoperational at times such as knock-off time when people leave the room or the like where the image forming apparatus is installed. Thus, when the image forming apparatus is nonoperational, power supply to the air cleaning apparatus may be turned off, given that there will be few invisible fine particles, fumes or the like discharged into the room from the image forming apparatus, as well as there being nobody in the room.

Thus, by operating the image forming apparatus and the air cleaning apparatus so that they cooperate with each other, the environment around the image forming apparatus, such as the room or the like where the image forming apparatus is installed, can be effectively kept clean, while suppressing power consumption.

However, the image forming apparatus and the air cleaning apparatus are completely separate apparatuses, and ON/OFF control of power supplied to the image forming apparatus and ON/OFF control of power supplied to the air cleaning apparatus are mutually independent and performed individually.

Therefore, in order to solve the problem, an object of the present invention is to provide an image forming system capable of effectively maintaining the environment around the image forming apparatus, such as the room or the like where the image forming apparatus is installed, in a clean state, while suppressing power consumption, by automatically causing the image forming apparatus and the air cleaning apparatus to cooperate.

SUMMARY OF THE INVENTION

An image forming system of the present invention includes an Image Forming Operation Unit that executes an image forming operation, an Air Cleaning Operation Unit that executes an air cleaning operation, a power source that supplies power to the Image Forming Operation Unit and the Air Cleaning Operation Unit, and a Control Unit that has a coordinated OFF control function of coordinating a first power supply OFF control for turning off power supply from the power source to the Image Forming Operation Unit and a second power supply OFF control for turning off power supply from the power source to the Air Cleaning Operation Unit, wherein the coordinated OFF control function is configured to execute the second power supply OFF control when a preset time period elapses after executing the first power supply OFF control.

According to the present invention, the second power supply OFF control (OFF control of power supply to Air Cleaning Operation Unit) is executed by the Control Unit of the image forming system a preset time period after the first power supply OFF control (OFF control of power supply to Image Forming Operation Unit) is executed.

Thus, the air in the room or the like where the image forming system is installed can continue to be cleaned even after the Image Forming Operation Unit of the image forming system has stopped operating, and the room or the like where the image forming system is installed can be effectively kept clean in preparation for the next day. Consequently, the environment around the image forming system, such as the room or the like where the image forming system is installed, can be effectively kept clean, while suppressing power consumption.

In the image forming system of the present invention, the power source may include a first power source that supplies power to the Image Forming Operation Unit, and a second power source that supplies power to the Air Cleaning Operation Unit, and the first power supply OFF control may be executed with respect to the first power source, and the second power supply OFF control may be executed with respect to the second power source.

Also, in the image forming system of the present invention, the Control Unit may be provided with a plurality of types of the coordinated OFF control function.

Also, in the image forming system of the present invention, the Control Unit may include an Operating Unit that receives an operation from outside, and may set the time period based on the operation received by the Operating Unit.

Also, in the image forming system of the present invention, the Control Unit may be provided with a plurality of types of the coordinated OFF control function, and may select one of the plurality of types of the coordinated OFF control function based on the operation received by the Operating Unit.

Also, in the image forming system of the present invention, the Control Unit may be further provided with an individual OFF control function of individually executing the first power supply OFF control and the second power supply OFF control independently of each other, and may execute an OFF control function selection for selecting one of the plurality of types of the coordinated OFF control function or the individual OFF control function, based on the operation received by the Operating Unit.

Also, in the image forming system of the present invention, the Control Unit may include a Remote Operation Reception Unit that receives a remote operation from outside via a communication function, and is further provided with an individual OFF control function of individually executing the first power supply OFF control and the second power supply OFF control independently of each other, and may execute an OFF control function selection for selecting one of the plurality of types of the coordinated OFF control function or the individual OFF control function, based on the remote operation received by the Remote Operation Reception Unit.

Also, in the image forming system of the present invention, the first power source, the Image Forming Operation Unit and the Control Unit may constitute an image forming apparatus, and the second power source and the Air Cleaning Operation Unit may constitute an air cleaning apparatus.

Also, in the image forming system of the present invention, the air cleaning apparatus may be provided outside the image forming apparatus.

Also, in the image forming system of the present invention, the air cleaning apparatus may be provided above the image forming apparatus.

Also, in the image forming system of the present invention, the Air Cleaning Operation Unit may be provided with an ion generating function.

Also, in the image forming system of the present invention, the image forming apparatus may be provided with a normal mode and a power saving mode in which power consumption is less than in the normal mode, and an ion emission direction of an ion emitted by the Air Cleaning Operation Unit may differ between the normal mode and the power saving mode.

Also, in the image forming system of the present invention, the air cleaning apparatus may be provided inside the image forming apparatus.

Also, in order to solve the problems, another image forming system of the present invention includes an air cleaning apparatus for cleaning air, an image forming apparatus that is settable by an input operation to a night mode for saving power, and a Control Unit that stops an air cleaning operation of the air cleaning apparatus when the image forming apparatus is set by the input operation to the night mode. The night mode referred to here is a mode in which at least transmission and reception of data to/from an external device is enabled.

Also, in order to solve the problems, another image forming system an air cleaning apparatus for cleaning air, an image forming apparatus that is automatically settable by a preset control procedure to a night mode for saving power, and a Control Unit that stops an air cleaning operation of the air cleaning apparatus when the image forming apparatus is automatically set by the control procedure to the night mode. The night mode referred to here is a mode in which at least transmission and reception of data to/from an external device is enabled.

The image forming system of the present invention enables the environment around the image forming apparatus, such as the room or the like where the image forming apparatus is installed, to be effectively kept clean, while suppressing power consumption, by automatically causing the image forming apparatus and the air cleaning apparatus to cooperate, because of being provided with the air cleaning apparatus, the image forming apparatus and the Control Unit.

Incidentally, the image forming apparatus provided in the image forming system of the present invention may be an electrophotographic image forming apparatus. With an electrophotographic apparatus, an electrostatic latent image is formed of the surface of a photosensitive drum and the electrostatic latent image is developed using toner to form a toner image on the surface of the photosensitive drum, and the toner image is transferred from the photosensitive drum to recording paper and heat and pressure are applied to the recording paper to fix the toner image to the recording paper.

Such image forming apparatuses are essential office automation equipment installed in most offices, and are in increasingly widespread use in homes and hospitals.

Meanwhile, air cleaning apparatuses that purify the air in the room are being increasingly installed in offices, homes, hospitals and the like.

As for air cleaning apparatuses, JP 2002-58731A given as a related art document, for example, discloses an ion generating apparatus that simultaneously generates positive and negative ions, and effectively eliminates airborne bacteria in the air using the positive and negative ions.

However, if an air cleaning apparatus is installed in addition to an image forming apparatus, the time and effort required by the user who operates these apparatuses is increased.

In terms of only image forming apparatuses, various kinds of proposals for simplifying operation thereof have been made (e.g., see JP 2000-47536A, JP 2001-117415A).

The technique of JP 2000-47536A, for example, is based on a connect copy function whereby a main image forming apparatus and a sub image forming apparatus are interconnected, and when an original is to be copied with the main machine, the original is communicated to the sub-machine and the same copy is executed on both the main machine and the sub-machine. Even if the sub-machine has been turned off due to a weekly timer function, the weekly timer function is disabled when executing the connect copy function and the sub-machine is turned on. The connect copy function can thus be executed at any time, even without an operation for turning on the sub-machine being particularly performed by the user.

With the technique of JP 2001-117415A, an image forming apparatus is set to switch between a preheating mode for lowering the fixing temperature of the fixing apparatus in the image forming apparatus and a night mode for turning off the heater power of the fixing apparatus, with the heater power of the fixing apparatus being automatically turned off when transitioning from the preheating mode to the night mode. An operation for turning off power to the fixing apparatus is thus unnecessary.

However, even if the techniques of JP 2000-47536A and JP 2001-117415A enable operation of the image forming apparatus to be simplified, they do not enable operation of both the image forming apparatus and the air cleaning apparatus to be simplified.

Further, if the image forming apparatus and the air cleaning apparatus are installed separately, the space occupied by the apparatuses will increase, and costs will also be incurred separately.

In contrast, the present invention, because of being provided with the air cleaning apparatus, the image forming apparatus and the Control Unit, enables the operation of the air cleaning apparatus to be simplified by combining the image forming apparatus and the air cleaning apparatus.

Also, according to the image forming system of the present invention, the Control Unit stops the air cleaning apparatus of the air cleaning operation when the image forming apparatus is set to the night mode by an input operation.

Alternatively, the Control Unit stops the air cleaning apparatus of the air cleaning operation when the image forming apparatus is automatically set to the night mode by a preset control procedure.

Here, the input operation is operation of a switch or the like by a user, and the control procedure is control based on a time schedule. The Control Unit stops the air cleaning apparatus of the air cleaning operation when the image forming apparatus is set to the night mode by such an input operation or control procedure.

Also, the night mode of the image forming apparatus is a mode in which at least transmission and reception of data with an external device is enabled, and only secondary functions of the image forming apparatus such as a facsimile function and the like, for example, are operated. For example, the image forming apparatus is provided with a main power source that supplies high power for operating functions necessary for printing and a secondary power source that supplies low power for operating the facsimile function, and economizes power consumption by either turning off the main power source or greatly reducing the amount of power supplied from the main power source when switching to the night mode, while continuing to supply power from the secondary power source. This is because printing does not normally need to be performed at night when there is nobody in the room, although incoming fax communications could possibly be received even if printing is not required.

When such a night mode has been set, there is no harm in stopping the air cleaning apparatus given that there is nobody in the room, and thus the air cleaning operation of the air cleaning apparatus is stopped. The air cleaning operation is an operation such as the rotation operation of a fan motor or the operation of the ion generating unit. The air cleaning apparatus is also provided with a power source, and the amount of power supplied from the power source can be greatly reduced by stopping the air cleaning operation of the air cleaning apparatus. The power consumption of the air cleaning apparatus can thereby be economized without the user particularly operating the air cleaning apparatus.

Also, in the image forming system of the present invention, the air cleaning apparatus may be provided with an ion generating unit, for example.

In this case, this ion generating unit preferably simultaneously generates and emits positive and negative ions. Such positive and negative ions are favorable for the present invention due to being able to effectively eliminate airborne bacteria in the air and to decompose and reduce exhaust gases from the image forming apparatus. For example, electrophotographic image forming apparatuses may produce exhaust gases such as ozone, and these gases are normally exhausted to the outside after having been removed with a filter built into the image forming apparatus, but by employing an ion generating unit, exhaust gases such as ozone can be decomposed and reduced by positive and negative ions.

With the image forming system of the present invention, the Control Unit may start measuring a fixed time period at the time the image forming apparatus is set to the night mode, and may stop the air cleaning operation of the air cleaning apparatus at the time the fixed time period elapse.

In this case, the air in the room is purified by the air cleaning apparatus for a fixed time period after the night mode has been set, or in other words, after everyone has left the room. The air in the room will thereby have already been purified when people return the next day, even if the air cleaning apparatus has not been operating.

Further, with the image forming system of the present invention, an adjusting unit for adjusting the fixed time may be provided.

In this case, the fixed time can be arbitrarily set, because the adjusting unit for adjusting the fixed time is provided.

Also, with the image forming system of the present invention, the Control Unit may further start the air cleaning operation of the air cleaning apparatus when the image forming apparatus transitions from the night mode to another mode.

In this case, the Control Unit, further, starts the air cleaning operation of the air cleaning apparatus when the image forming apparatus transitions from the night mode to another mode. Other modes include a warm-up mode for setting the fixing temperature in the image forming apparatus, a print mode for performing printing, a standby mode for reducing power consumption when printing is not being performed, and a power saving mode for further reducing power consumption. Because the image forming apparatus normally transitions from the night mode to the warm-up mode, the air cleaning operation of the air cleaning apparatus will be started when the image forming apparatus transitions to this warm-up mode. The air cleaning apparatus can thereby be started, without the user particularly operating the air cleaning apparatus.

Also, with the image forming system of the present invention, the air cleaning apparatus may be provided above the image forming apparatus.

In this case, the installation space of the air cleaning apparatus can be saved. Also, air blown from the air cleaning apparatus can be circulated over a wide area, and the action of purifying the air can be enhanced.

Alternatively, with the image forming system of the present invention, the air cleaning apparatus may be built into the image forming apparatus.

In this case, the installation space of the air cleaning apparatus can be saved.

BRIEF DESCRIPTION OF THE DRAWINGS

FIG. 14 is a flag list table provided in an image forming Control Unit of the image forming system in Embodiment 2.

FIG. 15 is a data list table (1 of 2) provided in the image forming Control Unit of the image forming system in Embodiment 2.

FIG. 20 is a diagram (4 of 7) of a setting display screen of the image forming display Operating Unit of the image forming system in Embodiment 2.

FIG. 21 is a diagram (5 of 7) of a setting display screen of the image forming display Operating Unit of the image forming system in Embodiment 2.

FIG. 26 is a diagram (1 of 2) of another example of a setting display screen of the image forming display Operating Unit of the image forming system in Embodiment 2.

FIG. 27 is a diagram (2 of 2) of another example of a setting display screen of the image forming display Operating Unit of the image forming system in Embodiment 2.

FIG. 33 is composed of FIG. 33A and FIG. 33B, FIG. 33A being a plan view showing a first input setting screen for setting the air cleaning operation of the air cleaning apparatus, and FIG. 33B being a chart showing operation names, operation descriptions and the like corresponding to keys on the first input setting screen.

FIG. 34 is composed of FIG. 34A and FIG. 34B, FIG. 34A being a plan view showing a second input setting screen for setting the air cleaning operation of the air cleaning apparatus, and FIG. 34B being a chart showing operation names, operation descriptions and the like corresponding to keys on the second input setting screen.

FIG. 36 is composed of FIG. 36A and FIG. 36B, FIG. 36A being a plan view showing a third input setting screen for setting the air cleaning operation of the air cleaning apparatus, and FIG. 36B being a chart showing operation names, operation descriptions and the like corresponding to a checkbox and keys on the third input setting screen.

DESCRIPTION OF REFERENCE NUMERALS

Figure 1:
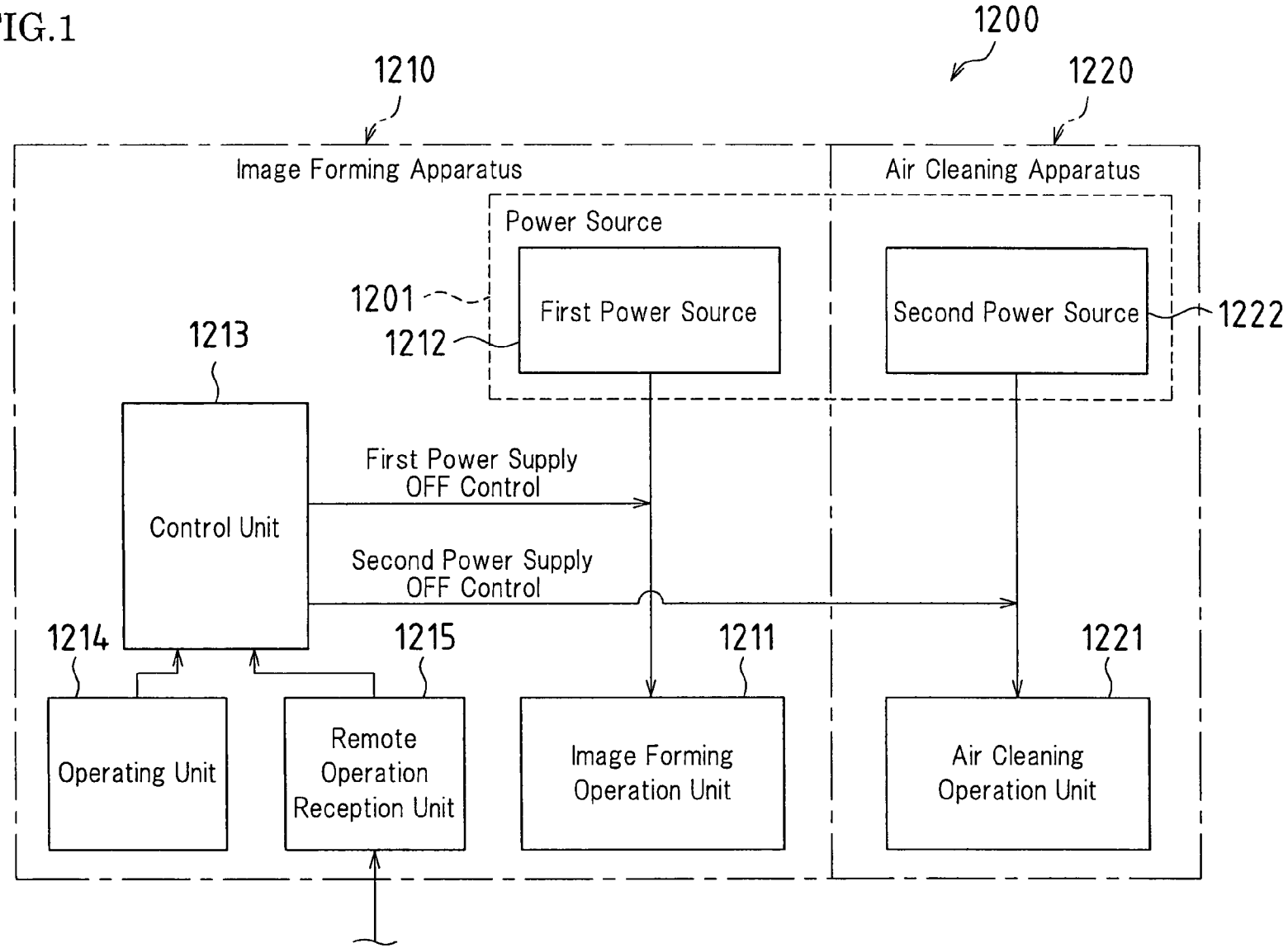
FIG. 1 is a block diagram showing the configuration of an image forming system in Embodiment 1.

| | |
|---|---|
| 1 | Laser Exposure Apparatus |
| 2 | Developing Apparatus |
| 3 | Photosensitive Drum |
| 4 | Cleaning Apparatus |
| 5 | Charging Unit |
| 6 | Intermediate Transfer Roller |
| 7 | Intermediate Transfer Belt |
| 8 | Intermediate Transfer Belt Apparatus |
| 9 | Intermediate Transfer Belt Cleaning Apparatus |

-continued

| DESCRIPTION OF REFERENCE NUMERALS | |
|---|---|
| 10 | Paper Supply Tray 10 |
| 11 | Secondary Transfer Apparatus |
| 11a | Transfer Roller |
| 12 | Fixing Apparatus |
| 14 | Paper Registration Roller |
| 15 | Paper Discharge Tray |
| 16 | Paper Pickup Roller |
| 21 | Intermediate Transfer Belt Drive Roller |
| 22 | Driven Roller |
| 31 | Heat Roller |
| 32 | Pressure Roller |
| 41 | Original Placement Tray |
| 42 | Original Transport Unit |
| 44 | Original Pickup Roller |
| 45 | Separation Roller |
| 46 | Separation Pad |
| 47 | Transport Path |
| 49 | Original Registration Roller |
| 51 | Reading Guide |
| 52 | Reading Glass |
| 53 | First Scanning Unit |
| 54 | Second Scanning Unit |
| 55 | Imaging Lens |
| 56 | CCD |
| 57 | Transport Roller |
| 58 | Discharge Roller |
| 59 | Discharge Tray |
| 60 | Original Reading Unit |
| 61 | Platen Glass |
| 170 | Air Cleaning Apparatus |
| 170a | Main Body |
| 170b | Support Column |
| 170c | Turning Shaft |
| 171 | Air Cleaning Operation Unit |
| 172 | Air Cleaning Operation Unit Power Source |
| 173 | Air Cleaning Control Unit |
| 174 | Air Cleaning Control Unit Power Source |
| 175 | Air Cleaning Display Operating Unit |
| 175a | Power Button (SW2) |
| 175b | Coordinated ON Display Lamp |
| 175c | Coordinated OFF Display Lamp |
| 175d | Power Display Lamp |
| 177 | Air Cleaning RS-232C I/F |
| 181a | Inlet Hole |
| 181b | Upper Face Outlet Opening |
| 182 | Fan Unit |
| 182a | Fan |
| 183 | Inlet Duct |
| 184 | outlet duct |
| 185 | Ion Generating Element |
| 185a | Positive Ion Generating Element |
| 185b | Negative Ion Generating Element |
| 187 | Arrow indicating Rotation Direction |
| 191 | Fixed Duct Front Wall |
| 192 | Fixed Duct Rear Wall |
| 271 | Air Cleaning Apparatus |
| 272 | Support Column |
| 281 | Main Casing |
| 282 | Fan Unit |
| 283 | Inlet Duct |
| 284 | Outlet Duct |
| 285 | Ion Generating Element |
| 286 | Filter |
| 1100 | Image Forming Apparatus |
| 1100a | Upper Corner of Rear Face of Casing |
| 1101 | Image Forming Operation Unit |
| 1102 | Image Forming Operation Unit Power Source |
| 1103 | Image Forming Control Unit |
| 1104 | Image Forming Control Unit Power Source |
| 1105 | Image Forming Display Operating Unit |
| 1105a | Power Button (SW1) |
| 1105b | Auto-ON Display Lamp |
| 1105c | Auto-OFF Display Lamp |
| 1105d | Power Display Lamp |
| 1105e | Switch Barrier |
| 1105f | User Settings Button (SW3) |
| 1105g | LCD |
| 1105h | Numerical Keypad |

-continued

| DESCRIPTION OF REFERENCE NUMERALS | |
|---|---|
| 1106 | Image Forming LAN I/F |
| 1107 | Image Forming RS-232C I/F |
| 1200 | Image Forming System |
| 1201 | Power Source |
| 1210 | Image Forming Apparatus |
| 1211 | Image Forming Operation Unit |
| 1212 | First Power Source |
| 1213 | Control Unit |
| 1214 | Operating Unit |
| 1215 | Remote Operation Reception Unit |
| 1220 | Air Cleaning Apparatus |
| 1221 | Air Cleaning Operation Unit |
| 1222 | Second Power Source |
| 2100 | Image Forming Apparatus |
| 2101 | Original Reading Apparatus |
| 2111, 2131 | Control Unit |
| 2112 | Image Data Storage Unit |
| 2113 | Image Processing Unit |
| 2114 | Image Forming Unit |
| 2115 | Facsimile Communication Unit |
| 2116, 2133 | Display Unit |
| 2117 | Input Operating Unit |
| 2118 | Bus |
| 2119, 2134 | Input/Output Unit |
| 2121 | Main Power Source |
| 2122 | Sub Power Source |
| 2132 | Motor |
| 2135 | Power Source |

DESCRIPTION OF THE PREFERRED EMBODIMENTS

Next, image forming systems in embodiments of the present invention will be described in detail based on the drawings.

Embodiment 1

Firstly, Embodiment 1 will be described. FIG. 1 is a block diagram showing a configuration of an image forming system in Embodiment 1 of the present invention. In FIG. 1, an image forming system 1200 in Embodiment 1 is provided with an Image Forming Operation Unit 1211 that executes an image forming operation, an Air Cleaning Operation Unit 1221 that executes an air cleaning operation, a power source 1201 that supplies power to the Image Forming Operation Unit 1211 and the Air Cleaning Operation Unit 1221, and a Control Unit 1213.

In the image forming system 1200, the Control Unit 1213 has a coordinated OFF control function of coordinating a first power supply OFF control for turning off power supply from the power source 1201 to the Image Forming Operation Unit 1211 and a second power supply OFF control for turning off power supply from the power source 1201 to the Air Cleaning Operation Unit 1221.

The coordinated OFF control function executes the second power supply OFF control (OFF control of power supply to the Air Cleaning Operation Unit 1221) a preset time period after executing the first power supply OFF control (OFF control of power supply to the Image Forming Operation Unit 1211).

According to the image forming system 1200, the second power supply OFF control (OFF control of power supply to the Air Cleaning Operation Unit 1221) is executed a preset time period from when the first power supply OFF control (OFF control of power supply to the Image Forming Operation Unit 1211) is executed, by the Control Unit 1213 of the image forming system 1200.

Thus, air in the room or the like where the image forming system 1200 is installed can continue to be cleaned even after the Image Forming Operation Unit 1211 of the image forming system 1200 has stopped operation, and the room or the like where the image forming system 1200 is installed can be effectively kept clean in preparation for the next day. As a result, the environment around the image forming system 1200, such as the room or the like where the image forming apparatus 1200 is installed, can be effectively kept clean, while suppressing power consumption.

The image forming system 1200 may be constituted as follows. That is, the power source 1201 of the image forming system 1200 is provided with a first power source 1212 that supplies power to the Image Forming Operation Unit 1211, and a second power source 1222 that supplies power to the Air Cleaning Operation Unit 1221.

The first power supply OFF control is executed with respect to the first power source 1212, and the second power supply OFF control is executed with respect to the second power source 1222.

This enables the image forming system 1200 to be logically constituted in the case where the image forming system 1200 is constituted by an image forming apparatus 1210 and an air cleaning apparatus 1220, as will be discussed later.

The Control Unit 1213 of the image forming system 1200 may be provided with a plurality of types of the coordinated OFF control function.

As for the types of the coordinated OFF control function, apart from the second power supply OFF control (OFF control of power supply to the Air Cleaning Operation Unit 1221) being executed a fixed time period after the execution of the first power supply OFF control (OFF control of power supply to the Image Forming Operation Unit 1211), the first power supply OFF control (OFF control of power supply to the Image Forming Operation Unit 1211) and the second power supply OFF control (OFF control of power supply to the Air Cleaning Operation Unit 1221) are executed at the same time, for example.

This enables optimal cooperation between the Image Forming Operation Unit 1211 and the Air Cleaning Operation Unit 1221 to be realized in accordance with the situation in the room or the like where the image forming system 1200 is installed, and the room where the image forming system 1200 is installed to be effectively kept clean while suppressing power consumption.

Also, the Control Unit 1213 of the image forming system 1200 may be provided with an Operating Unit 1214 that receives operations from outside. As for the Operating Unit 1214, keys such as numerical keypads, a touch panel superimposed on an LCD (Liquid Crystal Display), or the like are typically employed.

In this case, the Control Unit 1213 of the image forming system 1200 sets the time period, based on an operation received by the operation unit 1214. This enables an optimal time period to be set in accordance with the situation in room or the like where the image forming system is installed.

In the image forming system 1200, the Control Unit 1213 of the image forming system 1200 may select one of the plurality of types of the coordinated OFF control function, based on an operation received by the Operating Unit 1214.

In this case, "based on an operation received by the Operating Unit 1214" specifically means, for example, "based on information input to the Operating Unit 1214 as a result of an operation." This facilitates the selection of one of the plurality of types of the coordinated OFF control function.

In the case, the following configuration may be further adopted. That is, the Control Unit 1213 of the image forming system 1200 may be further provided with an individual OFF control function, in addition to the abovementioned plurality of types of the coordinated OFF control function. This individual OFF control function is for individually executing the first power supply OFF control and the second power supply OFF control independently rather than coordinating them.

The OFF control function selection is executed by the Control Unit 1213 of the image forming system 1200, based on an operation received by the operation unit 1214. This OFF control function selection is a function of selecting either one of the plurality of types of the coordinated OFF control function or the individual OFF control function.

The enables an optimal cooperative function of the Image Forming Operation Unit 1211 and the Air Cleaning Operation Unit 1221 to be selected and realized, out of functions including the individual OFF control function as well as the plurality of types of the coordinated OFF control function, in accordance with the situation in the room or the like where the image forming system 1200 is installed, and the room where the image forming system 1200 is installed to be effectively kept clean while suppressing power consumption.

The image forming system 1200 may also be constituted as follows. That is, the Control Unit 1213 of the image forming system 1200 is provided with a Remote Operation Reception Unit 1215 that receives a remote operation from outside via a communication function.

This Remote Operation Reception Unit 1215 can be realized as follows. For example, a LAN is employed as the communication function, and the Control Unit 1213 of the image forming system 1200 is provided with a function of receiving information input and transmitted from a personal computer connected to this LAN, and holding this received information as the content of a remote operation.

The OFF control function selection is then executed based on a remote operation received by the Remote Operation Reception Unit 1215, and in the example is executed based on information input from a personal computer connected to a LAN, for example.

The enables an optimal cooperative function of the Image Forming Operation Unit 1211 and the Air Cleaning Operation Unit 1221 to be selected and realized with a remote operation, out of functions including the individual OFF control function as well as the plurality of types of the coordinated OFF control function, in accordance with the situation in the room or the like where the image forming system 1200 is installed.

The image forming system 1200 can specifically be constituted by the image forming apparatus 1210 and the air cleaning apparatus 1220. Of these, the image forming apparatus 1210 is constituted by the abovementioned Image Forming Operation Unit 1211, first power source 1212 and Control Unit 1213, and the air cleaning apparatus 1220 is constituted by the abovementioned Air Cleaning Operation Unit 1221 and second power source 1222.

Typically, the image forming apparatus 1210 is constituted by the abovementioned Image Forming Operation Unit 1211, first power source 1212 and Control Unit 1213, and the air cleaning apparatus 1220 is constituted by the abovementioned Air Cleaning Operation Unit 1221 and second power source 1222. Accordingly, the enables the Control Unit 1213 of the image forming system 1200 to be logically constituted.

In the image forming system 1200 constituted by the abovementioned image forming apparatus 1210 and air cleaning apparatus 1220, the air cleaning apparatus 1220 may be provided outside the image forming apparatus 1210. Specifically, the air cleaning apparatus 1220 is, for example, provided above image forming apparatus 1210. Specifically, the air cleaning apparatus 1220 is provided above the image forming apparatus 1210, for example.

Providing the air cleaning apparatus 1220 outside the image forming apparatus 1210 as described above enables an increase in size of the image forming apparatus 1210 to be suppressed, since the air cleaning unit does not need to be provided inside the image forming apparatus 1210.

Also, constitute the image forming system 1200 by thus providing the air cleaning apparatus 1220 outside the image forming apparatus 1210, or, specifically, providing the air cleaning apparatus 1220 above the image forming apparatus 1210, for example, makes it unnecessary to separately provide an independent air cleaning apparatus in the room or the like where the image forming system 1200 is installed. Accordingly, any reduction of the space that can be effectively utilized in the room or the like where the image forming system 1200 is installed can be suppressed.

An ion generating function preferably is employed in the Air Cleaning Operation Unit 1221 used in the image forming system 1200 constituted by the abovementioned image forming apparatus 1210 and the air cleaning apparatus 1220.

This ion generating function is typically a function of simultaneously generating positive and negative ions, enabling airborne bacteria in the air to be effectively eliminated using the positive and negative ions thus generated, and is thus favorable for performing air cleaning.

The image forming system 1200 in which the ion generating function is employed the Air Cleaning Operation Unit 1221 may be configured as follows. That is, the image forming apparatus 1210 is provided with a normal mode in which image forming and related processing is performed, and a power saving mode in which power consumption is less than in the normal mode.

The ion emission direction of the Air Cleaning Operation Unit 1221 provided with the ion generating function differs between the normal mode and the power saving mode.

For example, when in the normal mode, the ion emission direction is oriented toward the main body of the image forming apparatus 1210, and when in the power saving mode, the ion emission direction is oriented other than toward the body of the image forming apparatus 1210, such as upward in the room, for example.

When the image forming apparatus 1210 is in the normal mode, invisible fine particles, fumes and the like can be discharged from the Image Forming Operation Unit 1211, since the image forming apparatus 1210 is operational. Thus, by orienting the ion emission direction toward the main body of the image forming apparatus when the image forming apparatus 1210 is in the normal mode, invisible fine particles, fumes and the like discharged into the room from the image forming apparatus 1210 can principally be removed.

When the image forming apparatus 1210 is in the power saving mode, few invisible fine particles, fumes or the like are discharged into the room from the image forming apparatus 1210, since the image forming apparatus 1210 is nonoperational. Thus, by orienting the ion emission direction upward in the room when the image forming apparatus 1210 is in the power saving mode, invisible fine particles, fumes and the like present in the room can principally be removed.

In the image forming system 1200 constituted by the abovementioned image forming apparatus 1210 and the air cleaning apparatus 1220, the air cleaning apparatus 1220 may be provided inside the image forming apparatus 1210. This makes it unnecessary to provide space for installing the air cleaning apparatus 1220 outside the image forming apparatus 1210.

This also makes it unnecessary to provide an independent air cleaning apparatus separately in the room or the like where the image forming system 1200 is installed. Accordingly, any reduction of the space that can be effectively utilized in the room or the like where the image forming system 1200 is installed can be suppressed.

Embodiment 2

Figure 2:
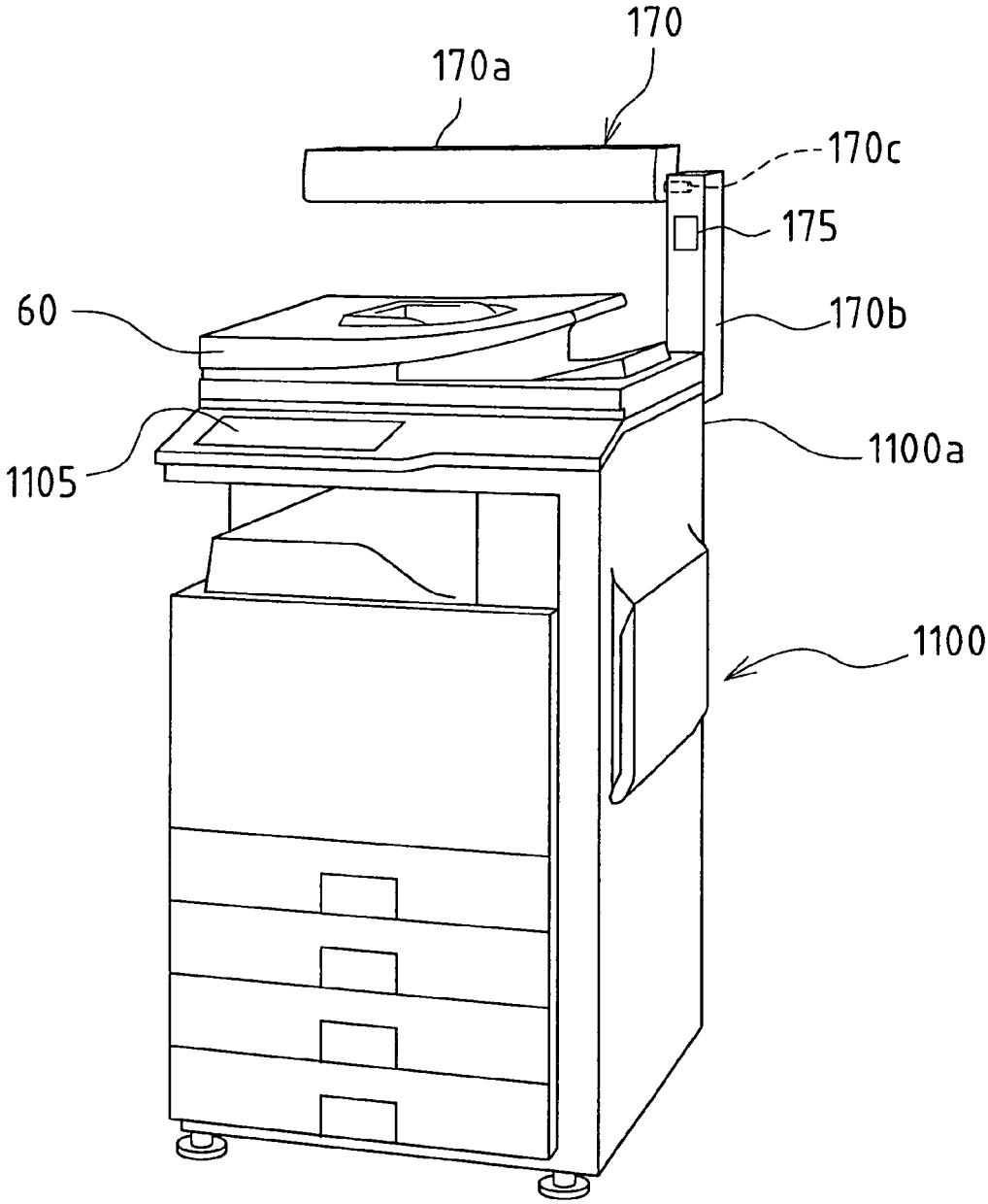
FIG. 2 is a perspective view showing the exterior of an image forming system in Embodiment 2.
Figure 3:
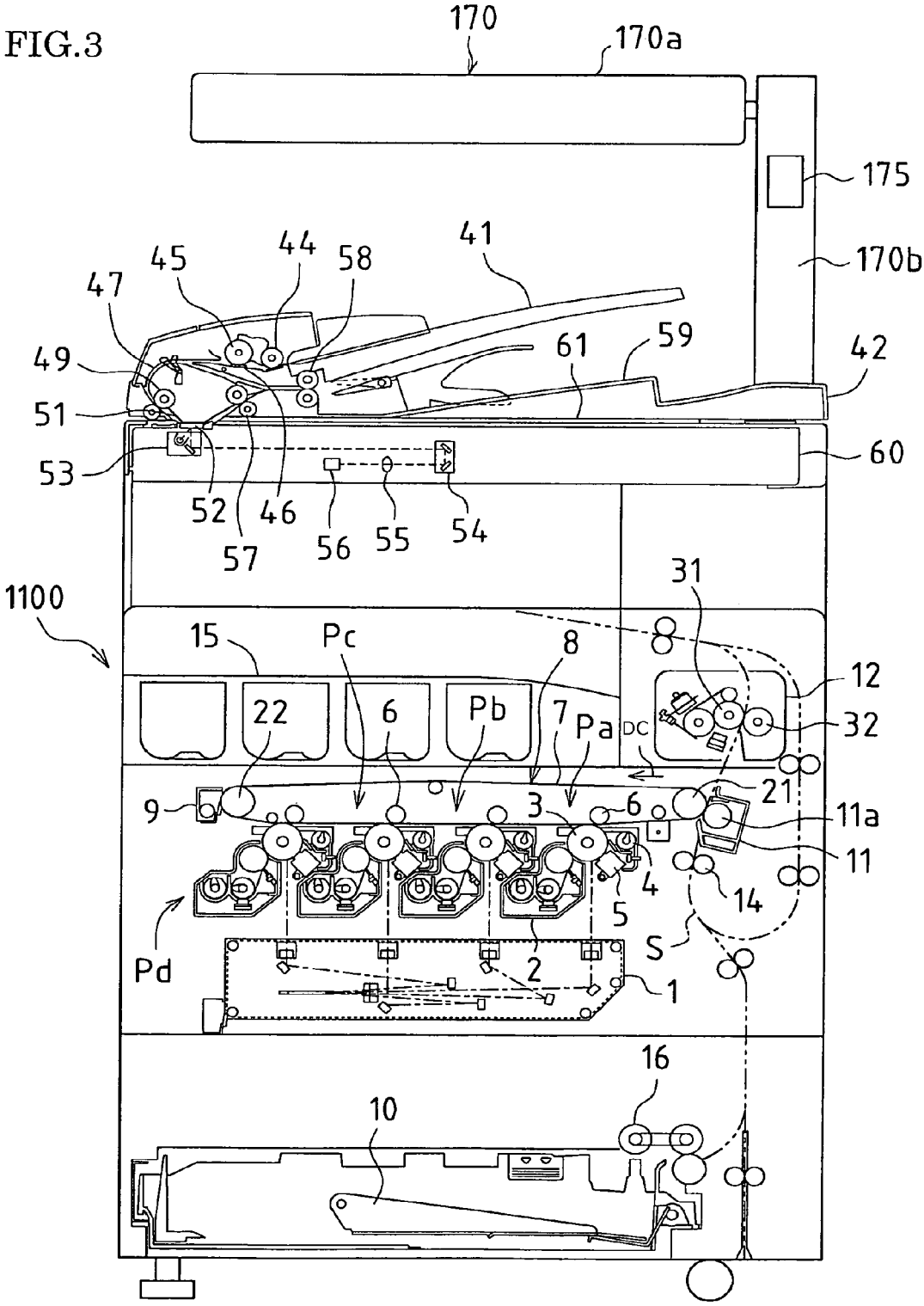
FIG. 3 is a configuration diagram showing the internal configuration of the image forming system in Embodiment 2.
Figure 4:
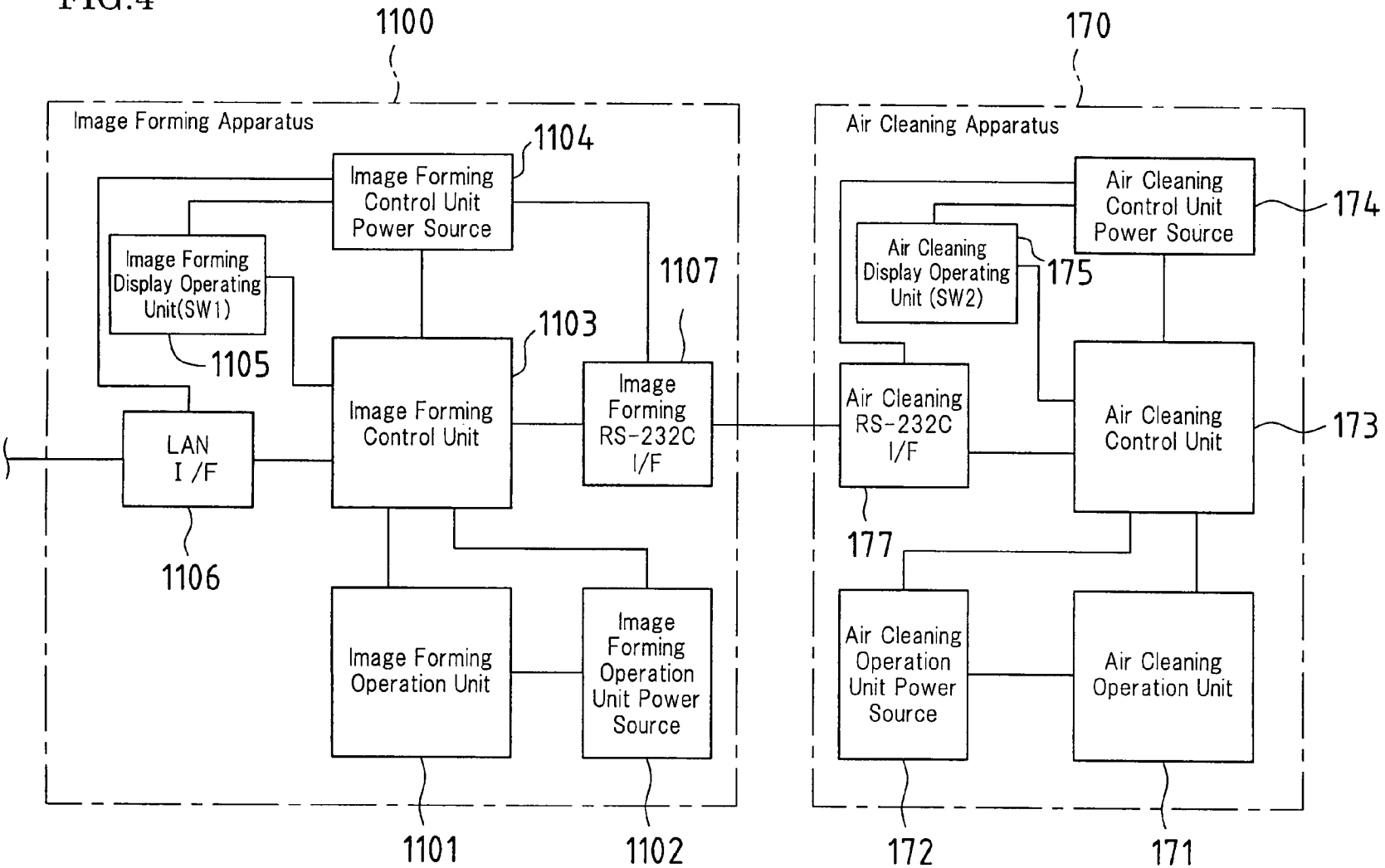
FIG. 4 is a block diagram showing the configuration of the image forming system in Embodiment 2.

Next, Embodiment 2 will be described. FIG. 2 is a perspective view showing the exterior of an image forming system in Embodiment 2, FIG. 3 is a configuration diagram showing the internal configuration of an image forming apparatus 1100 constituting this image forming system, and FIG. 4 is a block diagram showing the configuration of the image forming system.

Description of Exterior Shape of Image Forming System

Firstly, the exterior of the image forming system in Embodiment 2 will be described. In FIG. 2, the image forming system of Embodiment 2 is constituted by an image forming apparatus 1100 that performs an image forming process on recording paper, and an air cleaning apparatus 170 that generates ions and emits the generated ions externally.

The image forming apparatus 1100 is, in terms of exterior shape, a rectangular solid extending in the height direction. This image forming apparatus 1100 is, as shown in FIG. 2, provided with a display Operating Unit 1105 for performing various operations. The side on which the display Operating Unit 1105 is provided will be referred to as the front face of the casing of the image forming apparatus 1100, and the face on the opposite side to this front face will be referred to as the rear face of the casing of the image forming apparatus 1100. An operator who operates this image forming apparatus 1100 performs operations from the front face side of the casing of the image forming apparatus 1100.

The air cleaning apparatus 170 is, in terms of exterior shape, constituted by a main body 170*a* and a support column 170*b*. This air cleaning apparatus 170 is provided outside the casing of the image forming apparatus 1100 as follows.

That is, the main body 170*a* of the air cleaning apparatus 170 is attached to the casing of the image forming apparatus 1100 by the support column 170*b* of the air cleaning apparatus 170, which protrudes upward from an upper corner 1100*a* of the rear face of the casing of the image forming apparatus 1100. In other words, the air cleaning apparatus 170 is attached to the casing of the image forming apparatus 1100 at a distance from the casing of the image forming apparatus 1100.

The main body 170*a* of the air cleaning apparatus 170 is, as shown in FIG. 2, perpendicular with respect to the support column 170*b*, that is, horizontally elongated, and a base end portion of the main body 170*a* of this air cleaning apparatus 170 is supported by a tip of the support column 170*b*.

The main body 170*a* of this air cleaning apparatus 170 is swivelly attached to the support column 170*b* of the air cleaning apparatus 170, as will be discussed later, around the longitudinal direction of the main body 170*a* of this air cleaning apparatus 170. The longitudinal direction of this air cleaning apparatus 170 is the same as the direction that perpendicularly intersects the front-back direction of the casing of the image forming apparatus 1100 in the horizontal plane.

By thus attaching the air cleaning apparatus 170 to the casing of the image forming apparatus 1100 using the support column 170*b*, the air cleaning apparatus 170 can easily be provided outside of the casing of the image forming apparatus 1100. This also enables space necessary for operating the image forming apparatus 1100 to be adequately secured, and enables a configuration to be adopted in which the operability of the image forming apparatus 1100 is not impaired.

Description of the Configuration of Image Forming System

Next, the configuration of the image forming system in Embodiment 2 will be described. In FIG. 4, the image forming system in Embodiment 2 is constituted by the image forming apparatus 1100 and the air cleaning apparatus 170, as abovementioned.

The image forming apparatus 1100 is, in FIG. 4, constituted by an operation unit (hereinafter, Image Forming Operation Unit) 1101 of the image forming apparatus 1100, a power source (hereinafter, Image Forming Operation Unit power source) 1102 for the operation unit of the image forming apparatus 1100, a Control Unit (hereinafter, image forming Control Unit) 1103 of the image forming apparatus 1100, a power source (hereinafter, image forming Control Unit power source) 1104 for the Control Unit of the image forming apparatus 1100, a display Operating Unit (hereinafter, image forming display Operating Unit) 1105 of the image forming apparatus 1100, a LAN I/F (hereinafter, image forming LAN I/F) 1106 of the image forming apparatus 1100, and an RS-232C I/F (hereinafter, image forming RS-232C I/F) 1107 of the image forming apparatus 1100.

The Image Forming Operation Unit 1101 performs the image forming process in the image forming apparatus 1100. The Image Forming Operation Unit power source 1102 supplies power to the Image Forming Operation Unit 1101. The image forming Control Unit 1103 performs various types of control in the image forming apparatus 1100.

This image forming Control Unit 1103 is provided with a CPU and a memory such as flash memory or RAM. An OS and various types of software are loaded into this memory, and the image forming Control Unit 1103 performs control on the Image Forming Operation Unit 1101 and power control that will be discussed later, using the OS and software.

The image forming Control Unit power source 1104 supplies power to the image forming Control Unit 1103, the image forming display Operating Unit 1105, the image forming LAN I/F 1106 and the image forming RS-232C I/F 1107.

Operations by the user of the image forming apparatus 1100 and display relating to the image forming apparatus 1100 are performed on the image forming display Operating Unit 1105. The image forming LAN I/F 1106 is an interface (I/F) for connecting an external device such as a personal computer to the image forming apparatus 1100. The image forming RS-232C I/F 1107 is an interface (I/F) for connecting to the air cleaning apparatus 170.

The constituent elements are housed inside the casing of the image forming apparatus 1100. Of the above, the Image Forming Operation Unit 1101 is equivalent to the aforementioned Image Forming Operation Unit, the Image Forming Operation Unit power source 1102 is equivalent to the aforementioned first power source, the image forming Control Unit 1103 is equivalent to the aforementioned Control Unit, the image forming display Operating Unit 1105 is equivalent to the aforementioned Operating Unit, and the image forming LAN I/F 1106 is equivalent to the aforementioned remote operation receiving unit.

The air cleaning apparatus 170 is, in FIG. 4, constituted by an operation unit (hereinafter, Air Cleaning Operation Unit) 171 of the air cleaning apparatus 170, a power source (hereinafter, Air Cleaning Operation Unit power source) 172 for the operation unit of the air cleaning apparatus 170, a Control Unit (hereinafter, air cleaning Control Unit) 173 of the air cleaning apparatus 170, a power source (hereinafter, air cleaning Control Unit power source) 174 for the Control Unit of the air cleaning apparatus 170, a display Operating Unit (hereinafter, air cleaning display Operating Unit) 175 of the air cleaning apparatus 170, and an RS-232C I/F (hereinafter, air cleaning RS-232C I/F) 177 of the air cleaning apparatus 170.

The Air Cleaning Operation Unit 171 performs an air cleaning process in the air cleaning apparatus 170. The Air Cleaning Operation Unit power source 172 supplies power to the Air Cleaning Operation Unit 171. The air cleaning Control Unit 173 performs various types of control in the air cleaning apparatus 170.

This air cleaning Control Unit 173 is provided with a CPU and a memory such as flash memory or RAM. An OS and various types of software are loaded into this memory, and the air cleaning Control Unit 173 performs control on the Air Cleaning Operation Unit 171 and power control that will be discussed later, using the OS and software.

The air cleaning Control Unit power source 174 supplies power to the air cleaning Control Unit 173, the air cleaning display Operating Unit 175, and the air cleaning RS-232C I/F 177. Operations by the user of the air cleaning apparatus 170 and display relating to the air cleaning apparatus 170 are performed on the air cleaning display Operating Unit 175. The image forming RS-232C I/F 177 is an interface (I/F) for connecting to the image forming apparatus 1100.

Of the above, the Air Cleaning Operation Unit 171 is housed inside the main body 170*a* of the air cleaning apparatus 170, and the remaining constituent elements are distributed inside the support column 170*b* of the air cleaning apparatus 170. Also, of the above, the Air Cleaning Operation Unit 171 is equivalent to the aforementioned Air Cleaning Operation Unit, and the Air Cleaning Operation Unit power source 172 is equivalent to the aforementioned second power source.

The image forming system in Embodiment 2 is, as abovementioned, constituted by the image forming apparatus 1100 for performing an image forming process on recording paper, and the air cleaning apparatus 170 for performing an air cleaning process of generating ions and emitting the generated ions externally. The image forming process in the image forming apparatus 1100 is mainly performed by the Image Forming Operation Unit 1101, and the air cleaning operation in the air cleaning apparatus 170 is mainly performed by the Air Cleaning Operation Unit 171. Therefore, the Image Forming Operation Unit 1101 and the Air Cleaning Operation Unit 171 will be initially described.

Description of Image Forming Operation Unit

Firstly, the Image Forming Operation Unit 1101 will be described. In the Image Forming Operation Unit 1101 of the image forming apparatus 1100, processing that involves an image of an original read by an original reading unit 60 or an image received from outside being recorded on recording paper in color or monochrome is performed by an image forming unit in FIG. 3.

The original reading unit 60 reads an image of an original that is being transported by an original transport unit 42. In the original transport unit 42, when an original is placed in an original placement tray 41, an original pickup roller 44 is pressed against the surface of the original and rotated, and the original is pulled out from the original placement tray 41, passes between a separation roller 45 and a separation pad 46 and is separated sheet by sheet, before being transported to a transport path 47.

On this transport path 47, the leading edge of the original abuts against original registration rollers 49 and is aligned parallel to the original registration rollers 49, and the original is subsequently transported by the original registration rollers 49 and passes between a reading guide 51 and a reading glass 52. Further, the original is transported by transport rollers 57 and discharged into a discharge tray 59 via discharge rollers 58.

In the original reading unit 60, when the original passes between the reading guide 51 and the reading glass 52, light from a light source of a first scanning unit 53 is irradiated onto the surface of the original via the reading glass 52, reflected light from the surface of the original is incident on the first scanning unit 53 via the reading glass 52, reflected light from the first scanning unit is reflected by mirrors of the first scanning unit 53 and a second scanning unit 54 and guided to an imaging lens 55, and an image of the original is formed on a CCD (Charge Coupled Device) 56 by the imaging lens 55. The CCD 56 reads the image of the original, and outputs image data representing the image of the original.

An original placed on a platen glass 61 can also be read. The original transport unit 42 is pivotably supported so as to be openable/closable on the rear face side of the original reading unit 60, and the platen glass 61 is released when this original transport unit 42 is opened, enabling an original to be placed on the platen glass 61.

When the original transport unit 42 is closed after an original has been placed, the surface of the original on the platen glass 61 is exposed by the first scanning unit 53 while the first scanning unit 53 and the second scanning unit 54 are moved in a sub-scanning direction, reflected light from the surface of the original is guided to the imaging lens 55 by the first scanning unit 53 and the second scanning unit 54, and an image of the original is formed on the CCD 56 by the imaging lens 55.

At this time, the first scanning unit 53 and the second scanning unit 54 are moved while maintaining a predetermined speed relation between them, and the positional relation between the first scanning unit 53 and the second scanning unit 54 is constantly maintained such that there is no change in the length of the optical path of the reflected light from the surface of the original to the CCD 56 via the first scanning unit 53, the second scanning unit 54 and the imaging lens 55, with the image of the original on the CCD 56 thereby being constantly kept precisely focused.

The entire image of the original thus read is transmitted to a laser exposure apparatus 1 as image data, and the image is recorded on recording paper.

On the other hand, the image forming unit is constituted by the laser exposure apparatus 1, a developing apparatus 2, a photosensitive drum 3, a charging unit 5, a cleaning apparatus 4, an intermediate transfer belt apparatus 8, a fixing apparatus 12, a paper transport path S, a paper supply tray 10, a paper discharge tray 15, and the like.

Image data handled in the image forming unit corresponds to a color image employing the colors black (K), cyan (C), magenta (M) and yellow (Y), or to a monochrome image employing a single color (e.g., black). Accordingly, four each of the developing apparatus 2, the photosensitive drum 3, the charging unit 5 and the cleaning apparatus 4 are provided so as to form four types of latent image corresponding to the respective colors, and respectively associated with black, cyan, magenta and yellow to constitute four image stations Pa, Pb, Pc and Pd.

The photosensitive drum 3 is drum-like, and an electrostatic latent image is formed on the surface of this drum.

The charging unit 5 is a charging unit for uniformly charging the surface of the photosensitive drum 3 to a predetermined potential, with a contact-type charging unit such as a roller-type or brush-type charging unit being used, as well as a charger-type charging unit.

The laser exposure apparatus 1 is a laser scanning unit (LSU) provided with a laser diode and a reflective mirror, and exposes the charged surface of the photosensitive drum 3 according to the image data to form an electrostatic latent image corresponding to the image data on the surface of the photosensitive drum.

The developing apparatus 2 develops the electrostatic latent image formed on the photosensitive drum 3 using (K, C, M, Y) toner. The cleaning apparatus 4 removes and collects toner remaining on the surface of the photosensitive drum 3 after the developing and image transfer.

The intermediate transfer belt apparatus 8 disposed above the photosensitive drum 3 is provided with an intermediate transfer belt 7, an intermediate transfer belt drive roller 21, a driven roller 22, an intermediate transfer roller 6, and an intermediate transfer belt cleaning apparatus 9.

The intermediate transfer belt drive roller 21, the intermediate transfer roller 6, the driven roller 22 and the like support the intermediate transfer belt 7 in a tensioned state, and move the intermediate transfer belt 7 around in the direction of arrow DC.

The intermediate transfer roller 6 is rotatably supported in the vicinity of the intermediate transfer belt 7, and pressed against the photosensitive drum 3 via the intermediate transfer belt 7, and a transfer bias for transferring a toner image on the photosensitive drum 3 to the intermediate transfer belt 7 is applied thereto.

The intermediate transfer belt 7 is provided so as to contact each photosensitive drum 3, and a color toner image (toner image of each color) is formed by sequentially transferring the toner image on the surface of each photosensitive drum 3 to the intermediate transfer belt 7 in layers. This transfer belt is formed as an endless belt using a film with a thickness of around 100 to 150 μm.

The toner image is transferred from the photosensitive drum 3 to the intermediate transfer belt 7 by the intermediate transfer roller 6 that is pressed against the back surface of the intermediate transfer belt 7. A high-voltage transfer bias (high voltage of opposite polarity (+) to the toner charging polarity (−)) is applied to the intermediate transfer roller 6 in order to transfer the toner image. The intermediate transfer roller 6 has a metal (e.g., stainless steel) shaft with a diameter of 8 to 10 mm as a base, the surface of which is covered by a conductive elastic material (e.g., EPDM, urethane foam, etc.). This conductive elastic material enables a high voltage to be uniformly applied to the recording paper.

As discussed above, the toner images on the surface of photosensitive drums 3 are layered on the intermediate transfer belt 7 to form a color toner image represented by image data. The toner images of the respective colors thus layered are transported in conjunction with the intermediate transfer belt 7, and transferred to the recording paper by a transfer roller 11*a* of a secondary transfer apparatus 11 that contacts the intermediate transfer belt 7.

The intermediate transfer belt 7 and the transfer roller 11*a* of the secondary transfer apparatus 11 are pressed against each other to form a nip. Also, a voltage (high voltage of opposite polarity (+) to the toner charging polarity (−)) for transferring the toner images of the respective colors on the intermediate transfer belt 7 to the recording paper is applied to the transfer roller 11*a* of the secondary transfer apparatus 11. Further, in order to constantly obtain the nip, a hard material (metal, etc.) is used for one of the transfer roller 11*a* of the secondary transfer apparatus 11 or the intermediate transfer belt drive roller 21, and a soft material (elastic rubber roller, foam resin roller, etc.) such as an elastic roller is used for the other.

Toner may remain on the intermediate transfer belt 7 due to the toner images on the intermediate transfer belt 7 not being completely transferred to the recording paper by the secondary transfer apparatus 11, and this residual toner causes mixing of toner colors in the next process. Residual toner is thus removed and collected by the intermediate transfer belt cleaning apparatus 9. The intermediate transfer belt cleaning apparatus 9 is, for example, provided with a cleaning blade that contacts the intermediate transfer belt 7 and removes residual toner as a cleaning member, and the inner side of the intermediate transfer belt 7 is supported by the driven roller 22 at the location where the cleaning blade makes contact.

The paper supply tray 10, which is for storing recording paper, is provided below the image forming unit of the image forming apparatus 1100, and supplies recording paper in the tray.

An S-shaped paper transport path S is provided for feeding recording paper supplied from the paper supply tray 10 to the paper discharge tray 15 via the secondary transfer apparatus 11 and the fixing apparatus 12. Paper pickup rollers 16, paper registration rollers 14, the fixing apparatus 12, transport rollers for transporting recording paper, and the like are disposed along this paper transport path S.

The paper pickup rollers 16 are provided at an end of the paper supply tray 10, and supply recording paper, sheet by sheet, from the paper supply tray 10 to the paper transport path S. A plurality of transport rollers are provided, these being small rollers for facilitating and assisting transportation of recording paper.

The paper registration rollers 14 temporarily stop recording paper that has been transported, align the leading edge of the recording paper, and transport the recording paper in a timely manner in accordance with rotation of the photosensitive drums 3 and the intermediate transfer belt 7, such that the color toner image on the intermediate transfer belt 7 is transferred to the recording paper at the nip between the intermediate transfer belt 7 and the transfer roller 11*a* of the secondary transfer apparatus 11.

For example, the paper registration rollers 14 transport the recording paper so that the leading edge of the color toner image on the intermediate transfer belt 7 coincides with the leading edge of the image forming region of the recording paper at the nip between the intermediate transfer belt 7 and the transfer roller 11*a* of the secondary transfer apparatus 11, based on the detection output of a pre-registration detection switch (not shown).

The fixing apparatus 12 is provided with a heat roller 31, a pressure roller 32, and the like. The heat roller 31 and the pressure roller 32 sandwich and transport recording paper that has passed through the nip between the intermediate transfer belt 7 and the transfer roller 11*a* of the secondary transfer apparatus 11.

The heat roller 31 is controlled so as to be at a predetermined fixing temperature, based on the sensor output of a temperature sensor (not shown), and has a function of fusing, mixing and applying pressure to the toner images transferred to the recording paper to heat-fix the toner images to the recording paper, by thermally compressing the recording paper in conjunction with the pressure roller 32.

The recording paper to which the toner images of the respective colors have been fixed is discharged face-down onto the paper discharge tray 15 by the transport rollers.

Note that the Image Forming Operation Unit 1101 is provided with two states as state modes of the Image Forming Operation Unit 1101. That is, a power saving state and a normal state. The abovementioned operation is performed when the state mode of the Image Forming Operation Unit 1101 is the normal state. In contrast, the abovementioned operation is not performed when the state mode is the power saving state. With the state modes, the normal state is equivalent to the abovementioned normal mode, and the power saving state is equivalent to the abovementioned power saving mode.

Also, in the image forming apparatus 1100, "Copy", "Printer" and "Send image" can be performed using the functions of the abovementioned Image Forming Operation Unit 1101. These functions are selected by pressing a Copy button, a Printer button or a Send Image button shown in FIG. 11 that are provided on the image forming display Operating Unit 1105 of the image forming apparatus 1100.

Figure 11:
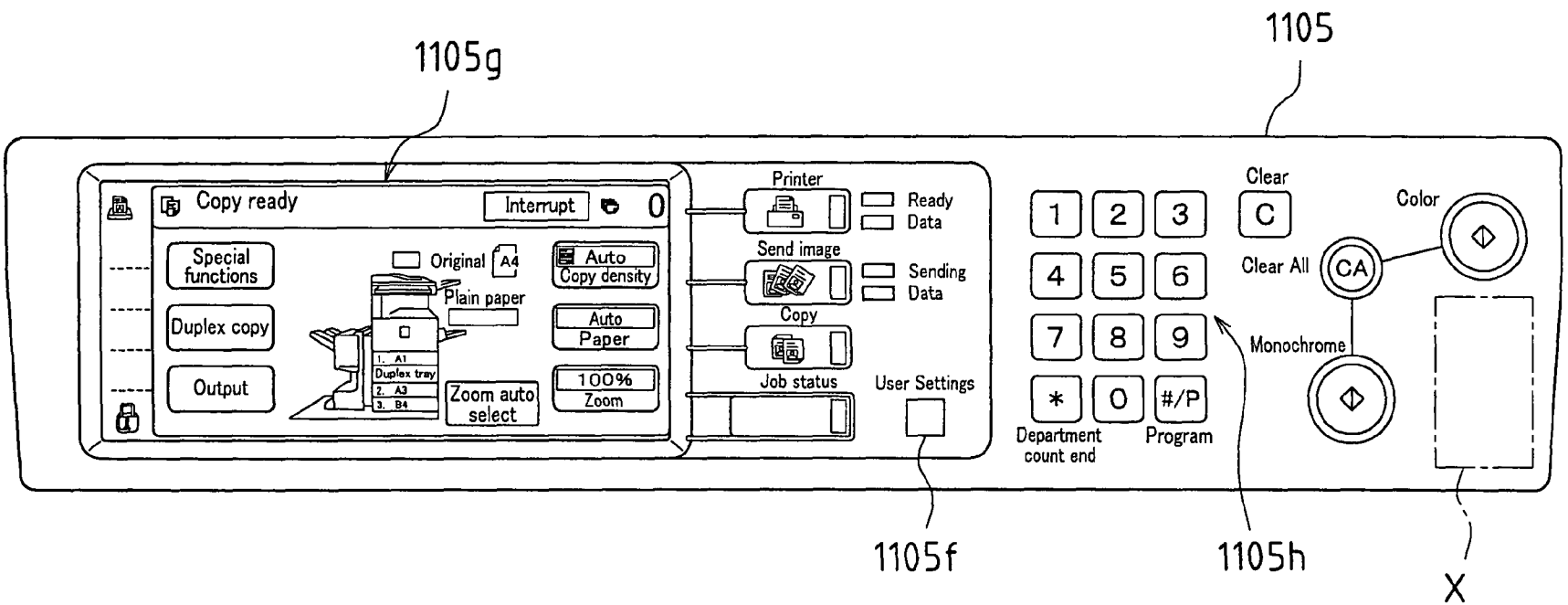
FIG. 11 is a plan view of an image forming display Operating Unit provided in the image forming apparatus of the image forming system in Embodiment 2.

The image forming display Operating Unit 1105 is, as shown in FIG. 11, provided with a Color button for instructing color copying as "Copy", a Monochrome button for instructing monochrome copying, a User Settings button (press-button switch SW3) 1105*f* for configuring various settings on the image forming apparatus 1100, and a numerical keypad 1105*h* for setting the number of copies and the like, as well as the buttons and an LCD (Liquid Crystal Display) 1105*g* provided with a touch panel.

Figure 12:
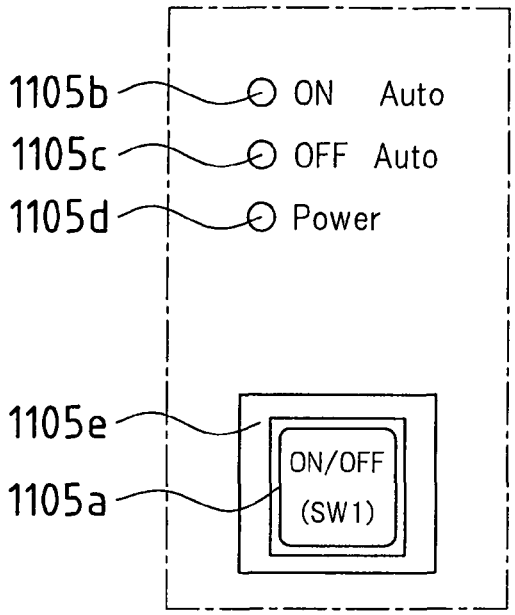
FIG. 12 is an enlarged view of an X portion in FIG. 11.

Also, the image forming display Operating Unit 1105 includes, for use in a power control that will be discussed later, a power button (press-button switch SW1) 1105*a*, an auto-ON display lamp 1105*b*, an auto-OFF display lamp 1105*c*, a power display lamp 1005*d* and a switch barrier 1105*e* that are shown in FIG. 12, which is an enlarged view of the X portion in FIG. 11.

Description of Air Cleaning Operation Unit

Figure 5:
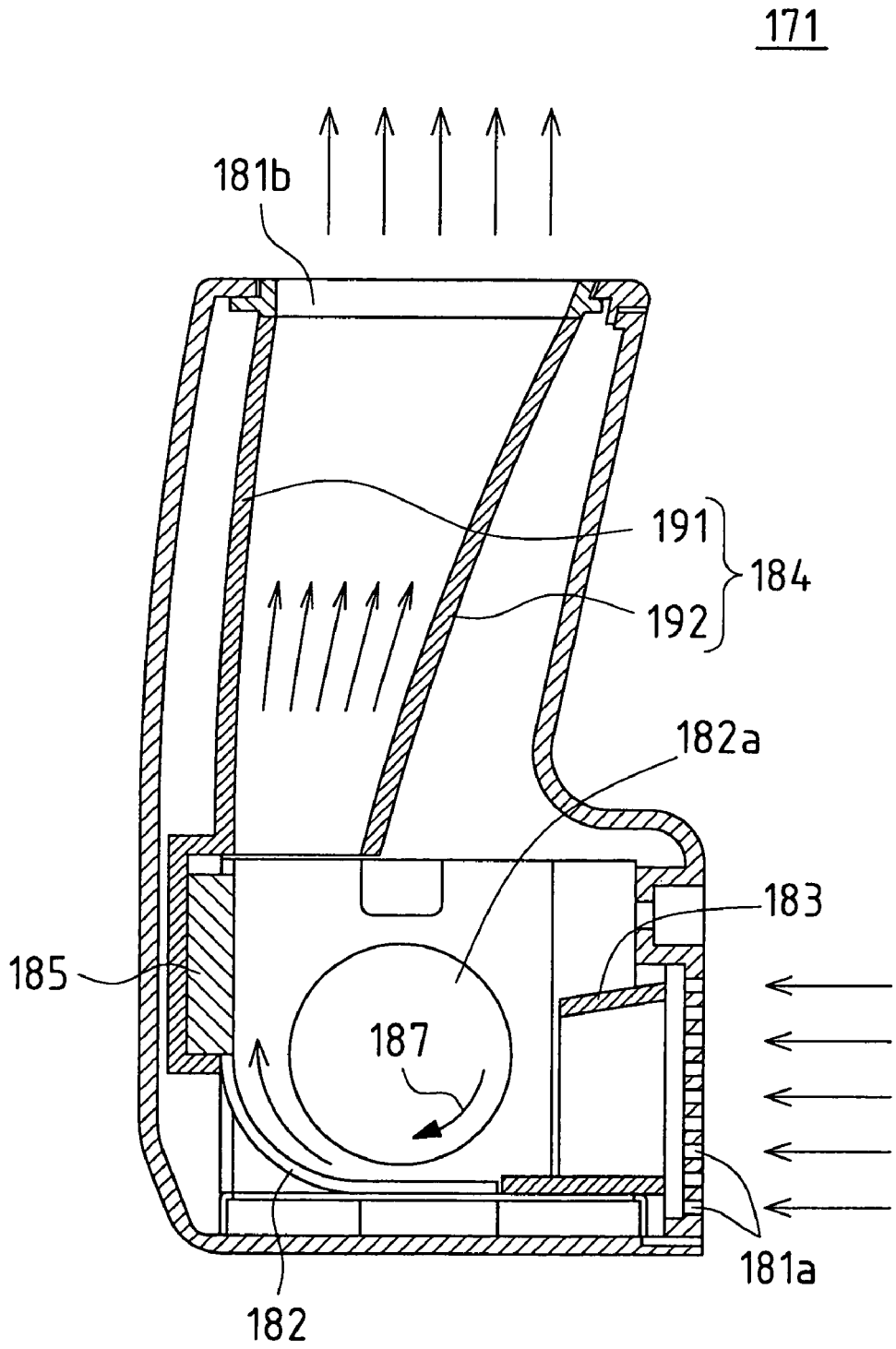
FIG. 5 is a cross-sectional view showing the structure of an Air Cleaning Operation Unit of the image forming system in Embodiment 2.
Figure 6:
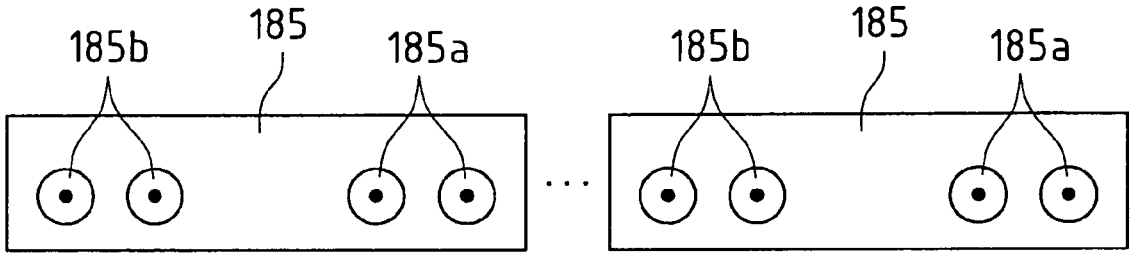
FIG. 6 is a plan view showing ion generating elements built into the Air Cleaning Operation Unit of the image forming system in Embodiment 2.
Figure 7:
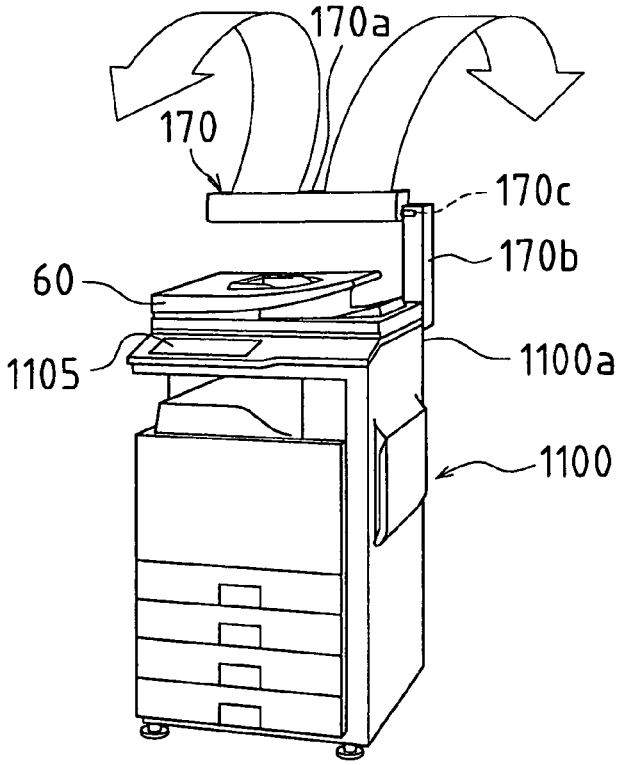
FIG. 7 is a perspective view (1 of 2) showing a state in which an air cleaning apparatus that includes the Air Cleaning Operation Unit is attached to the casing of an image forming apparatus of the image forming system in Embodiment 2.
Figure 8:
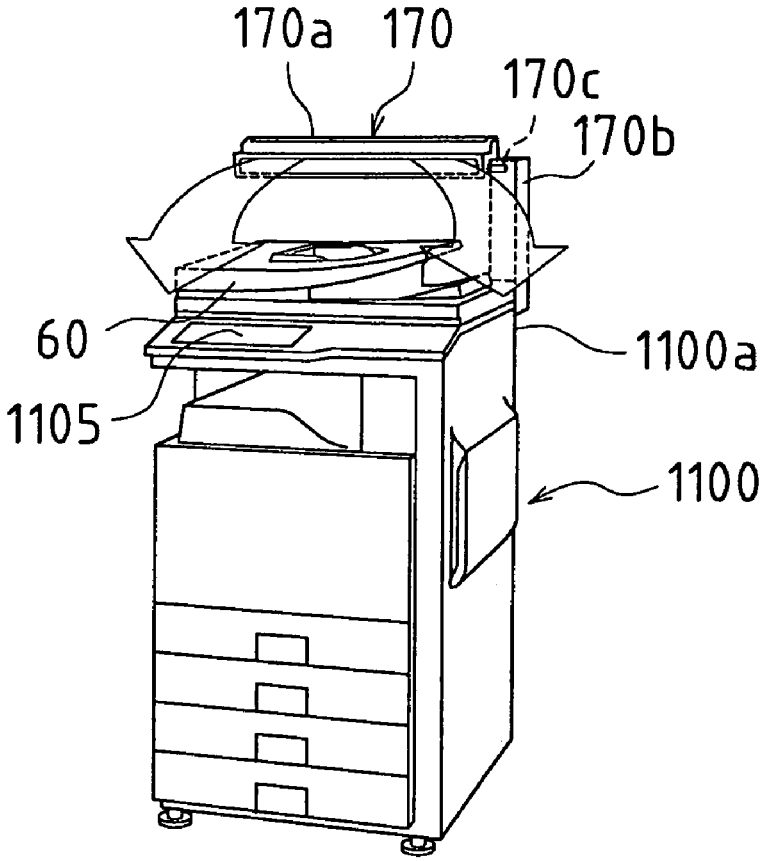
FIG. 8 is a perspective view (2 of 2) showing a state in which an air cleaning apparatus that includes the Air Cleaning Operation Unit is attached to the casing of an image forming apparatus of the image forming system in Embodiment 2.
Figure 9:
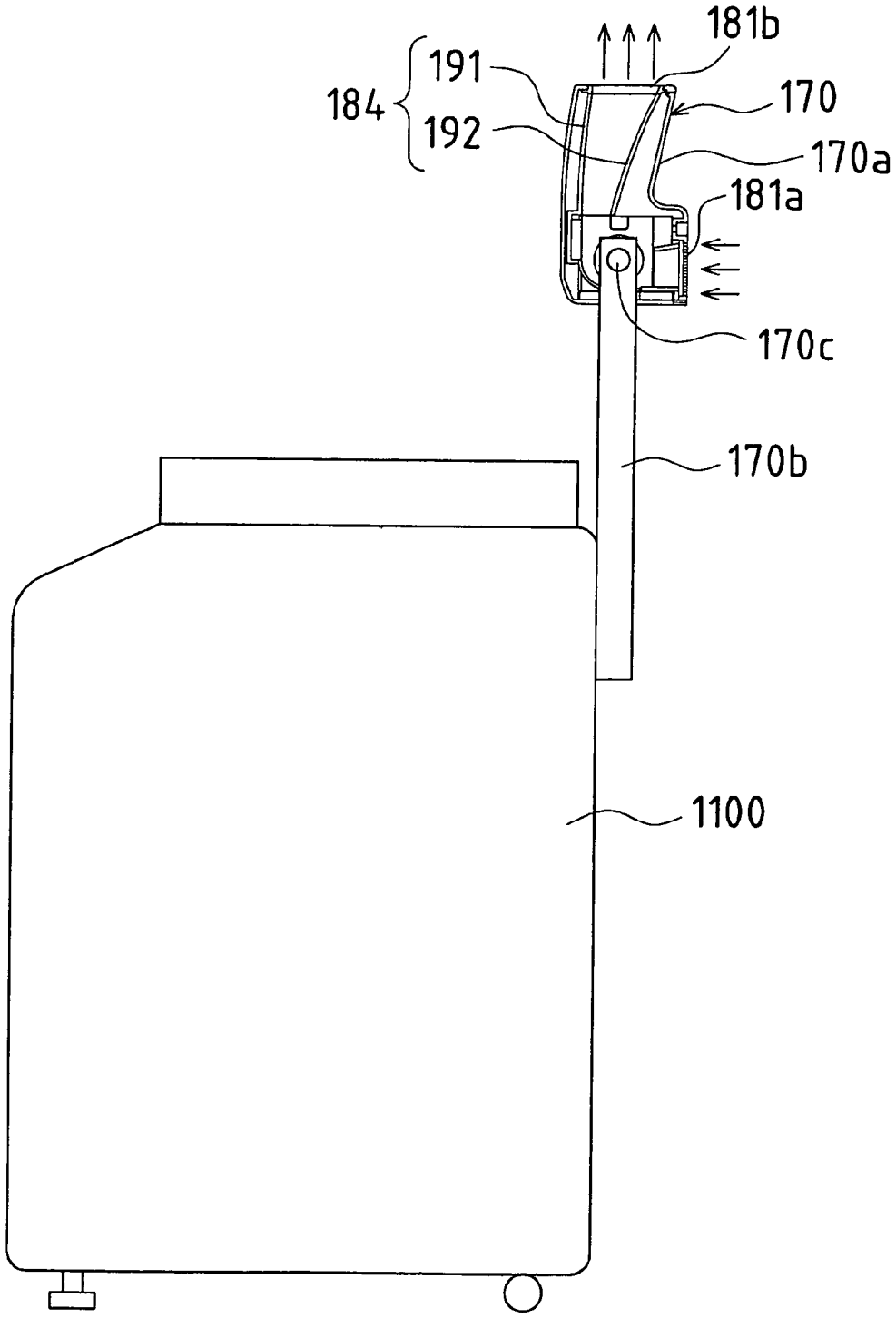
FIG. 9 is a cross-sectional view showing operation in a power saving state of the Air Cleaning Operation Unit of the image forming system in Embodiment 2.
Figure 10:
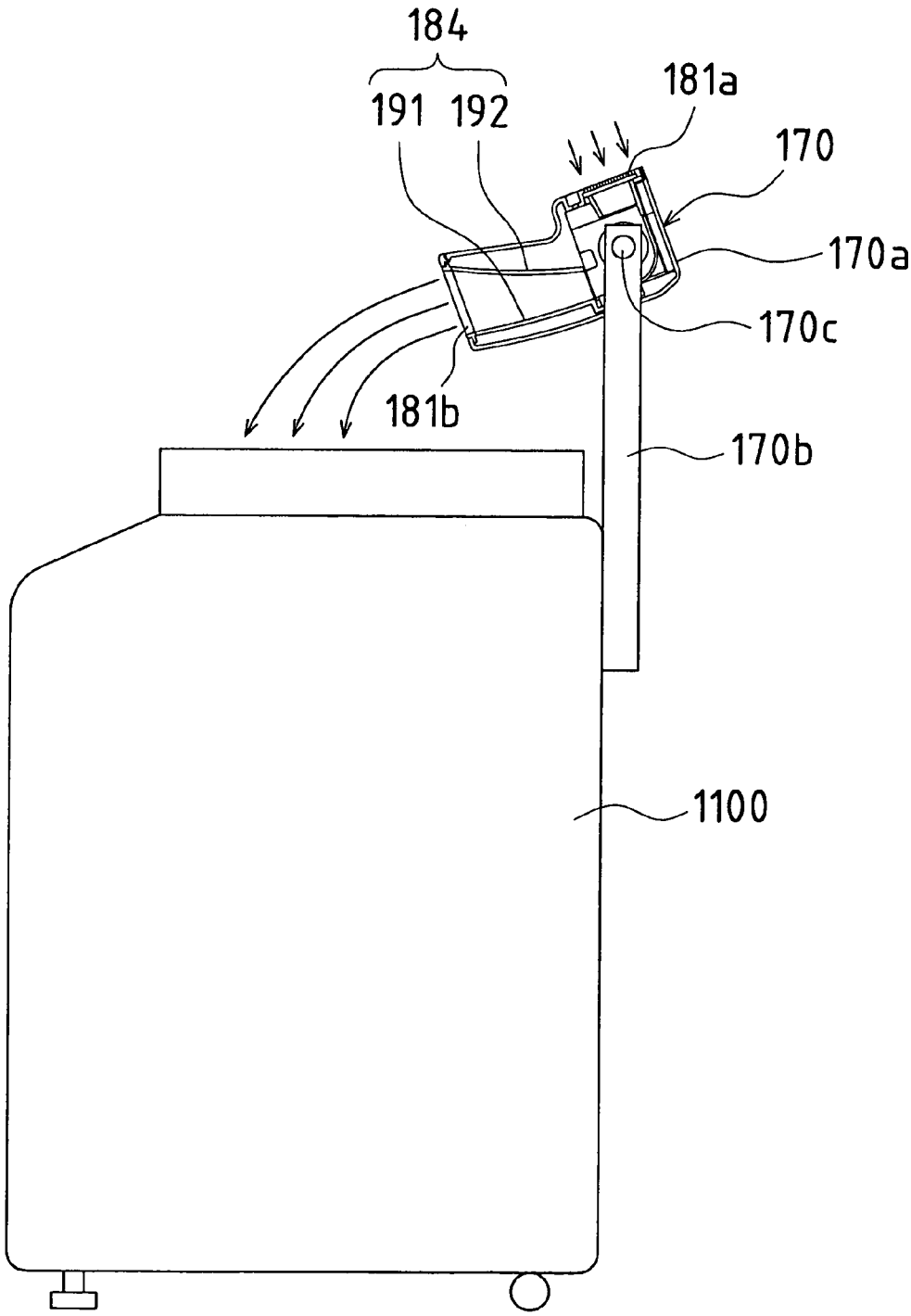
FIG. 10 is a cross-sectional view showing operation in a normal state of the Air Cleaning Operation Unit of the image forming system in Embodiment 2.

Next, the Air Cleaning Operation Unit 171 for performing an air cleaning process that is housed in the main body 170*a* of the air cleaning apparatus 170 will be described. FIG. 5 is a cross-sectional view showing the structure of this Air Cleaning Operation Unit 171, FIG. 6 is a plan view showing ion generating elements 185 built into the Air Cleaning Operation Unit 171, and FIGS. 7 and 8 are perspective views showing a state in which the air cleaning apparatus 170 that includes the Air Cleaning Operation Unit 171 is attached to the casing of the image forming apparatus 1100. FIG. 9 is a cross-sectional view showing operation in the power saving state of the Air Cleaning Operation Unit 171, and FIG. 10 is a cross-sectional view showing operation in the normal state of the Air Cleaning Operation Unit 171. Note that the broad arrows and the line arrows in the figures indicate the direction of airflow.

This Air Cleaning Operation Unit 171, as shown in FIG. 5, has an approximately L-shaped cross-section that bends in the direction of the rear face. Note that in FIG. 5, the left side when facing the drawing is the front face side, and the right side is the rear face side.

The Air Cleaning Operation Unit 171 is constituted as follows. Firstly, a fan unit 182 equipped with a fan 182*a* is built into a lower portion inside the Air Cleaning Operation Unit 171. A plurality of inlet holes 181*a* are formed in the rear face of a lower portion of the Air Cleaning Operation Unit 171, and an upper face outlet opening 181*b* is formed in the upper face of the Air Cleaning Operation Unit 171.

An inlet duct 183 that guides air drawn in through the inlet holes 181*a* to the fan unit 182 is formed between the inlet holes 181*a* and the fan unit 182. An outlet duct 184 that guides air output from the fan unit 182 to the upper face outlet opening 181*b* is formed between the fan unit 182 and the upper face outlet opening 181*b*.

This outlet duct 184 is, as shown in FIG. 5, provided with a fixed duct front wall 191 and a fixed duct rear wall 192. The fixed duct front wall 191 extends from the front edge of the upper face of the fan unit 182 to the front edge of the upper face outlet opening 181*b*, and has a plate-like shape that bulges slightly on the front face side. The fixed duct rear wall 192 extends from the center of the upper face of the fan unit 182 to the rear edge of the upper face outlet opening 181*b*, and has a plate-like shape that bulges slightly on the front face side.

The ion generating elements 185 are provided on the front face side of the fan unit 182 in a lower portion inside the Air Cleaning Operation Unit 171. These ion generating element 185 are configured by Plasmacluster Ion (registered trademark) generating elements (PCI). A plurality of the ion generating elements 185 are, as shown in FIG. 6, arranged in the longitudinal direction of the Air Cleaning Operation Unit 171, that is, in the longitudinal direction of the main body 170*a* of the air cleaning apparatus 170.

These ion generating elements 185 are, as shown in FIG. 6, each constituted by a pair of positive ion generating elements 185*a* that generate positive ions and a pair of negative ion generating elements 185*b* that generate negative ions. Using these positive ion generating elements 185*a* and negative ion generating elements 185*b* enables positive and negative ions to be generated at the same time.

Simultaneously generating positive and negative ions in this way is known to efficiently eliminate airborne bacteria in the air. These ion generating elements 185 are disclosed in detail in JP 2002-58731A, which discloses an invention for which a patent application was lodged by the same applicant as the present invention (assignee of the instant invention).

The fan 182*a* and ion generating elements 185 are connected to the air cleaning Control Unit 173 of the air cleaning apparatus 170 shown in FIG. 4, and the fan 182*a* and the ion generating elements 185 are controlled by this air cleaning Control Unit 173. This control enables fluctuations in the number of ions emitted from the Air Cleaning Operation Unit 171 to be controlled.

Two types of methods are used to control fluctuations in the number of ions emitted from this Air Cleaning Operation Unit 171. The first control method involves increasing or decreasing the air volume of the fan 182*a*.

The air volume of this fan 182*a* is increased or decreased by increasing or decreasing the number of revolutions of the fan 182*a*. The second control method involves increasing or decreasing the number of ion generating elements 185 that are operated.

These methods enable the number of ions generated and emitted by the Air Cleaning Operation Unit 171 to be easily and reliably varied.

With the Air Cleaning Operation Unit 171, air drawn in through the inlet holes 181*a* is discharged to the outside via the fan unit 182 with the positive and negative ions generated by the ion generating elements 185 contained therein, as a result of the fan 182*a* mounted in the fan unit 182 rotating in the direction of arrow 187 indicating the rotation direction, as shown in FIG. 5.

Also, the Air Cleaning Operation Unit 171, that is, the main body 170*a* of the air cleaning apparatus 170 is, as shown in FIGS. 7 to 10, attached to the support column 170*b* so that this main body 170*a* is movable relative to the support column 170*b*, that is, so that the main body 170*a* can swivel.

A swivel drive motor (not shown) is built into the tip of the support column 170*b*, in order to swivel the main body 170*a* of this air cleaning apparatus 170. Also, the main body 170*a* of this air cleaning apparatus 170 is provided with a turning shaft 170*c* for turning, as shown in FIGS. 7 to 10, and this turning shaft 170*c* is configured to engage the rotation shaft of the swivel drive motor.

Swiveling of the main body 170*a* of this air cleaning apparatus 170 is controlled by the air cleaning Control Unit 173 of the air cleaning apparatus 170.

As for the orientation of the main body 170*a*, the main body 170*a* of the air cleaning apparatus 170 is swiveled between a state where the upper face outlet opening 181*b* of the main body 170*a* faces upward, as shown in FIGS. 7 and 9, and a state where the upper face outlet opening 181*b* faces in the direction of the upper face of the casing of the image forming apparatus 1100, as shown in FIGS. 8 and 10. The orientation of this main body 170*a* differs depending on the state of the Image Forming Operation Unit 1101.

That is, when the Image Forming Operation Unit 1101 is in the power saving state, the upper face outlet opening 181*b* of the Air Cleaning Operation Unit 171 faces upward, as shown in FIGS. 7 and 9, and when the image forming apparatus 1101 is in the normal state, the upper face outlet opening 181*b* faces in the direction of the upper face of the casing of the image forming apparatus 1100, as shown in FIGS. 8 and 10.

The Air Cleaning Operation Unit 171 generates and emits fewer ions in the normal state of the Image Forming Operation Unit 1101 than in the power saving state.

That is, when the Image Forming Operation Unit 1101 is in the power saving state, the upper face outlet opening 181*b* of the Air Cleaning Operation Unit 171 faces upward, as shown in FIGS. 7 and 9, and the Air Cleaning Operation Unit 171 generates and emits more ions than in the normal state of the Image Forming Operation Unit 1101.

In contrast, when the Image Forming Operation Unit 1101 is in the normal state, the upper face outlet opening 181*b* of the Air Cleaning Operation Unit 171 faces in the direction of the upper face of the casing of the image forming apparatus 1100, as shown in FIGS. 8 and 10, and the Air Cleaning Operation Unit 171 generates and emits fewer ions than in the power saving state of the Image Forming Operation Unit 1101.

The is based on usage in cases where states such as the following are assumed. That is, when the Image Forming Operation Unit 1101 is in the normal state, the focus is principally on purifying exhaust gases discharged from the casing of the image forming apparatus 1100, and when the Image Forming Operation Unit 1101 is in the power saving state, the focus is principally on purifying the air in the room or the like where the image forming system is installed.

The Air Cleaning Operation Unit 171 enables exhaust gases discharged from the casing of the image forming apparatus 1100 to be purified and the air in the room or the like where the image forming system is installed to be purified, while suppressing increases in the size and cost of the image forming apparatus 1100, because of being able to provide the Air Cleaning Operation Unit 171 outside the casing of this image forming apparatus 1100. That is, the two functions of purifying exhaust gases from the casing of the image forming apparatus 1100 and purifying the air in the room can be served by a single device.

Note that with the Air Cleaning Operation Unit 171, the number of ions generated and emitted by the Air Cleaning Operation Unit 171 is less in the normal state of the Image Forming Operation Unit 1101 than in the power saving state, but that an operation method in which the number of ions is the same in both the power saving state and the normal state of the Image Forming Operation Unit 1101 is also possible.

Also, with the Air Cleaning Operation Unit 171, this Air Cleaning Operation Unit 171 may be attached in state in which the upper face outlet opening 181*b* of the Air Cleaning Operation Unit 171 always faces in the direction of the upper face of the casing of the image forming apparatus 1100, as shown in FIGS. 8 and 10, and the number of ions generated and emitted by the Air Cleaning Operation Unit 171 may be less in the normal state of the Image Forming Operation Unit 1101 than in the power saving state.

This enables air discharged from the Air Cleaning Operation Unit 171 to be diffused in the room or the like where the image forming system is installed when the Image Forming Operation Unit 1101 is in the power saving state, and allows ions to float around the casing of the image forming apparatus 1100 and envelope the periphery of the casing of the image forming apparatus 1100 in the form of an air curtain when the Image Forming Operation Unit 1101 is in the normal state. Accordingly, the also enables the air in the room and exhaust gases discharged from the casing of the image forming apparatus 1100 to be purified.

Description of Power Control of Image Forming System

Incidentally, in the image forming system, the image forming apparatus 1100 is provided with the Image Forming Operation Unit power source 1102 and the image forming Control Unit power source 1104 as power sources, and the air cleaning apparatus 170 is provided with the Air Cleaning Operation Unit power source 172 and the air cleaning Control Unit power source 174 as power sources.

Of these, the image forming Control Unit power source 1104 and the air cleaning Control Unit power source 174 remain on and apply current at all times, so that control can always be performed in the image forming apparatus 1100 and the air cleaning apparatus 170.

In contrast, the Image Forming Operation Unit power source 1102 and the Air Cleaning Operation Unit power source 172 are turned on and apply current when required, and are turned off when not required. A feature of the image forming system is this ON/OFF control of the Image Forming Operation Unit power source 1102 and the Air Cleaning Operation Unit power source 172. Therefore, this will be described next.

In the image forming system, firstly, the Image Forming Operation Unit power source 1102 has power ON/OFF that is performed manually and power ON/OFF that is performed automatically. As discussed above, the image forming apparatus 1100 is provided with the image forming display Operating Unit 1105, and the air cleaning apparatus 170 is provided with the air cleaning display Operating Unit 175.

Figure 13:
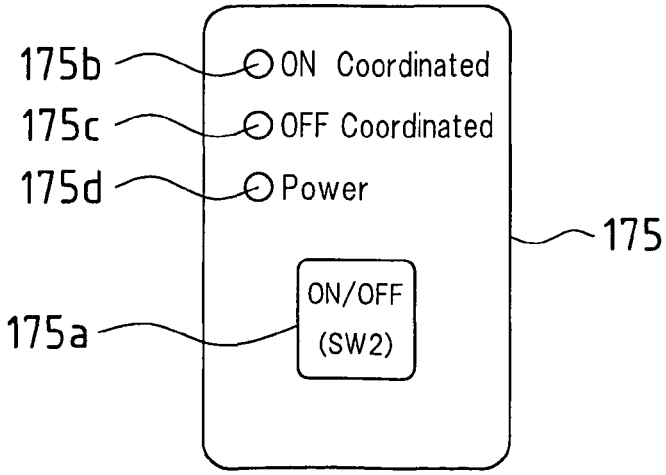
FIG. 13 is a plan view of an air cleaning display Operating Unit provided in the air cleaning apparatus of the image forming system in Embodiment 2.

FIG. 11 is a plan view of the image forming display Operating Unit provided in the image forming apparatus of the image forming system, FIG. 12 is an enlarged view of the X portion in FIG. 11, and FIG. 13 is a plan view of the air cleaning display Operating Unit 175 provided in the air cleaning apparatus 170.

The power button (SW1) 1105*a* (see FIG. 12) provided in this image forming display Operating Unit 1105 is used in the manual operation. This power button (SW1) 1105*a* is formed with a press-button switch. A clock function provided in the image forming Control Unit 1103 is used in the automated operation.

In FIG. 12, the switch barrier 1105*e* is provided in order to prevent the power button (SW1) 1105*a* from being pressed by mistake, and is formed by enclosing the power button (SW1) 1105*a* with a barrier that is higher than this power button (SW1) 1105*a*.

In the image forming display Operating Unit 1105 shown in FIG. 12, the power display lamp 1105*d* is illuminated when the Image Forming Operation Unit power source 1102 is ON, and is extinguished when the Image Forming Operation Unit power source 1102 is OFF. The auto-ON display lamp 1105*b* is illuminated in the case where the Image Forming Operation Unit power source 1102 is automatically turned on using the clock function provided in the image forming Control Unit 1103, and the auto-OFF display lamp 1105*c* is likewise illuminated in the case where the Image Forming Operation Unit power source 1102 is automatically turned off using the clock function provided in the image forming Control Unit 1103.

That is, when both the auto-ON display lamp 1105*b* and the auto-OFF display lamp 1105*c* are illuminated, the power button (SW1) 1105*a* is disabled, and the operation will be disregarded if the power button (SW1) 1105*a* is pressed. In contrast, when either the auto-ON display lamp 1105*b* or the auto-OFF display lamp 1105*c* is illuminated, the power button (SW1) 1105*a* is enabled in the case of being manually operated to perform the function of whichever of the lamps is not illuminated.

In the image forming system, the Air Cleaning Operation Unit power source 172 has power ON/OFF that is coordinated with the Image Forming Operation Unit power source 1102, and power ON/OFF that is performed independently of the Image Forming Operation Unit power source 1102 rather than being coordinated.

As shown in FIG. 4, the image forming Control Unit 1103 and the air cleaning Control Unit 173 are connected via the image forming RS-232C I/F 1107 and the air cleaning RS-232C I/F 177. Power ON/OFF of the Air Cleaning Operation Unit power source 172 and power ON/OFF of the Image Forming Operation Unit power source 1102 are coordinated using the connection between the image forming Control Unit 1103 and the air cleaning Control Unit 173 via the image forming RS-232C I/F 1107 and the air cleaning RS-232C I/F 177. That is, the coordination is, as will be discussed later, performed by instructions from the image forming Control Unit 1103 to the air cleaning Control Unit 173 relating to power supply control of the Air Cleaning Operation Unit power source 172.

When the coordination is performed, it may be the case that the Air Cleaning Operation Unit power source 172 is turned on or off or both on and off at the same time that the Image Forming Operation Unit power source 1102 is turned on or off or both on and off, or this may not be the case.

The following two possibilities exist when the is not the case: one is the case where the Air Cleaning Operation Unit power source 172 is turned on in advance of the time at which the Image Forming Operation Unit power source 1102 is turned on, and the other is the case where the Air Cleaning Operation Unit power source 172 is turned off at a delay from the time at which the Image Forming Operation Unit power source 1102 is turned off.

The Air Cleaning Operation Unit power source 172 is independently turned on/OFF irrespective of power ON/OFF of the Image Forming Operation Unit power source 1102 in the following manner. That is, the support column 170*b* of the air cleaning apparatus 170 is provided with the air cleaning display Operating Unit 175 shown in FIG. 13, and a power button (SW2) 175*a* provided in this air cleaning display Operating Unit 175 is used to turn the Air Cleaning Operation Unit power source 172 ON/OFF independently of the Image Forming Operation Unit power source 1102. The power button (SW2) 175*a* is formed with a press-button switch.

Also, with the air cleaning display Operating Unit 175 shown in FIG. 13, a power display lamp 175*d* is illuminated when the Air Cleaning Operation Unit power source 172 is ON, and extinguished when the Air Cleaning Operation Unit power source 172 is OFF. Also, a coordinated ON display lamp 175*b* is illuminated in the case where the Air Cleaning Operation Unit power source 172 is turned on in coordination with the Image Forming Operation Unit power source 1102, and a coordinated OFF display lamp 175*c* is illuminated in the case where the Air Cleaning Operation Unit power source 172 is turned off in coordination with the Image Forming Operation Unit power source 1102.

That is, when both the coordinated ON display lamp 175*b* and the coordinated OFF display lamp 175*c* are illuminated, the power button (SW2) 175*a* is disabled, and the operation will be disregarded if the power button (SW2) 175*a* is pressed. In contrast, when either the coordinated ON display lamp 175*b* or the coordinated OFF display lamp 175*c* is illuminated, the power button (SW2) 175*a* is enabled in the case of being manually operated to perform the function of whichever of the lamps is not illuminated.

In relation to the abovementioned power control, the method used is selected and determined by settings configured using the LCD (Liquid Crystal Display) 1105*g* with touch panel of the image forming display Operating Unit 1105 provided in the image forming apparatus 1100, as will be discussed in detail later.

Figures 16, 17:
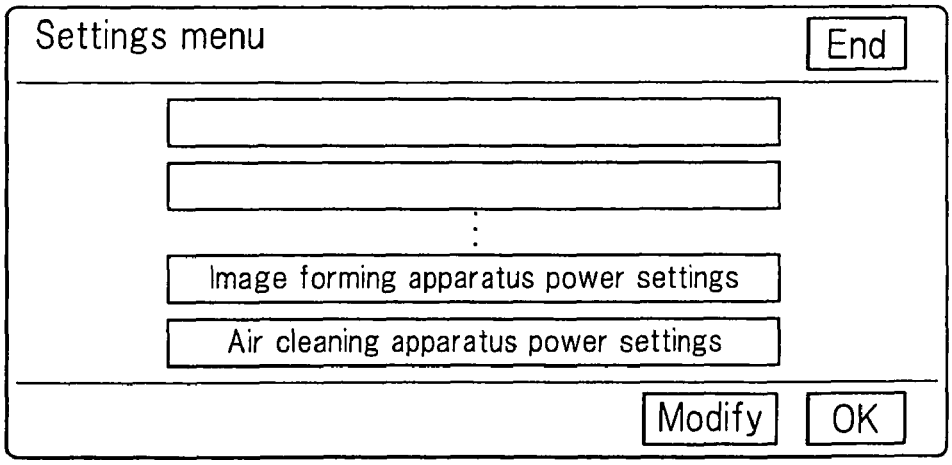
FIG. 16 is a data list table (2 of 2) provided in the image forming Control Unit of the image forming system in Embodiment 2.
FIG. 17 is a diagram (1 of 7) of a setting display screen of the image forming display Operating Unit of the image forming system in Embodiment 2.

In the image forming system, the memory provided in the image forming Control Unit 1103 is provided with the flags shown in FIG. 14 and the data shown in FIGS. 15 and 16, in order to realize the power control function. Of these, all of the data shown FIG. 15 and the remaining data excluding an air cleaning power-ON time t3 and an air cleaning power-OFF time t4 from the data shown in FIG. 16 are configured by the settings using the LCD (Liquid Crystal Display) 1105*g* with touch panel of the image forming display Operating Unit 1105.

The flags shown in FIG. 14 include an image forming power ON/OFF instruction flag F1, an air cleaning power ON/OFF instruction flag F2, an image forming power saving state flag F3, and an image forming in-progress flag F4.

The image forming power ON/OFF instruction flag F1 is for instructing the ON state/OFF state of the Image Forming Operation Unit power source 1102, with F4=0 indicating a power-OFF state instruction, and F1=1 a power-ON state instruction.

That is, the image forming Control Unit 1103 turns on the Image Forming Operation Unit power source 1102 when the image forming power ON/OFF instruction flag F1 changes from F1=0 to F1=1, and turns off the Image Forming Operation Unit power source 1102 when the image forming power ON/OFF instruction flag F1 changes from F1=1 to F1=0.

The air cleaning power ON/OFF instruction flag F2 is for instructing the ON state/OFF state of the Air Cleaning Operation Unit power source 172, with F2=0 indicating a power-OFF state instruction, and F2=1 a power-ON state instruction.

That is, the image forming Control Unit 1103 notifies an Air Cleaning Operation Unit power source 172 ON instruction to the air cleaning Control Unit 173 via the image forming RS-232C I/F 1107 and the air cleaning RS-232C I/F 177 when the air cleaning power ON/OFF instruction flag F2 changes from F2=0 to F2=1. The air cleaning Control Unit 173, having received notification of this Air Cleaning Operation Unit power source 172 ON instruction, turns on the Air Cleaning Operation Unit power source 172.

Also, the image forming Control Unit 1103 notifies an Air Cleaning Operation Unit power source 172 OFF instruction to the air cleaning Control Unit 173 via the image forming RS-232C I/F 1107 and the air cleaning RS-232C I/F 177 when the air cleaning power ON/OFF instruction flag F2 changes from F2=1 to F2=0. The air cleaning Control Unit 173, having received notification of the Air Cleaning Operation Unit power source 172 OFF instruction, turns the Air Cleaning Operation Unit power source 172 OFF.

The image forming power saving state flag F3 represents the state of the Image Forming Operation Unit 1101, with F3=0 representing the Image Forming Operation Unit 1101 being in the normal state, and F3=1 representing the Image Forming Operation Unit 1101 being in the power saving state.

The image forming in-progress flag F4 represents whether or not the Image Forming Operation Unit 1101 is operating, with F4=0 representing the Image Forming Operation Unit 1101 not operating, and F4=1 representing the Image Forming Operation Unit 1101 operating. Note that F4=1 only occurs when the Image Forming Operation Unit 1101 is in the normal state, that is, while the image forming power saving state flag F3 is F3=0.

The data shown in FIG. 15 includes an image forming auto power-ON determination D1, an image forming auto power-OFF determination D2, an air cleaning coordinated power-ON determination D3, an air cleaning coordinated power-OFF determination D4, an air cleaning advanced power-ON determination D5, and an air cleaning delayed power-OFF determination D6.

The image forming auto power-ON determination D1 represents whether or not to turn the Image Forming Operation Unit power source 11020N automatically, with D1=0 representing not to turn power ON automatically and D1=1 representing to turn power ON automatically.

The image forming auto power-OFF determination D2 represents whether or not to turn the Image Forming Operation Unit power source 1102 OFF automatically, with D2=0 representing not to turn power OFF automatically and D2=1 representing to turn power OFF automatically.

The air cleaning coordinated power-ON determination D3 represents whether or not to coordinate turning on the Air Cleaning Operation Unit power source 172 with turning on the Image Forming Operation Unit power source 1102, with D3=0 representing not to coordinate the turning on and D3=1 representing to coordinate the turning on.

The air cleaning coordinated power-OFF determination D4 represents whether or not to coordinate turning off the Air Cleaning Operation Unit power source 172 with turning off the Image Forming Operation Unit power source 1102, with D4=0 representing not to coordinate the turning off and D4=1 representing to coordinate the turning off.

The air cleaning advanced power-ON determination D5 represents whether or not to turn on the Air Cleaning Operation Unit power source 172 in advance of turning on the Image Forming Operation Unit power source 1102, with D5=0 representing not to turn on in advance and D5=1 representing to turn on in advance.

If D5=0, the Air Cleaning Operation Unit power source 172 is turned on at the same time as the Image Forming Operation Unit power source 1102. If D5=1, the Air Cleaning Operation Unit power source 172 is turned in advance of turning on the Image Forming Operation Unit power source 1102, although this is limited to the case where the image forming auto power-ON determination D1=1.

The air cleaning delayed power-OFF determination D6 represents whether or not to turn off the Air Cleaning Operation Unit power source 172 at a delay from turning off the Image Forming Operation Unit power source 1102, with D6=0 representing not to turn off at a delay and D6=1 representing to turn off at a delay.

The data shown in FIG. 16 includes an image forming power-ON time t1, an image forming power-OFF time t2, an air cleaning advanced power-ON time period (min.) T1, an air cleaning delayed power-OFF time period (min.) T2, air cleaning power-ON time t3, and an air cleaning power-OFF time t4.

The image forming power-ON time t1 is data set in the case where the image forming auto power-ON determination D1=1, and represents the time for turning on the Image Forming Operation Unit power source 1102.

The image forming power-OFF time t2 is data set in the case where the image forming auto power-OFF determination D2=1, and represents the time for turning off the Image Forming Operation Unit power source 1102.

The air cleaning advanced power-ON time period (min.) T1 is data set in the case where the air cleaning advanced power-ON determination D5=1, and represents the amount of time by which the Air Cleaning Operation Unit power source 172 is to be turned on in advance of the Image Forming Operation Unit power source 1102 being turned on. The maximum air cleaning advanced power-ON time period (min.) T1 is assumed to be 120 minutes.

The air cleaning delayed power-OFF time period (min.) T2 is data set in the case where the air cleaning delayed power-OFF determination D6=1, and represents the amount of time by which the Air Cleaning Operation Unit power source 172 is to be turned off at a delay from the Image Forming Operation Unit power source 1102 being turned off. The maximum air cleaning delayed power-OFF time period (min.) T2 is assumed to be 120 minutes.

The air cleaning power-ON time t3 is the time for turning on the Air Cleaning Operation Unit power source 172, and, in the case where the air cleaning advanced power-ON determination D5=1, is automatically calculated and set by the image forming Control Unit 1103 based on the air cleaning advanced power-ON time period (min.) T1.

That is, in the case where the image forming auto power-ON determination D1=1, t3=t1−T1 is calculated because t1 will have been set. In contrast, in the case where the image forming auto power-ON determination D1=0, t3 cannot be derived because t1 will not have been set. Therefore, in this case, the Air Cleaning Operation Unit power source 172 is turned on at the same time that the Image Forming Operation Unit power source 1102 is actually turned on, rather than using t3.

The air cleaning power-OFF time t4 is the time for turning off the Air Cleaning Operation Unit power source 172, and, in the case where the air cleaning delayed power-OFF determination D6=1, is automatically calculated and set by the image forming Control Unit 1103 based on the air cleaning delayed power-OFF time period (min.) T2.

That is, in the case where the image forming auto power-OFF determination D2=1, t4=t2+T2 is calculated because t2 will have been set. In contrast, in the case where the image forming auto power-OFF determination D2=0, t2 will not have been set. Because the Image Forming Operation Unit power source 1102 is turned off manually in this case, t4=tf+T2 is calculated using the time tf at which the Image Forming Operation Unit power source 1102 is actually turned off.

As discussed above, all of the data shown in FIG. 15 and the remaining data excluding the air cleaning power ON time t3 and the air cleaning power-OFF time t4 from the data shown in FIG. 16 are configured by the abovementioned settings using the LCD (Liquid Crystal Display) 1105*g* with touch panel of the image forming display Operating Unit 1105. In view of this, the setting of this data will be described next.

Note that with settings configured using the LCD (Liquid Crystal Display) 1105*g* with touch panel of the image forming display Operating Unit 1105 that will be discussed later, the Image Forming Operation Unit power source 1102 is displayed as "Image forming apparatus power source", and the Air Cleaning Operation Unit power source 172 is displayed as "Air cleaning apparatus power source" on the LCD (Liquid Crystal Display) 1105*g* with touch panel.

FIGS. 17 to 23 are screens that are employed in the settings configured using the LCD (Liquid Crystal Display) 1105*g* with touch panel of the image forming display Operating Unit 1105. To set this data, the user of the image forming system firstly presses the User Settings button (SW3) 1105*f* of the image forming display Operating Unit 1105 shown in FIG. 11.

The "Settings menu" screen of FIG. 17 is then displayed on the LCD (Liquid Crystal Display) 1105*g* with touch panel of the image forming display Operating Unit 1105. "Image forming apparatus power settings" and "Air cleaning apparatus power settings" are displayed on this display screen together with other setting items, as display with respect to which input is performed when the user of the image forming system touches the screen display.

Other display with respect to which input is performed when the screen is touched includes "End" "Modify" and "OK". Of these, when the "End" is touched, the setting process ends, and the screen of the LCD (Liquid Crystal Display) 1105*g* with touch panel of the image forming display Operating Unit 1105 returns to the state prior to the User Settings button (SW3) 1105*f* of the image forming display Operating Unit 1105 being pressed.

When the "Modify" is touched, input on the screen can be modified. When "OK" is touched, input information on the screen is confirmed and input is ended, after which processing moves to the next stage. Note that "Modify" and "OK" are applicable to all of the screens discussed below. "End" is only used on the screen of FIG. 17, and on screens other than FIG. 17, "Back" is displayed instead of "End". When "Back" is touched, display returns to the previous screen.

Figure 18:
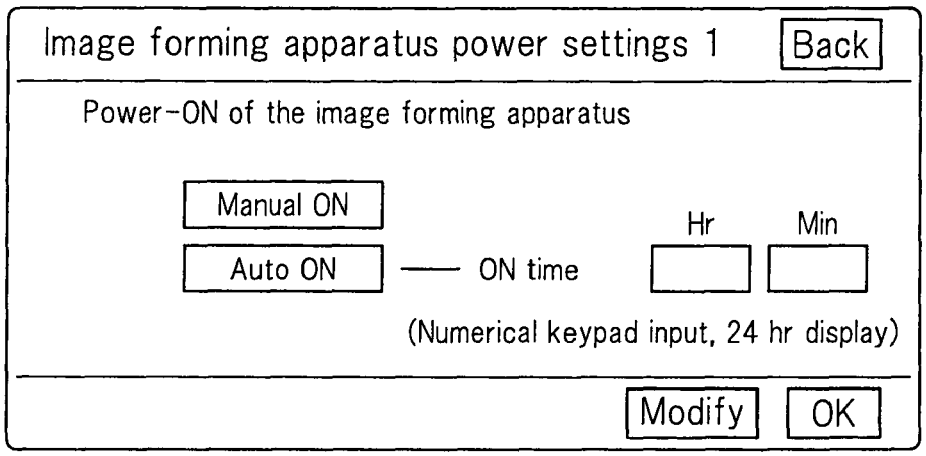
FIG. 18 is a diagram (2 of 7) of a setting display screen of the image forming display Operating Unit of the image forming system in Embodiment 2.

When "Image forming apparatus power settings" is touched on the "Settings menu" screen of FIG. 17, display moves to the "Image forming apparatus power settings 1" screen of FIG. 18.

"Image forming apparatus power settings 1" screen of FIG. 18 is for configuring settings related to power-ON of the Image Forming Operation Unit power source 1102. When "Manual ON" followed by "OK" are touched on the "Image forming apparatus power settings 1" screen of FIG. 18, image forming auto power-ON determination D1=0 is set, and display moves to the "Image forming apparatus power settings 2" screen of FIG. 19.

When "Auto ON" is touched on the "Image forming apparatus power settings 1" screen of FIG. 18, an "ON time" is further input in this case in the order "hr" "min" with 24-hour display, using the numerical keypad 1105*h* provided on display Operating Unit 1105. When "OK" is touched after this input, image forming auto power-ON determination D1=1 is set, and the time that was input is further set in the image forming power-ON time t1, after which display moves to the "Image forming apparatus power settings 2" screen of FIG. 19.

Figure 19:
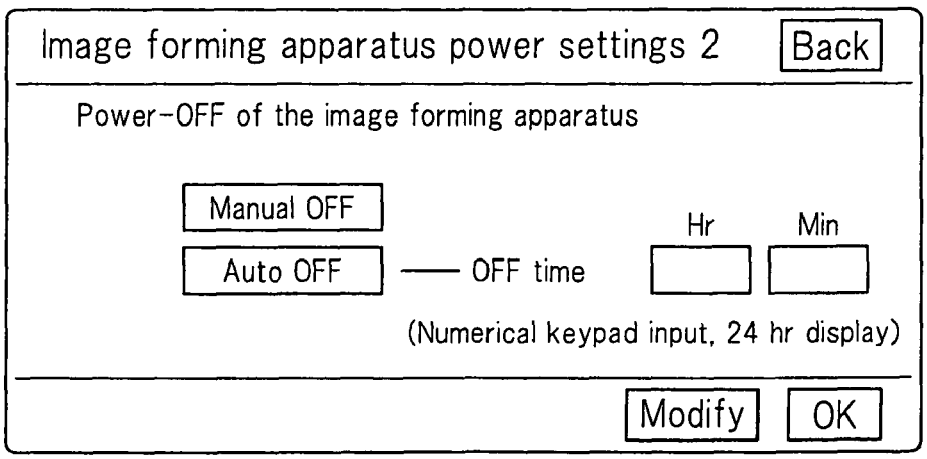
FIG. 19 is a diagram (3 of 7) of a setting display screen of the image forming display Operating Unit of the image forming system in Embodiment 2.

The "Image forming apparatus power settings 2" screen of FIG. 19 is for configuring settings related to power-OFF of the Image Forming Operation Unit power source 1102. When "Manual OFF" followed by "OK" are touched on the "Image forming apparatus power settings 2" screen of FIG. 19, image forming auto power-OFF determination D2=0 is set, and display then moves to the "Settings menu" screen of FIG. 17.

When "Auto OFF" is touched on the "Image forming apparatus power settings 2" screen of FIG. 19, an "OFF time" is further input in this case in the order "hr" then "min" with 24-hour display, using the numerical keypad 1105*h* provided on display Operating Unit 1105. When "OK" is touched after this input, image forming auto power-OFF determination D2=1 is set, and the time that was input is further set in the image forming power-OFF time t2, after which display moves to the "Settings menu" screen of FIG. 17.

Next, when the "Air cleaning apparatus power settings" is touched on the "Setting menu" screen of FIG. 17, display moves to the "Air cleaning apparatus power settings 1-1" screen of FIG. 20.

The "Air cleaning apparatus power settings 1-1" screen of FIG. 20 is for configuring settings related to whether to coordinate power-ON of the Air Cleaning Operation Unit power source 172 with power-ON of the Image Forming Operation Unit power source 1102.

Figure 22:
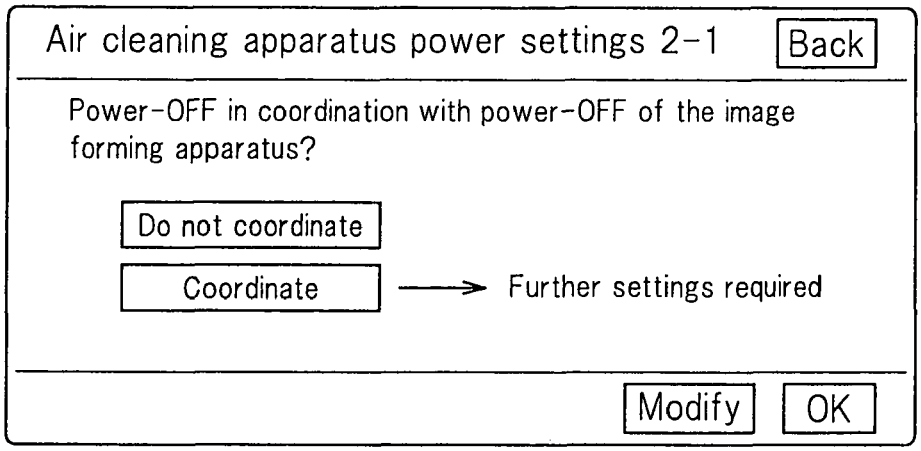
FIG. 22 is a diagram (6 of 7) of a setting display screen of the image forming display Operating Unit of the image forming system in Embodiment 2.

When "Do not coordinate" followed by "OK" are touched on the "Air cleaning apparatus power settings 1-1" screen of FIG. 20, air cleaning coordinated power-ON determination D3=0 is set, and display next moves to the "Air cleaning apparatus power settings 2-1" screen of FIG. 22.

When "Coordinate" followed by "OK" are touched on the "Air cleaning apparatus power settings 1-1" screen of FIG. 20, air cleaning coordinated power-ON determination D3=1 is set, and display next moves to the "Air cleaning apparatus power settings 1-2" screen of FIG. 21 given that further settings are required in this case.

The "Air cleaning apparatus power settings 1-2" screen of FIG. 21 is for configuring settings related to whether power-ON of the Air Cleaning Operation Unit power source 172 is to be performed at the same time as power-ON of the Image Forming Operation Unit power source 1102, or whether power-ON of the Air Cleaning Operation Unit power source 172 is to be performed in advance of power-ON of the Image Forming Operation Unit power source 1102.

When "At the same time" followed by "OK" are touched on the "Air cleaning apparatus power settings 1-2" screen of FIG. 21, air cleaning advanced power-ON determination D5=0 is set, and display moves to the "Air cleaning apparatus power settings 2-1" screen of FIG. 22.

When "In advance" is touched on the "Air cleaning apparatus power settings 1-2" screen of FIG. 21, an "Advance time period (min.)" is further input in this case, using the numerical keypad 1105*h* provided on the image forming display Operating Unit 1105. When "OK" is touched after this input, air cleaning advanced power-ON determination D5=1 is set, and the time period (min.) that was input is further set in the air cleaning advanced power-ON time period (min.) T1, after which display moves to the "Air cleaning apparatus power settings 2-1" screen of FIG. 22.

The "Air cleaning apparatus power settings 2-1" screen of FIG. 22 is for configuring settings related to whether to coordinate power-OFF of the Air Cleaning Operation Unit power source 172 with power-OFF of the Image Forming Operation Unit power source 1102.

When "Do not coordinate" followed by "OK" are touched on the "Air cleaning apparatus power settings 2-1" screen of FIG. 22, air cleaning coordinated power-OFF determination D4=0 is set, and display next moves to the "Settings menu" screen of FIG. 17.

Figure 23:
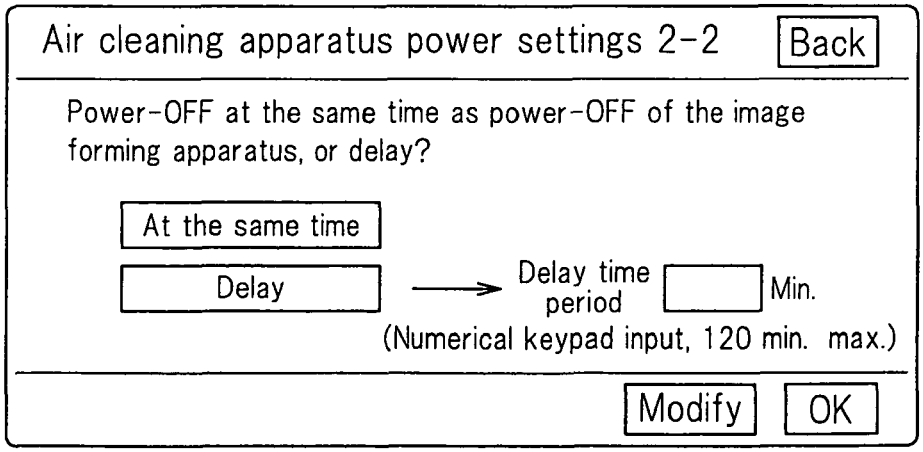
FIG. 23 is a diagram (7 of 7) of a setting display screen of the image forming display Operating Unit of the image forming system in Embodiment 2.

When "Coordinate" followed by "OK" are touched on the "Air cleaning apparatus power settings 2-1" screen of FIG. 22, air cleaning coordinated power-OFF determination D4=1 is set, and display next moves to the "Air cleaning apparatus power settings 2-2" screen of FIG. 23 given that further settings are required in this case.

The "Air cleaning apparatus power settings 2-2" screen of FIG. 23 is for configuring settings related to whether power-OFF of the Air Cleaning Operation Unit power source 172 is to be performed at the same time as power-OFF of the Image Forming Operation Unit power source 1102, or whether power-OFF of the Air Cleaning Operation Unit power source 172 is to be performed at a delay from power-OFF of the Image Forming Operation Unit power source 1102.

When "At the same time" followed by "OK" are touched on the "Air cleaning apparatus power settings 2-2" screen of FIG. 23, air cleaning delayed power-OFF determination D6=0 is set, and display next moves to the "Settings menu" screen of FIG. 17.

When "At a delay" is touched on the "Air cleaning apparatus power settings 2-2" screen of FIG. 23, a "Delay time period (min.)" is further input in this case, using the numerical keypad 1105*h* provided in the image forming display Operating Unit 1105. When "OK" is touched after this input, air cleaning delayed power-OFF determination D6=1 is set, and the time period (min.) that was input is further set in the air cleaning delayed power-OFF time period (min.) T2, after which display moves to the "Settings menu" screen of FIG. 17.

Because all settings related to power control are completed as a result of the above, the screen of the LCD (Liquid Crystal Display) 1105*g* with touch panel of the image forming display Operating Unit 1105 returns to the state prior to the User Settings button (SW3) 1105*f* of the image forming display Operating Unit 1105 being pressed when "End" on the "Settings menu" screen of FIG. 17 is touched after all of these settings have been completed.

The abovementioned settings are configured using the LCD (Liquid Crystal Display) 1105*g* with touch panel of the image forming display Operating Unit 1105, although these settings can alternatively be configured by an external device such as a personal computer connected to the image forming apparatus 1100.

That is, as discussed above, the image forming apparatus 1100 is provided with the image forming LAN I/F 1106, enabling an external device such as a personal computer to be connected via this image forming LAN I/F 1106.

An external device such as a personal computer connected to this image forming apparatus 1100 is provided with a display apparatus such as an LCD, and an input apparatus such as a numerical keypad, a full keyboard or a mouse, and the abovementioned settings can be configured by using the display apparatus and input apparatus.

In this case, settings can be configured similarly to the manner discussed above by replacing the operation performed by touching the display of a touch panel in the abovementioned settings with clicking on the display using a mouse.

Next, the power control operation on the Image Forming Operation Unit power source 1102 and the power control operation on the Air Cleaning Operation Unit power source 172 performed by the image forming Control Unit 1103 will be described based on the settings.

Figure 24:
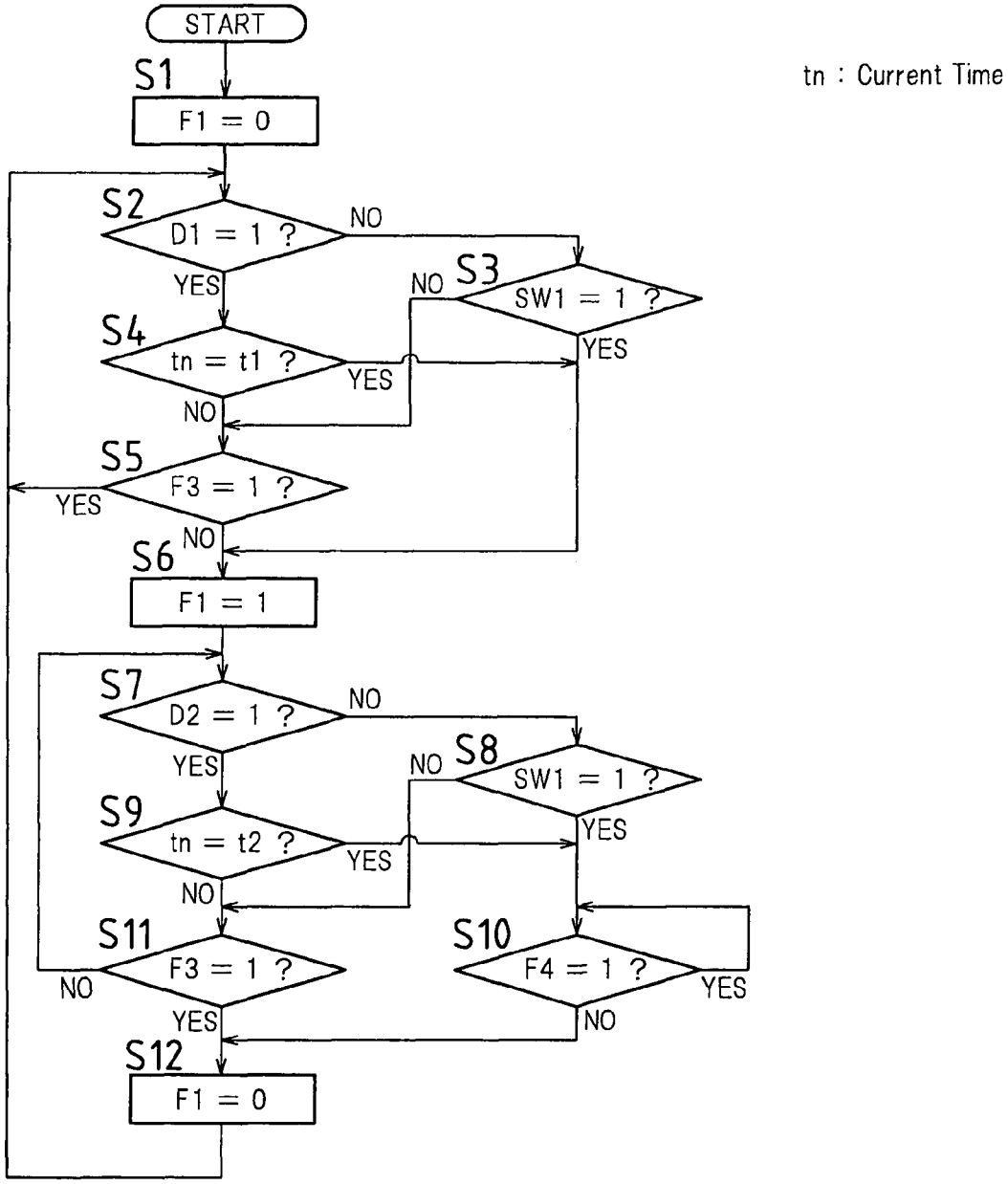
FIG. 24 is a flowchart (1 of 2) showing a power control operation of the image forming system in Embodiment 2.
Figure 25:
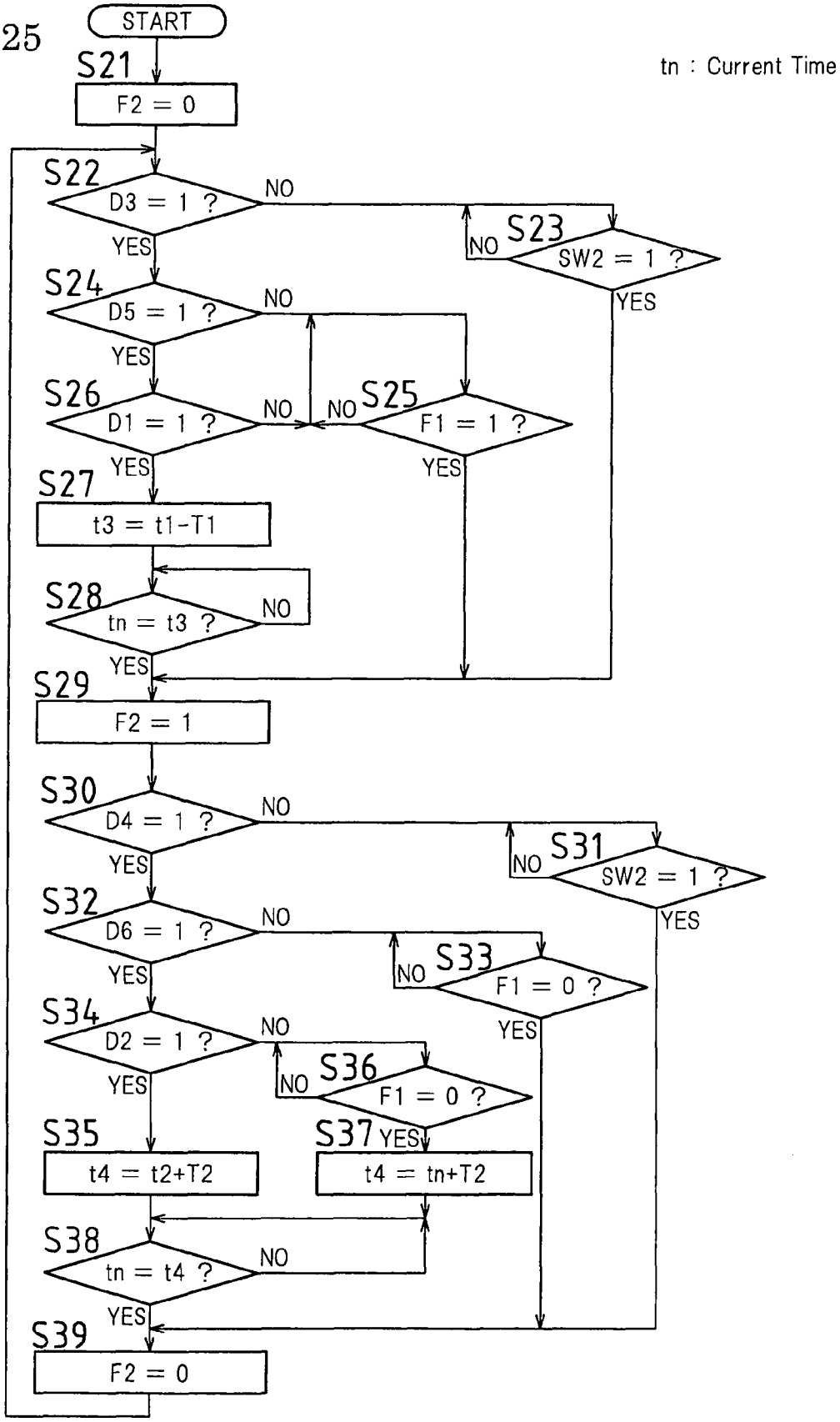
FIG. 25 is a flowchart (2 of 2) showing a power control operation of the image forming system in Embodiment 2.

FIG. 24 is a flowchart showing the power control operation on the Image Forming Operation Unit power source 1102 performed by the image forming Control Unit 1103, and FIG. 25 is likewise a flowchart showing the power control operation on the Air Cleaning Operation Unit power source 172 performed by the image forming Control Unit 1103.

The power control operation on the Image Forming Operation Unit power source 1102 and power control operation on the Air Cleaning Operation Unit power source 172 are performed using a clock function provided in the image forming Control Unit 1103 of the image forming system. Note that to in FIGS. 24 and 25 represents the current time.

Initially, the power control operation on the Image Forming Operation Unit power source 1102 will be described based on FIG. 24. In the flowchart shown in FIG. 24, S2 to S6 show the flow of a process of setting the image forming power ON/OFF instruction flag F1, that is, the process of turning on the Image Forming Operation Unit power source 1102, and S7 to S12 show the flow of a process of resetting the image forming power ON/OFF instruction flag F1, that is, the process of turning off the Image Forming Operation Unit power source 1102.

In FIG. 24, this power control operation on the Image Forming Operation Unit power source 1102 proceeds to the flow of S2 to S6 for setting the image forming power ON/OFF instruction flag F1, after firstly resetting the image forming power ON/OFF instruction flag F1 to F1=0 (S1).

In the flow for setting the image forming power ON/OFF instruction flag F1, the image forming auto power-ON determination D1 is initially checked at S2, and if D1≠1, that is, if D1=0, the Image Forming Operation Unit power source 1102 is to be turned on manually. Therefore, the processing next proceeds to S3.

If D1=1 when the image forming auto power-ON determination D1 is checked at S2, the Image Forming Operation Unit power source 1102 is to be turned on automatically. Therefore, the processing next proceeds to S4.

At S3, the power button (SW1) 1105*a* of the image forming display Operating Unit 1105 is checked, and if SW1=1, the Image Forming Operation Unit power source 1102 needs to be turned on because the power button (SW1) 1105*a* of the image forming display Operating Unit 1105 is being pressed, and the processing next proceeds to S6.

If SW1≠1, that is, if SW1=0 when the power button (SW1) 1105*a* of the image forming display Operating Unit 1105 is checked at S3, the Image Forming Operation Unit power source 1102 does not need to be turned on because the power button (SW1) 1105*a* of the image forming display Operating Unit 1105 is not being pressed, and the processing next proceeds to S5.

At S4, it is checked whether the current time tn is the image forming power-ON time t1, and if tn=t1, the Image Forming Operation Unit power source 1102 needs to be turned on because the image forming power-ON time t1 has arrived, and the processing next proceeds to S6.

If tn≠t1 when the current time tn is the image forming power-ON time t1 is checked at S4, the Image Forming Operation Unit power source 1102 does not need to be turned on because the image forming power-ON time t1 has not arrived, and the processing next proceeds to S5.

At S5, the image forming power saving state flag F3 is checked, and if F3=1, the processing returns to S2 and the processing from S2 is repeated, because the Image Forming Operation Unit 1101 is in the power saving state, and the Image Forming Operation Unit power source 1102 does not need to be turned on.

If F3≠1, that is, if F3=0 when the image forming power saving state flag F3 is checked at S5, the processing next proceeds to S6, because the Image Forming Operation Unit 1101 is in the normal state, and the Image Forming Operation Unit power source 1102 needs to be turned on.

At S6, the image forming power ON/OFF instruction flag F1 is set to F1=1. That is, the image forming power ON/OFF instruction flag F1 is changed from F1=0 to F1=1. Therefore, the image forming Control Unit 1103 turns on the Image Forming Operation Unit power source 1102, as discussed above.

When the Image Forming Operation Unit power source 1102 is turned on as a result of the image forming power ON/OFF instruction flag F1 being set in S6, the flow for setting the image forming power ON/OFF instruction flag F1 ends, and the processing next proceeds to the flow of S7 to S12 for resetting the image forming power ON/OFF instruction flag F1.

In the flow for resetting the image forming power ON/OFF instruction flag F1, the image forming auto power-OFF determination D2 is initially checked at S7, and if D2≠1, that is, if D2=0, the Image Forming Operation Unit power source 1102 is to be turned off manually. Therefore, the processing next proceeds to S8.

If D2=1 when the image forming auto power-OFF determination D2 is checked at S7, the Image Forming Operation Unit power source 1102 is to be turned off automatically. Therefore, the processing next proceeds to S9.

At S8, the power button (SW1) 1105*a* of the image forming display Operating Unit 1105 is checked, and if SW1=1, the Image Forming Operation Unit power source 1102 needs to be turned off because the power button (SW1) 1105*a* of the image forming display Operating Unit 1105 is being pressed, and the processing next proceeds to S10.

If SW1≠1, that is, if SW1=0 when the power button (SW1) 1105*a* of the image forming display Operating Unit 1105 is checked at S8, the Image Forming Operation Unit power source 1102 does not need to be turned off because the power button (SW1) 1105*a* of the image forming display Operating Unit 1105 is not being pressed, and the processing next proceeds to S11.

At S9, it is checked whether the current time tn is the image forming power-OFF time t2, and if tn=t2, the Image Forming Operation Unit power source 1102 needs to be turned off because the image forming power-OFF time t2 has arrived, and the processing next proceeds to S10.

If tn≠t2 when the current time tn is the image forming power-OFF time t2 is checked at S9, the Image Forming Operation Unit power source 1102 does not need to be turned off because the image forming power-OFF time t2 has not arrived, and the processing next proceeds to S11.

At S10, in order to ensure that the Image Forming Operation Unit power source 1102 is not turned off while the Image Forming Operation Unit 1101 is operating, the image forming in-progress flag F4 is checked prior to turning off the Image Forming Operation Unit power source 1102, and if F4=1, the processing proceeds to S12 after waiting until F4=0 because the Image Forming Operation Unit 1101 is operating.

At S11, the image forming power saving state flag F3 is checked, and if F3=1, the processing next proceeds to S12, because the Image Forming Operation Unit 1101 is in the power saving state, and the Image Forming Operation Unit power source 1102 needs to be turned off.

If F3≠1, that is, if F3=0 when the image forming power saving state flag F3 is checked at S11, the processing returns to S7 and the processing from S7 is repeated, because the Image Forming Operation Unit 1101 is in the normal state, and the Image Forming Operation Unit power source 1102 does not need to be turned off.

At S12, the image forming power ON/OFF instruction flag F1 is reset to F1=0. That is, the image forming power ON/OFF instruction flag F1 is changed from F1=1 to F1=0. Therefore, the image forming Control Unit 1103 turns off the Image Forming Operation Unit power source 1102, as discussed above.

When the Image Forming Operation Unit power source 1102 is turned off as a result of the image forming power ON/OFF instruction flag F1 being reset in S12, the flow for resetting the image forming power ON/OFF instruction flag F1 ends, and the processing next returns to S2 to proceed to the flow of S2 to S6 for setting the image forming power ON/OFF instruction flag F1, and the processing from S2 is repeated.

Next, the power control operation on the Air Cleaning Operation Unit power source 172 will be described based on FIG. 25. In the flowchart shown in FIG. 25, S22 to S29 show the flow of a process of setting the air cleaning power ON/OFF instruction flag F2, that is, the process of turning on the Air Cleaning Operation Unit power source 172, and S30 to S39 show the flow of a process of resetting the air cleaning power ON/OFF instruction flag F2, that is, the process of turning off the Air Cleaning Operation Unit power source 172.

In FIG. 25, this power control operation on the Air Cleaning Operation Unit power source 172 proceeds to the flow of S22 to S29 for setting the air cleaning power ON/OFF instruction flag F2, after firstly resetting the air cleaning power ON/OFF instruction flag F2 to F2=0 (S21).

In the flow for setting the air cleaning power ON/OFF instruction flag F2, the air cleaning coordinated power-ON determination D3 is initially checked at S22, and if D3≠1, that is, if D3=0, the Air Cleaning Operation Unit power source 172 is to be turned on manually. Therefore, the processing next proceeds to S23.

If D3=1 when the air cleaning coordinated power-ON determination D3 is checked at S22, the Air Cleaning Operation Unit power source 172 is to be turned on automatically. Therefore, the processing next proceeds to S24.

At S23, the power button (SW2) 175*a* of the air cleaning display Operating Unit 175 is checked, and once SW2=1 after waiting until the power button (SW2) 175*a* of the air cleaning display Operating Unit 175 is pressed, the Air Cleaning Operation Unit power source 172 needs to be turned on at the same time, and the processing next proceeds to S29.

At S24, the air cleaning advanced power-ON determination D5 is checked and if D5≠1, that is, if D5=0, the Air Cleaning Operation Unit power source 172 is to be turned on at the same time that the Image Forming Operation Unit power source 1102 is turned on. Therefore, the processing next proceeds to S25.

If D5=1 when the air cleaning advanced power-ON determination D5 is checked at S24, the Air Cleaning Operation Unit power source 172 is to be turned on in advance of the Image Forming Operation Unit power source 1102 being turned on. In this case, the air cleaning power-ON time t3 needs to have been calculated by t3=image forming power-ON time t1−air cleaning advanced power-ON time period (min.) T1, and the image forming power-ON time t1 needs to have been set, as discussed above. This t1 is set in the case where image forming auto power-ON determination D1=1, as discussed above. Therefore, the processing next proceeds to S26 in order to check this.

At S25, the image forming power ON/OFF instruction flag F1 is checked and once F1=1 after waiting until F1 is set, the Air Cleaning Operation Unit power source 172 needs to be turned on at the same time because the Image Forming Operation Unit power source 1102 has been turned on, and the processing next proceeds to S29.

At S26, the image forming auto power-ON determination D1 is checked, and if D1≠1, that is, if D1=0, the image forming Control Unit 1103 is not able to calculate the air cleaning power-ON time t3, because the image forming power-ON time t1 has not been set. Therefore, in this case, similar processing to the case where air cleaning advanced power-ON determination D5=0 is performed, as discussed above. Therefore, the processing next proceeds to the S25 which has already been discussed.

If D1=1 when the image forming auto power-ON determination D1 is checked at S26, the image forming power-ON time t1 will have been set, and the image forming Control Unit 1103 is able to calculate the air cleaning power-ON time t3. Therefore, the processing proceeds to S27.

At S27, the image forming Control Unit 1103 calculates the air cleaning power-ON time t3 by t3=image forming power-ON time t1−air cleaning advanced power-ON time period (min.) T1, and the processing next proceeds to S28.

At S28, it is checked whether the current time tn is the air cleaning power-ON time t3, and if tn=t3, the Air Cleaning Operation Unit power source 172 needs to be turned on because the air cleaning power-ON time t3 has arrived, and the processing next proceeds to S29.

At S29, the air cleaning power ON/OFF instruction flag F2 is set to F2=1. That is, the air cleaning power ON/OFF instruction flag F2 is changed from F2=0 to F2=1. Therefore, as discussed above, the image forming Control Unit 1103 notifies an Air Cleaning Operation Unit power source 172 ON instruction to the air cleaning Control Unit 173 via the image forming RS-232C I/F 1107 and the air cleaning RS-232C I/F 177. The air cleaning Control Unit 173, having received notification of the Air Cleaning Operation Unit power source 172 ON instruction, turns on the Air Cleaning Operation Unit power source 172.

When the Air Cleaning Operation Unit power source 172 is turned on as a result of the air cleaning power ON/OFF instruction flag F2 being set in S29, the flow for setting the air cleaning power ON/OFF instruction flag F2 ends, and the processing next proceeds to the flow of S30 to S39 for resetting the air cleaning power ON/OFF instruction flag F2.

In the flow for resetting the air cleaning power ON/OFF instruction flag F2, the air cleaning coordinated power-OFF determination D4 is initially checked at S30, and if D4≠1, that is, if D4=0, the Air Cleaning Operation Unit power source 172 is to be turned off manually. Therefore, the processing next proceeds to S31.

If D4=1 when the air cleaning coordinated power-OFF determination D4 is checked at S30, the Air Cleaning Operation Unit power source 172 is to be turned off automatically. Therefore, the processing next proceeds to S32.

At S31, the power button (SW2) 175*a* of the air cleaning display Operating Unit 175 is checked, and once SW2=1 after waiting until the power button (SW2) 175*a* of the air cleaning display Operating Unit 175 is pressed, the Air Cleaning Operation Unit power source 172 needs to be turned off at the same time, and the processing next proceeds to S39.

At S32, the air cleaning delayed power-OFF determination D6 is checked and if D6≠1, that is, if D6=0, the Air Cleaning Operation Unit power source 172 is to be turned off at the same time that the Image Forming Operation Unit power source 1102 is turned off. Therefore, the processing next proceeds to S33.

At S33, the image forming power ON/OFF instruction flag F1 is checked, and once F1=0 after waiting until F1 is reset, the Air Cleaning Operation Unit power source 172 needs to be turned off at the same time, because the Image Forming Operation Unit power source 1102 has been turned off, and the processing next proceeds to S39.

If D6=1 when the air cleaning delayed power-OFF determination D6 is checked at S24, the Air Cleaning Operation Unit power source 172 is to be turned off at a delay from the Image Forming Operation Unit power source 1102 being turned off.

In this case, the delayed OFF time is the air cleaning power-OFF time t4, and the image forming Control Unit 1103 calculates this air cleaning power-OFF time t4 by t4=image forming power-OFF time t2+air cleaning delayed power-OFF time period (min.) T2, because the image forming power-OFF time t2 will have been set in the case where the image forming auto power-OFF determination D2=1, as discussed above.

In contrast, in the case where image forming auto power-OFF determination D2=0, the image forming power-OFF time t2 will not have been set. Because the Image Forming Operation Unit power source 1102 is to be turned off manually in this case, the image forming Control Unit 1103 calculates the air cleaning power-OFF time t4 by t4=tf+air cleaning delayed power-OFF time period (min.) T2, using the time tf at which the Image Forming Operation Unit power source 1102 is actually turned off. The processing next proceeds to S34 to judge which of the calculations to perform.

At S34, the image forming auto power-OFF determination D2 is checked, and if D2=1, the processing proceeds to S35 and the air cleaning power-OFF time t4 is calculated by t4=image forming power-OFF time t2+air cleaning delayed power-OFF time period (min.) T2, because the image forming power-OFF time t2 has been set, after which the processing proceeds to S38.

If D2≠1, that is, if D2=0 when the image forming auto power-OFF determination D2 is checked at S34, the processing proceeds to S36 because the time tf at which the Image Forming Operation Unit power source 1102 will actually be turned off needs to be known.

At S36, the image forming power ON/OFF instruction flag F1 is checked, and once F1=0 after waiting until F1 is reset, the processing proceeds to S37 and the air cleaning power-OFF time t4 is calculated by t4=tn+air cleaning delayed power-OFF time period (min.) T2, using the current time tn at this time as the time tf, because the Image Forming Operation Unit power source 1102 has been turned off, after which the processing proceeds to S38.

At S38, it is checked whether the current time tn is the air cleaning power-OFF time t4, and if tn=t4, the Air Cleaning Operation Unit power source 172 needs to be turned off because the air cleaning power-OFF time t4 has arrived, and the processing next proceeds to S39.

At S39, the air cleaning power ON/OFF instruction flag F2 is reset to F2=0. That is, the air cleaning power ON/OFF instruction flag F2 is changed from F2=1 to F2=0. Therefore, as discussed above, the image forming Control Unit 1103 notifies an Air Cleaning Operation Unit power source 172 OFF instruction to the air cleaning Control Unit 173 via the image forming RS-232C I/F 1107 and the air cleaning RS-232C I/F 177. The air cleaning Control Unit 173, having received notification of the Air Cleaning Operation Unit power source 172 OFF instruction, turns off the Air Cleaning Operation Unit power source 172.

When the Air Cleaning Operation Unit power source 172 is turned off as a result of the air cleaning power ON/OFF instruction flag F2 being reset in S39, the flow for resetting the air cleaning power ON/OFF instruction flag F2 ends, and the processing next returns to S22 to proceed to the flow of S22 to S29 for setting the air cleaning power ON/OFF instruction flag F2, and the processing from S22 is repeated.

The image forming system enables ON/OFF of the Air Cleaning Operation Unit power source 172 to be coordinated with the Image Forming Operation Unit power source 1102. That is, the image forming system has a coordinated ON control function and a coordinated OFF control function of controlling power supply to the Image Forming Operation Unit 1101 and the Air Cleaning Operation Unit 171.

Thus, the environment around of the image forming system, such as the room or the like where this image forming system is installed, can be effectively kept clean while suppressing power consumption.

Also, power-ON of the Air Cleaning Operation Unit power source 172 can be performed in advance of power-ON of the Image Forming Operation Unit power source 1102. That is, ON control of power supply to the Air Cleaning Operation Unit 171 (aforementioned second power supply ON control) can be executed a preset time period before the time at which ON control of power supply to the Image Forming Operation Unit 1101 (aforementioned first power supply ON control) is executed.

Thus, the air in the room or the like where the image forming system is installed can be cleaned in advance, before the Image Forming Operation Unit 1101 of the image forming system operates. Accordingly, the environment around the image forming system, such as the room or the like where this image forming system is installed, can be effectively kept clean, while suppressing power consumption.

Also, power-OFF of the Air Cleaning Operation Unit power source 172 can be performed at a delay from the power-OFF time of the Image Forming Operation Unit power source 1102. That is, OFF control of power supply to the Air Cleaning Operation Unit 171 (aforementioned second power supply OFF control) can be executed a preset time period after the time at which OFF control of power supply to the Image Forming Operation Unit 1101 (aforementioned first power supply OFF control) is executed.

Thus, the air in the room or the like where the image forming system is installed can continue to be cleaned even after the Image Forming Operation Unit 1101 of the image forming system has stopped operating, and the room or the like where the image forming system is installed can be effectively kept clean in preparation for the next day. Accordingly, the environment around the image forming system, such as the room or the like where this image forming system is installed, can be effectively kept clean, while suppressing power consumption.

Also, power-ON of the Air Cleaning Operation Unit power source 172 and power-ON of the Image Forming Operation Unit power source 1102 can be performed at the same time. That is, ON control of power supply to the Image Forming Operation Unit 1101 (aforementioned first power supply ON control) and ON control of power supply to the Air Cleaning Operation Unit 171 (aforementioned second power supply ON control) can be executed at the same time, as execution of the coordinated ON control function.

Thus, by turning on power supply to the Air Cleaning Operation Unit 171 and operating the Air Cleaning Operation Unit 171 at the same time that power supply to the Image Forming Operation Unit 1101 is turned on, invisible fine particles, fumes and the like discharged from the Image Forming Operation Unit 1101 can be removed, and the room where the image forming system is installed can be effectively kept clean while suppressing power consumption.

Also, power-OFF of the Air Cleaning Operation Unit power source 172 and power-OFF of the Image Forming Operation Unit power source 1102 can be performed at the same time. That is, OFF control of power supply to the Image Forming Operation Unit 1101 (aforementioned first power supply OFF control) and OFF control of power supply to the Air Cleaning Operation Unit 171 (aforementioned second power supply OFF control) can be executed at the same time, as execution of the coordinated OFF control function.

Thus, by turning off power supply to the Air Cleaning Operation Unit 171 and stopping operation of the Air Cleaning Operation Unit 171 at the same time that power supply to the Image Forming Operation Unit 1101 is turned off, the room where the image forming system is installed can be effectively kept clean while suppressing power consumption. Also, this prevents the Air Cleaning Operation Unit 171 from being left ON.

Also, the Image Forming Operation Unit 1101 of the image forming system is provided with a power saving mode in which OFF control of power supply to the Image Forming Operation Unit 1101 (aforementioned first power supply OFF control) is executed by the image forming Control Unit 1103, so as to reduce power consumption by the Image Forming Operation Unit 1101 when the Image Forming Operation Unit 1101 is not operating, and when the Image Forming Operation Unit 1101 is in the power saving mode, OFF control of power supply to the Air Cleaning Operation Unit 171 (aforementioned second power supply OFF control) is not executed, even if OFF control of power supply to the Image Forming Operation Unit 1101 is executed.

Thus, when the Image Forming Operation Unit 1101 is not being operated, OFF control of power supply to the Image Forming Operation Unit 1101 is executed by the image forming Control Unit 1103 of the image forming system as a result of switching to the power saving mode, and power supply to the Image Forming Operation Unit 1101 is stopped, from the viewpoint of suppressing power consumption. However, power supply to the Air Cleaning Operation Unit 171 is not turned off, and operation of the Air Cleaning Operation Unit 171 is continued. Accordingly, the room where the image forming system is installed can be effectively kept clean, while suppressing power consumption.

Also, the image forming system is provided with a plurality of types of coordinated ON control. That is, as discussed above, apart from being able to execute ON control of power supply to the Image Forming Operation Unit 1101 (aforementioned first power supply ON control) and ON control of power supply to the Air Cleaning Operation Unit 171 (aforementioned second power supply ON control) at the same time, ON control of power supply to the Air Cleaning Operation Unit 171 (aforementioned second power supply ON control) can be executed a fixed time period before ON control of power supply to the Image Forming Operation Unit 1101 (aforementioned first power supply ON control) is executed.

Also, as discussed above, apart from being able to execute OFF control of power supply to the Image Forming Operation Unit 1101 (aforementioned first power supply OFF control) and OFF control of power supply to the Air Cleaning Operation Unit 171 (aforementioned second power supply OFF control) at the same time, OFF control of power supply to the Air Cleaning Operation Unit 171 (aforementioned second power supply OFF control) can be executed a fixed time period after OFF control of power supply to the Image Forming Operation Unit 1101 (aforementioned first power supply OFF control) is executed.

Thus, by selecting one of the plurality of types of the coordinated ON control function and one of the plurality of types of the coordinated OFF control function, cooperation between the Image Forming Operation Unit 1101 and the Air Cleaning Operation Unit 171 can be realized in accordance with the situation in the room or the like where the image forming system is installed, and the room where the image forming system is installed can be effectively kept clean while suppressing power consumption.

Also, the image forming system is provided with a function of individually executing ON control of power supply to the Image Forming Operation Unit 1101 (aforementioned first power supply ON control) and ON control of power supply to the Air Cleaning Operation Unit 171 (aforementioned second power supply ON control) independently rather than coordinating them, and a function of individually executing OFF control of power supply to the Image Forming Operation Unit 1101 (aforementioned first power supply OFF control) and ON control of power supply to the Air Cleaning Operation Unit 171 (aforementioned second power supply OFF control) independently rather than coordinating them.

Thus, power control on the Image Forming Operation Unit 1101 and the Air Cleaning Operation Unit 171 can also be individually performed, in accordance with the situation in the room or the like where the image forming system is installed, and the room where the image forming apparatus is installed can be effectively kept clean while suppressing power consumption.

Also, the image forming system enables settings required in the abovementioned power controls to be configured by remote operation using an external device such as a personal computer connected to the image forming apparatus 1100 via the image forming LAN I/F 1106 provided in the image forming apparatus 1100, apart from by operations using the image forming display Operating Unit 1105 provided in the image forming apparatus 1100.

Thus, settings for power control on the image forming system can be configured from a plurality of locations, and the work involved in configuring the settings can be facilitated and expedited.

In the image forming system, the "Image forming apparatus power settings 1" screen of FIG. 18 and the "Image forming apparatus power settings 2" screen of FIG. 19 are used for configuring settings related to power ON/OFF of the Image Forming Operation Unit power source 1102, but the "Image forming apparatus power settings 1" screen of FIG. 26 and the "Image forming apparatus power settings 2" screen of FIG. 27 may be used instead of the "Image forming apparatus power settings 1" screen of FIG. 18 and the "Image forming apparatus power settings 2" screen of FIG. 19.

In this case, with the "Image forming apparatus power settings 1" screen of FIG. 26, settings for turning the Image Forming Operation Unit power source 1102 on and off in relation to whether to perform power ON/OFF manually or automatically are configured with a single operation.

With the "Image forming apparatus power settings 2" screen of FIG. 27, on and off of the Image Forming Operation Unit power source 1102 are set for one week, and the ON time and the OFF time of the Image Forming Operation Unit power source 1102 are individually set for each day of the week.

In this case, the seven days Monday through Sunday are respectively secured, and set data is used for each day, as data areas of the image forming power-ON time t1 and the image forming power-OFF time t2 shown in FIG. 16.

This enables settings adapted to daily operations of the image forming system to be configured.

Also, in the image forming system, a FAX machine (facsimile function) is not provided, but a FAX machine may be provided by providing a dial-up connection interface in the image forming Control Unit 1103. In this case, only the reception function, out of the transmission function and reception function of the FAX function, is performed while the Image Forming Operation Unit power source 1102 is OFF.

Embodiment 3

Figure 28:
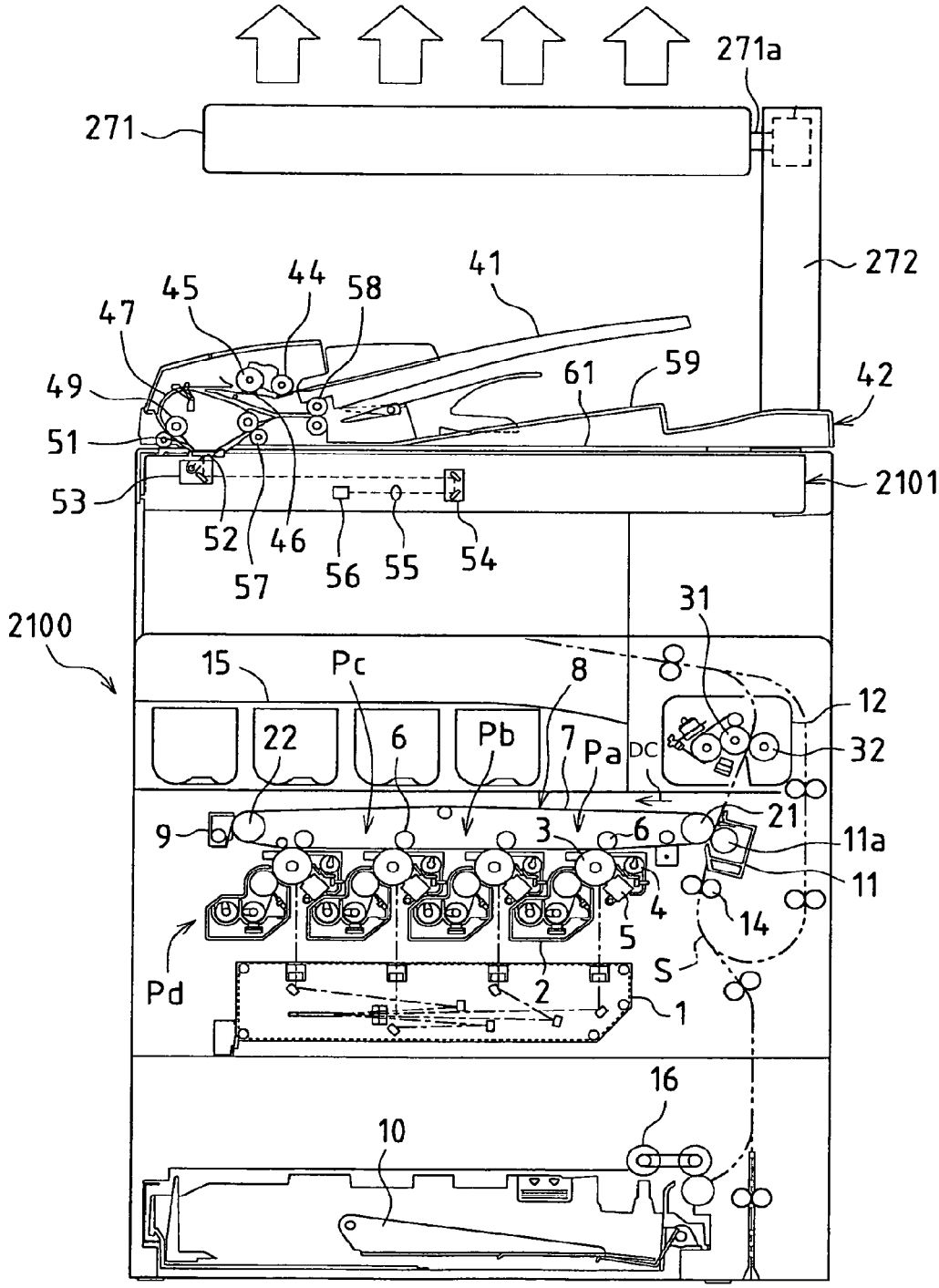
FIG. 28 is a cross-sectional view schematically showing Embodiment of the image forming system of the present invention.

Next, Embodiment 3 will be described. FIG. 28 schematically shows Embodiment of the image forming system according to Embodiment 3. The image forming system according to the present embodiment is provided with an image forming apparatus 2100 and an air cleaning apparatus 271 disposed above the image forming apparatus 2100.

The image forming apparatus 2100 is a so-called multi-function peripheral that includes a scanner function, a copy function, a printer function and a facsimile function, and performs processing such as transmitting an image of an original read by an original reading apparatus 2101 to the outside (corresponds to scanner function), and recording and forming the image of the original that was read or an image received from outside on recording paper in color or monochrome (corresponds to copy function, printer function, and facsimile function).

This image forming apparatus 2100 is provided with the original reading apparatus 2101 and an original transport unit 42 to read an image of an original. The original reading unit 60 reads an image of an original that is being transported by the original transport unit 42. In the original transport unit 42, when an original is placed in an original placement tray 41, an original pickup roller 44 is pressed against the surface of the original and rotated, and the original is pulled out from the original placement tray 41, passes between a separation roller 45 and a separation pad 46 and is separated sheet by sheet, before being transported to a transport path 47.

On this transport path 47, the leading edge of the original abuts against original registration rollers 49 and is aligned parallel to the original registration rollers 49, and the original is subsequently transported by the original registration rollers 49 and passes between a reading guide 51 and a reading glass 52. Further, the original is transported by transport rollers 57 and discharged into a discharge tray 59 via discharge rollers 58.

In the original reading apparatus 2101, when the original passes between the reading guide 51 and the reading glass 52, light from a light source of a first scanning unit 53 is irradiated onto the surface of the original via the reading glass 52, reflected light from the surface of the original is incident on the first scanning unit 53 via the reading glass 52, reflected light from the first scanning unit 54 is reflected by mirrors of the first and second scanning units 53 and 54 and guided to an imaging lens 55, and an image of the original is formed on a CCD (Charge Coupled Device) 56 by the imaging lens 55. The CCD 56 reads the image of the original, and outputs image data representing the image of the original.

An original placed on a platen glass 61 can also be read. The original transport unit 42 is pivotably supported on the far side by a hinge (not shown) at the far side of the original reading apparatus 2101 positioned underneath, and is opened and closed by raising and lowering the near portion thereof. The far side of original transport unit 42 is pivotably supported by a hinge (not shown) on the far side of the original reading apparatus 2101 positioned underneath, and is opened and closed by raising and lowering the near portion of the original transport unit 42. The original glass platen 61 is released when this original transport unit 42 is opened, enabling an original to be placed on the platen glass 61. When the original transport unit 42 is closed after an original has been placed, the surface of the original on the platen glass 61 is exposed by the first scanning unit 53 while the first and second scanning units 53 and 54 are moved in a sub-scanning direction, reflected light from the surface of the original is guided to the imaging lens 55 by the first and second scanning units 53 and 54, and an image of the original is formed on the CCD 56 by the imaging lens 55. At this time, the first and second scanning units 53 and 54 are moved while maintaining a predetermined speed relation to each other, and the positional relation between the first and second scanning units 53 and 54 is constantly maintained such that there is no change in the length of the optical path of the reflected light from the surface of the original to the CCD 56 via the first scanning unit 53, the second scanning unit 54 and the imaging lens 55, with the image of the original on the CCD 56 thereby being constantly kept precisely focused.

The entire image of the original thus read is transmitted to a laser exposure apparatus 1 of the image forming apparatus 2100 as image data, and the image is recorded on recording paper in the image forming apparatus 2100.

The image forming apparatus 2100 is provided with the laser exposure apparatus 1, a developing apparatus 2, a photosensitive drum 3, a charging unit 5, a cleaning apparatus 4, an intermediate transfer belt apparatus 8, a fixing apparatus 12, a paper transport path S, a paper supply tray 10, a paper discharge tray 15, and the like.

Image data handled in the image forming apparatus 2100 corresponds to a color image using the colors black (K), cyan (C), magenta (M), and yellow (Y), or to a monochrome image using a single color (e.g., black). Four each of the developing apparatus 2, the photosensitive drum 3, the charging unit 5 and the cleaning apparatus 4 are thus provided so as to form four types of latent image corresponding to the respective colors, and respectively associated with black, cyan, magenta and yellow to constitute four image stations Pa, Pb, Pc, and Pd.

The photosensitive drums 3 are disposed roughly in the center of the image forming apparatus 2100.

The charging unit 5 is a charging unit for uniformly charging the surface of the photosensitive drum 3 to a predetermined potential, with a contact-type charging unit such as a roller-type or brush-type charging unit being used, as well as a charger-type charging unit.

The laser exposure apparatus 1 is a laser scanning unit (LSU) provided with a laser diode and a reflective mirror, and exposes the charged surface of the photosensitive drum 3 according to the image data to form an electrostatic latent image corresponding to the image data on the surface of the photosensitive drum.

The developing apparatus 2 develops the electrostatic latent image formed on the photosensitive drum 3 using (K, C, M, Y) toner. The cleaning apparatus 4 removes and collects toner remaining on the surface of the photosensitive drum 3 after the developing and image transfer.

The intermediate transfer belt apparatus 8 disposed above the photosensitive drum 3 is provided with an intermediate transfer belt 7, an intermediate transfer belt drive roller 21, a driven roller 22, an intermediate transfer roller 6, and an intermediate transfer belt cleaning apparatus 9.

The intermediate transfer belt drive roller 21, the intermediate transfer roller 6, the driven roller 22 and the like support the intermediate transfer belt 7 in a tensioned state, and move the intermediate transfer belt 7 around in the direction of arrow DC.

The intermediate transfer roller 6 is rotatably supported in the vicinity of the intermediate transfer belt 7, and pressed against the photosensitive drum 3 via the intermediate transfer belt 7, and a transfer bias for transferring a toner image on the photosensitive drum 3 to the intermediate transfer belt 7 is applied thereto.

The intermediate transfer belt 7 is provided so as to contact each photosensitive drum 3, and a color toner image (toner image of each color) is formed by sequentially transferring the toner image on the surface of each photosensitive drum 3 to the intermediate transfer belt 7 in layers. This intermediate transfer belt 7 is formed as an endless belt using a film with a thickness of around 100 to 150 μm.

The toner image is transferred from the photosensitive drum 3 to the intermediate transfer belt 7 by the intermediate transfer roller 6 that is pressed against the inner surface of the intermediate transfer belt 7. A high-voltage transfer bias (high voltage of opposite polarity (+) to the toner charging polarity (−)) is applied to the intermediate transfer roller 6 in order to transfer the toner image. The intermediate transfer roller 6 has a metal (e.g., stainless steel) shaft with a diameter of 8 to 10 mm as a base, the surface of which is covered by a conductive elastic material (e.g., EPDM, urethane foam, etc.). This conductive elastic material enables a high voltage to be uniformly applied to the recording paper.

As discussed above, the toner images on the surface of the photosensitive drums 3 are layered on the intermediate transfer belt 7 to form a color toner image represented by image data. The toner images of the respective colors thus layered are transported in conjunction with the intermediate transfer belt 7, and transferred to the recording paper by a transfer roller 11*a* of a secondary transfer apparatus 11 that contacts the intermediate transfer belt 7.

The intermediate transfer belt 7 and the transfer roller 11*a* of the secondary transfer apparatus 11 are pressed against each other to form a nip. Also, a voltage (high voltage of opposite polarity (+) to the toner charging polarity (−)) for transferring the toner images of the respective colors on the intermediate transfer belt 7 to the recording paper is applied to the transfer roller 11*a* of the secondary transfer apparatus 11. Further, in order to constantly obtain the nip, a hard material (metal, etc.) is used for one of the transfer roller 11*a* of the secondary transfer apparatus 11 or the intermediate transfer belt drive roller 21, and a soft material (elastic rubber roller, foam resin roller, etc.) such as an elastic roller is used for the other.

Toner may remain on the intermediate transfer belt 7 due to the toner images on the intermediate transfer belt 7 not being completely transferred to the recording paper by the secondary transfer apparatus 11, and this residual toner causes mixing of toner colors in the next process. Residual toner is thus removed and collected by the intermediate transfer belt cleaning apparatus 9. The intermediate transfer belt cleaning apparatus 9 is, for example, provided with a cleaning blade that contacts the intermediate transfer belt 7 and removes residual toner as a cleaning member, and the inner side of the intermediate transfer belt 7 is supported by the driven roller 22 at the location where the cleaning blade makes contact.

The paper supply tray 10, which is for storing recording paper, is provided below the image forming apparatus 2100, and supplies recording paper in the tray.

An S-shaped paper transport path S for feeding recording paper supplied from the paper supply tray 10 to the paper discharge tray 15 via the secondary transfer apparatus 11 and the fixing apparatus 12 is provided in the image forming apparatus 2100. Paper pickup rollers 16, paper registration rollers 14, the fixing apparatus 12, transport rollers for transporting recording paper, and the like are disposed along this paper transport path S.

The paper pickup rollers 16 are provided at an end of the paper supply tray 10, and supply recording paper, sheet by sheet, from the paper supply tray 10 to the paper transport path S. A plurality of transport rollers are provided, these being small rollers for facilitating and assisting transportation of recording paper.

The paper registration rollers 14 temporarily stop recording paper that has been transported, align the leading edge of the recording paper, and transport the recording paper in a timely manner in accordance with rotation of the photosensitive drums 3 and the intermediate transfer belt 7, such that the color toner image on the intermediate transfer belt 7 is transferred to the recording paper at the nip between the intermediate transfer belt 7 and the transfer roller 11*a* of the secondary transfer apparatus 11.

For example, the paper registration rollers 14 transport the recording paper so that the leading edge of the color toner image on the intermediate transfer belt 7 coincides with the leading edge of the image forming region of the recording paper at the nip between the intermediate transfer belt 7 and the transfer roller 11*a* of the secondary transfer apparatus 11, based on the detection output of a pre-registration detection switch (not shown).

The fixing apparatus 12 is provided with a heat roller 31, a pressure roller 32, and the like.

The heat roller 31 and the pressure roller 32 sandwich and transport recording paper that has passed through the nip between the intermediate transfer belt 7 and the transfer roller 11*a* of the secondary transfer apparatus 11.

The heat roller 31 is controlled so as to be at a predetermined fixing temperature, based on the sensor output of a temperature sensor (not shown), and has a function of fusing, mixing and applying pressure to the toner images transferred to the recording paper to heat-fix the toner images to the recording paper, by thermally compressing the recording paper in conjunction with the pressure roller 32.

The recording paper to which the toner images of the respective colors have been fixed is discharged face-down onto the paper discharge tray 15 by the transport rollers.

Next, the air cleaning apparatus 271 will be described. This air cleaning apparatus 271, which is supported at the upper end of a support column 272 that protrudes from one of the corners of the back face of the main body of the image forming apparatus 2100, generates positive and negative ions, and emits the positive and negative ions upward together with air.

The image forming apparatus 2100 is often disposed with its back against the wall of the room, and thus the air cleaning apparatus 271 will also be disposed against the wall of the room. In this case, most of the air emitted upward from the air cleaning apparatus 271 rises along the wall and is blown onto the ceiling, where it spreads along the ceiling and circulates throughout the room. Accordingly, positive and negative ions contained in the air emitted from the air cleaning apparatus 271 also circulate throughout the room, and airborne bacteria in the air in the room are effectively eliminated by these positive and negative ions.

Also, some of the air emitted upward from the air cleaning apparatus 271 sinks down and floats around near the image forming apparatus 2100, enveloping the entire main body of the image forming apparatus 2100, and exhaust gases from the image forming apparatus 2100 are decomposed and reduced by the positive and negative ions contained in the air.

The electrophotographic image forming apparatus 2100 may produce ozone, and while a filter or the like for reducing this may be built into the image forming apparatus 2100, it is possible to omit the built-in filter or the like, since the positive and negative ions are able to decompose and reduce ozone.

Since space does not need to be especially provided for installing the air cleaning apparatus 271 given that the air cleaning apparatus 271 is disposed above the image forming apparatus 2100, this space can be saved.

Also, since space is opened up between the image forming apparatus 2100 and the air cleaning apparatus 271 given that the air cleaning apparatus 271 is supported at the upper end of the support column 272 protruding from the image forming apparatus 2100, usability of the image forming apparatus 2100 is not impaired.

Figure 29:
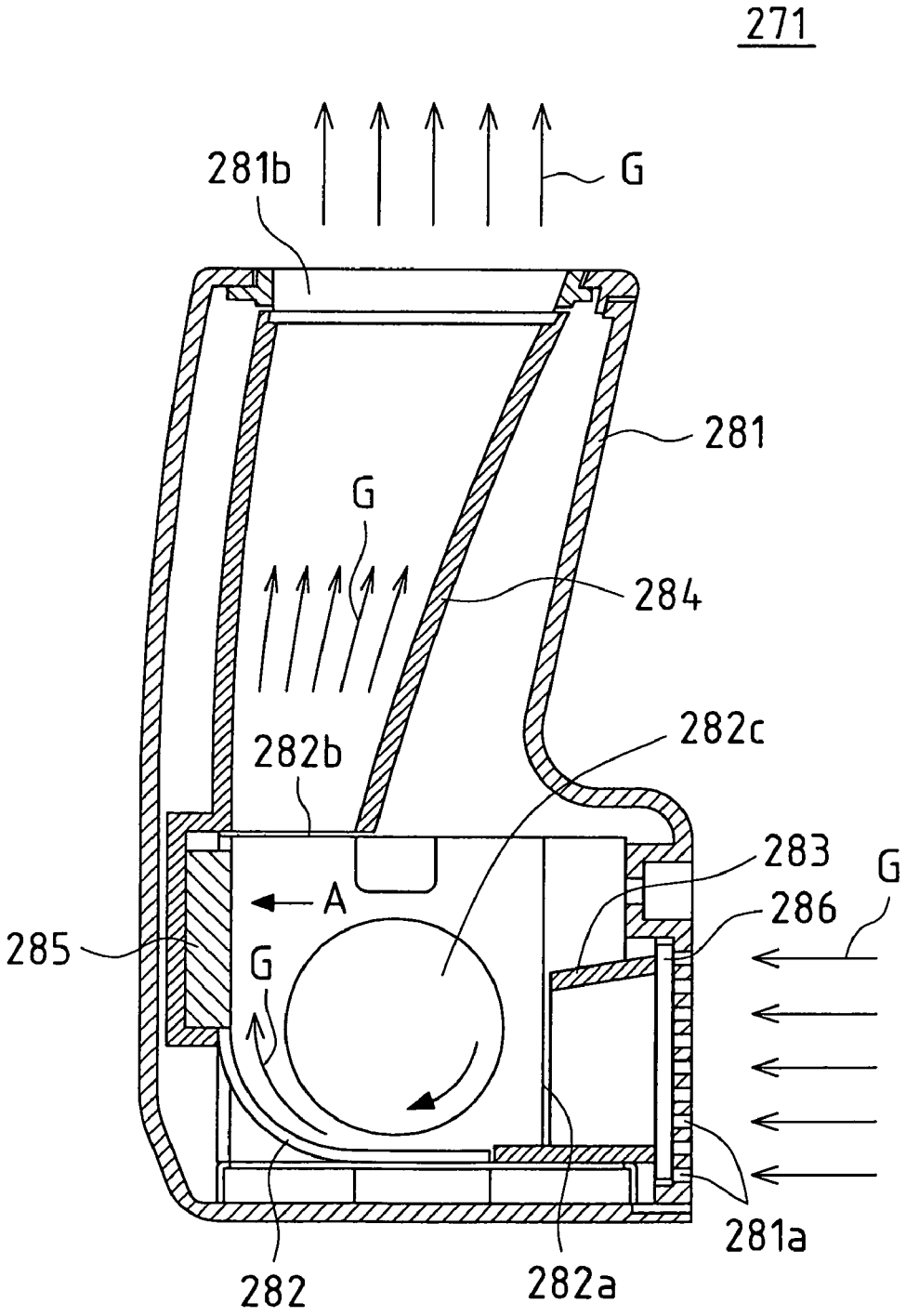
FIG. 29 is a cross-sectional view showing the air cleaning apparatus in the image forming system of FIG. 28.

FIG. 29 is a cross-sectional view showing the air cleaning apparatus 271. This air cleaning apparatus 271 is provided with a main casing 281, a fan unit 282 disposed in a lower portion of the main casing 281, a plurality of inlet holes 281*a* formed in the lower wall of the main casing 281, a filter 286 disposed so as to overlap the inlet holes 281*a*, an inlet duct 283 disposed between the filter 286 and an inlet opening 282*a* of the fan unit 282, an upper outlet opening 281*b* formed in the upper portion of the main casing 281, an outlet duct 284 disposed between the upper outlet opening 281*b* and an outlet opening 282*b* of the fan unit 282, and a plurality of ion generating elements 285 disposed on the periphery of the fan unit 282.

Since the air cleaning apparatus 271 is long in the width direction of the image forming apparatus 2100 as shown in FIG. 28, the main casing 281, the fan unit 282, the inlet holes 281*a*, the inlet duct 283, the outlet opening 282*b*, the outlet duct 284, and the like are also long in the width direction of the image forming apparatus 2100, and the plurality of ion generating elements 285 are also arranged in the width direction of the image forming apparatus 2100.

When a fan 282*c* of the fan unit 282 is rotationally driven by a motor (not shown), airflow such as shown by arrows G is generated, with air being drawn into the fan unit 282 by way of the inlet holes 281*a*, the filter 286 and the inlet duct 283, and being discharged from the upper outlet opening 281*b* via the outlet duct 284 after having being circulated in proximity to the ion generating elements 285. At this time, the filter 286 adsorbs and removes dust and the like in the air.

Figure 30:
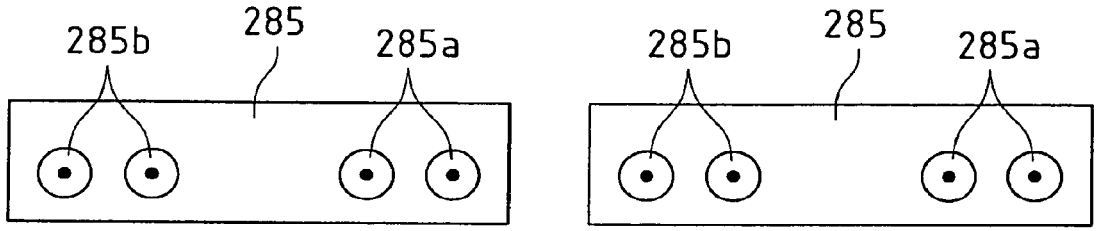
FIG. 30 is a plan view illustrating Plasmacluster Ion generating elements in the ion generating apparatus of FIG. 29.

The ion generating elements 285 are Plasmacluster Ion (registered trademark) generating elements (PCI). When the ion generating elements 285 are viewed from the direction of arrow A in FIG. 29, two ion generating elements 285 are arrayed in the width direction of the image forming apparatus 2100 as shown in FIG. 30, and a pair of positive ion generating units 285*a* for generating positive ions and a pair of negative ion generating units 285*b* for generating negative ions are arrayed for each ion generating element 285.

Such ion generating elements 285 are disclosed in detail in JP 2002-58731A previously lodged by the applicant of the instant invention (assignee of the instant invention).

The positive and negative ions generated by these ion generating elements 285 are emitted from the upper outlet opening 281*b* via the outlet duct 284 together with the airflow generated by the fan 282*c* of the fan unit 282.

The amount of air discharge from the air cleaning apparatus 271 can be adjusted by changing the rotational speed of the motor of the fan 282*c*. If the amount of air discharge is increased, air containing positive and negative ions circulates over a wider area, and the air is purified over a wider area. If the amount of air discharge is reduced, air containing positive and negative ions tends to float in the vicinity of the image forming apparatus 2100, and the exhaust gases of the image forming apparatus 2100 are more effectively decomposed and reduced.

Figure 31:
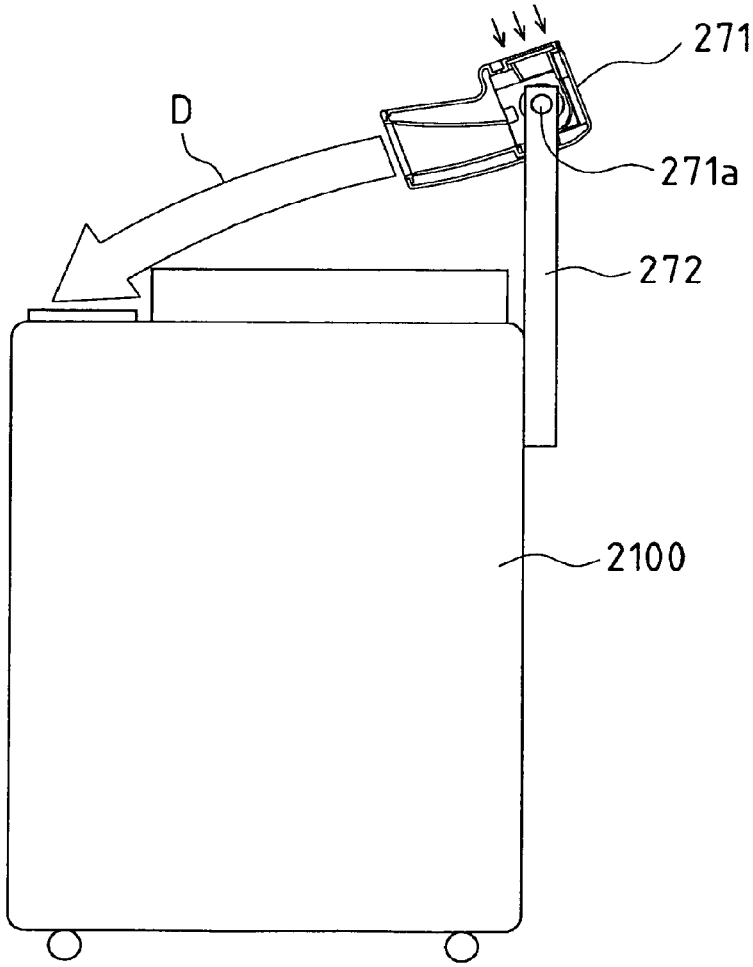
FIG. 31 is a lateral view showing a state in which the emission direction of ions from the air cleaning device in the image forming system of FIG. 28 is set diagonally downward.

The direction of air discharge from the air cleaning apparatus 271 may be set diagonally downward as shown by arrow D in FIG. 31, rather than upward. Alternatively, a shaft 271*a* on one end side of the air cleaning apparatus 271 may be rotationally supported at the upper end of the support column 272, and this shaft 271*a* may be rotated by a motor drive to rotate the air cleaning apparatus 271 about the shaft 271*a* and change the direction of air discharge from the air cleaning apparatus 271. Further, the air cleaning apparatus 271 may be reciprocally rotated in a fixed angular range about the shaft 271*a*, or in other words, the air cleaning apparatus 271 may be swung to expand the emission range of the positive and negative ions.

Figure 32:
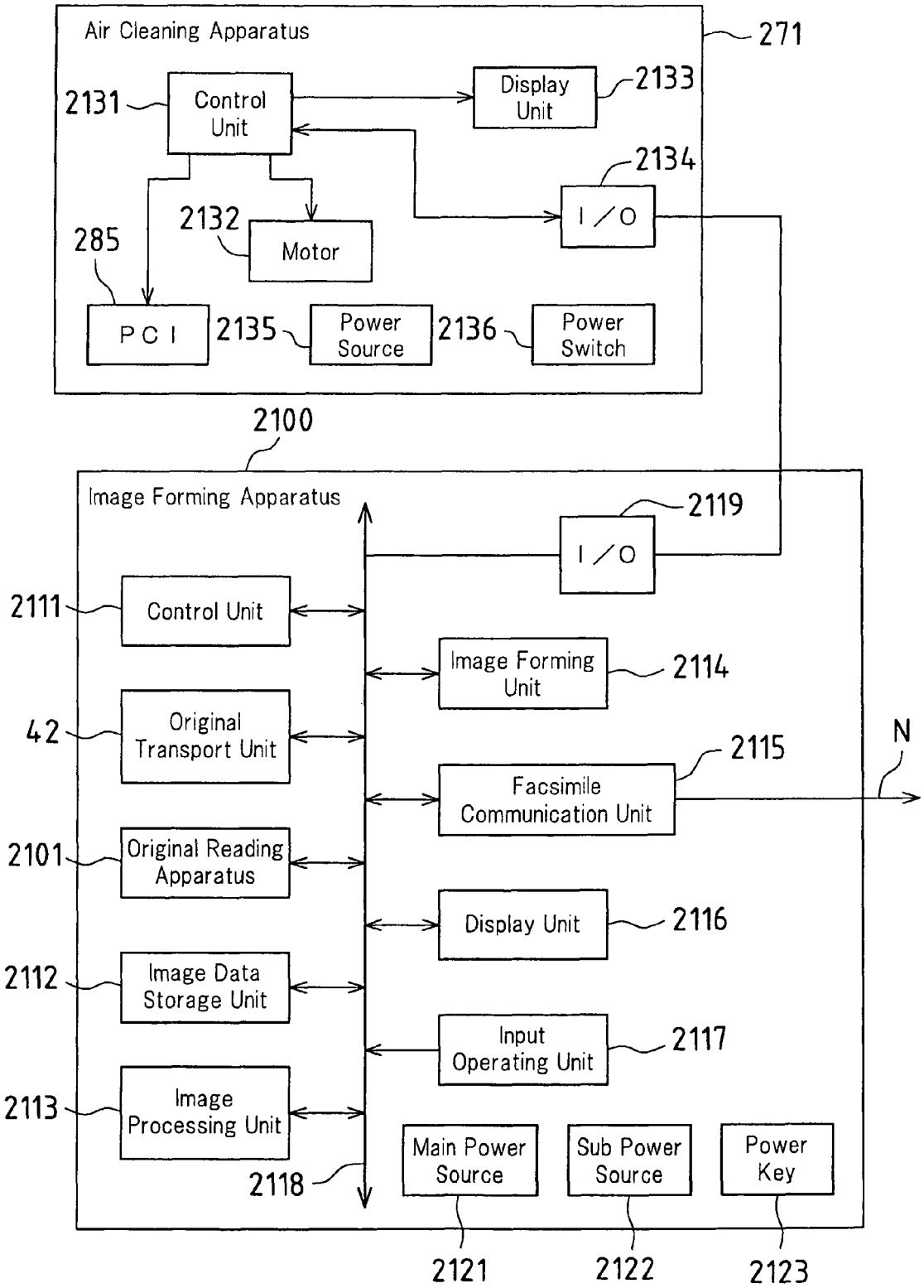
FIG. 32 is a block diagram showing configurations of the image forming apparatus and the air cleaning apparatus in the image forming system of FIG. 28.

FIG. 32 is a block diagram showing configurations of the image forming apparatus 2100 and the air cleaning apparatus 271. As shown in FIG. 32, the image forming apparatus 2100 is provided with a Control Unit 2111 that administers overall control of this image forming apparatus 2100, the original transport unit 42, the original reading apparatus 2101, an image data storage unit 2112, an image processing unit 2113, an image forming unit 2114, a facsimile communication unit 2115, a Display Unit 2116 that displays various types of information, an input Operating Unit 2117 operated by a user, a bus 2118 interconnecting the constituent elements, an input/output unit 2119, a main power source 2121, a sub power source 2122, a power key 2123, and the like.

The Control Unit 2111 is composed of a CPU (Central Processing. Unit), a ROM (Read Only Memory) storing various types of programs to be executed by the CPU, a RAM (Random Access Memory) that is used as a work area of the CPU, and the like, and performs overall control of the image forming apparatus 2100 by executing programs using the CPU and performing data processing.

Also, the Control Unit 2111 is connected to the air cleaning apparatus 271 via the input/output unit 2119, and controls the operation of this air cleaning apparatus 271.

The original transport unit 42 and the original reading apparatus 2101, which are also shown in FIG. 28, transport originals and read the images of originals.

The image data storage unit 2112, which is a hard disk apparatus or the like, stores image data representing images of originals read by the original reading apparatus 2101 and images received from outside. The image processing unit 2113 performs various types of processing on image data stored in the image data storage unit 2112.

The image forming unit 2114 is composed of the laser exposure apparatus 1, the developing apparatuses 2, the photosensitive drums 3, the charging units 5, the cleaning apparatuses 4, the intermediate transfer belt apparatus 8, the fixing apparatus 12, the paper transport path S, the paper feed tray 10, the paper discharge tray 15, and the like, which are shown in FIG. 28, and prints an image of an original on recording paper.

The facsimile communication unit 2115 is connected to a network N, and transmits and receives image data via the network N by executing a facsimile communication protocol with another terminal.

The Display Unit 2116 is, for example, a liquid crystal display apparatus, and performs display such as operation guidance for the image forming apparatus 2100. The input Operating Unit 2117 is provided with various types of keys and buttons that are operated by the user or a touch panel superimposed on the screen of the Display Unit 2116, and detects keys and buttons operated by the user or keys and the like on the screen of the Display Unit 2116 selected by the user via the touch panel, and outputs input instructions made by this user to the Control Unit 2111.

The main power source 2121 is for supplying power to constituent elements other than the facsimile communication unit 2115, and supplies operating power to the Control Unit 2111, the original transport unit 42, the original reading apparatus 2101, the image data storage unit 2112, the image processing unit 2113, the image forming unit 2114, the Display Unit 2116, the input Operating Unit 2117, the input/output unit 2119, and the like. The sub power source 2122 is a dedicated power source for the facsimile communication unit 2115, and supplies operating power to only the facsimile communication unit 2115.

The power key 2123 is a key operated by the user, and is operated to set the image forming apparatus 2100 to a night mode (described in detail later) or to resume the image forming apparatus 2100 from the night mode.

On the other hand, the air cleaning apparatus 271 is provided with a Control Unit 2131 that administers overall control of the air cleaning apparatus 271, a motor 2132 that rotates the fan 282*c*, a Display Unit 2133, an input/output unit 2134, the ion generating elements 285, a power source 2135, a power switch 2136, and the like.

The Control Unit 2131 is composed of a CPU, a ROM that stores various types of programs to be executed by the CPU, a RAM that is used as a work area of the CPU, and the like, and performs overall control of the air cleaning apparatus 271 by executing programs using the CPU.

The Control Unit 2131 is connected to the image forming apparatus 2100 via the input/output unit 2134, and controls the operation of the air cleaning apparatus 271 in response to instructions from the Control Unit 2111 of the image forming apparatus 2100.

The motor 2132 is for rotationally driving the fan 282*c* of the fan unit 282 shown in FIG. 29. The ion generating elements 285 are PCI generating elements shown in FIGS. 29 and 30.

The Display Unit 2133 is, for example, a plurality of LEDs, and these LEDs are selectively illuminated or flashed, with the user being informed of a variety of information by this selective illuminating or flashing.

The power source 2135 supplies operating power to the Control Unit 2131, the motor 2132, the Display Unit 2133, the input/output unit 2134, the ion generating elements 285, and the like.

The power switch 2136 is a switch operated by the user, and is operated to turn power supply from the power source 2135 on and off.

Incidentally, in an image forming system having such a configuration, the user would be forced to perform complex operations if the image forming apparatus 2100 and the air cleaning apparatus 271 were operated separately.

Operating the image forming apparatus 2100 and the air cleaning apparatus 271 separately is troublesome for the user, even though it is desirable in an office, for example, to set the image forming apparatus 2100 to the night mode and to stop the air cleaning operation of the air cleaning apparatus 271 in order to save power, given that the air cleaning apparatus 271 does not need to be operated at night since the image forming apparatus 2100 will not be used because of there being nobody around.

In view of this, in the present invention, the air cleaning operation of the air cleaning apparatus 271 is stopped when the image forming apparatus 2100 is set to the night mode or when a fixed time period elapses from the setting of the night mode, thereby simplifying operation of the air cleaning apparatus 271.

The night mode here is a mode in which at least transmission and reception of data with an external device (another terminal) is enabled, and is, for example, a mode for stopping constituent elements involved in the printing process of the image forming apparatus 2100, including the original transport unit 42, the original reading apparatus 2101, the image data storage unit 2112, the image processing unit 2113, the image forming unit 2114, the Display Unit 2116, and the input Operating Unit 2117, and for operating only the facsimile communication unit 2115, the input/output unit 2119, and some of the functions of the Control Unit 2111. Constituent elements involved in the printing process of the image forming apparatus 2100 may be stopped because the printing process of the image forming apparatus 2100 is not performed at night when there is nobody in the office. However, the facsimile communication unit 2115 needs to be operated, since incoming facsimile communication could be received, even if there is nobody in the office at night and printing is not performed. Also, even in the night mode, operation of the input/output unit 2119 and some of the functions of the Control Unit 2111 needs to be continued to start constituent elements involved in the printing process of the image forming apparatus 2100 and record an image represented by image data received by the facsimile communication unit 2115 to recording paper, or control the air cleaning apparatus 271 using the Control Unit 2111.

To operate the facsimile communication unit 2115, the sub power source 2122 is kept ON and power supply from the sub power source 2122 to the facsimile communication unit 2115 is continued. To operate only the input/output unit 2119 and some of the functions of the Control Unit 2111, power supply from the main power source 2121 to the constituent elements involved in the printing process of the image forming apparatus 2100 is stopped, and power supply from the main power source 2121 to the input/output unit 2119 and the Control Unit 2111 is continued.

Note that even in the case where the role allocation of power supply by the main power source 2121 and the sub power source 2122 is changed, it is possible to operate only the facsimile communication unit 2115, the input/output unit 2119 and some of the functions of the Control Unit 2111. For example, in the case where power is supplied from the sub power source 2122 to the facsimile communication unit 2115, the input/output unit 2119 and the Control Unit 2111, the sub power source 2122 need only be turned on and the main power source 2121 can be completely turned off.

The air cleaning operation of the air cleaning apparatus 271 refers to the operation by the motor 2132 and the ion generating elements 285, for example, and it is permissible to stop the motor 2132 and the ion generating elements 285 at night when there is nobody around, given that the air cleaning operation is no longer necessary. Also, the operation of the input/output unit 2134 and some of the functions of the Control Unit 2131 is continued to respond to instructions from the Control Unit 2131 of the image forming apparatus 2100 whatever the time including night time, and, further, the operation of the Display Unit 2133 is also continued.

To operate the input/output unit 2134, the Display Unit 2133 and some of the functions of the Control Unit 2131, power supply from the power source 2135 to the motor 2132 and the ion generating elements 285 is stopped, and power supply from the power source 2135 to the input/output unit 2134, the Display Unit 2133 and the Control Unit 2131 is continued.

Also, in the present embodiment, the air cleaning operation of the air cleaning apparatus 271 is restarted when the image forming apparatus 2100 resumes from the night mode. This also enables the operation of the air cleaning apparatus 271 to be simplified.

Resuming the image forming apparatus 2100 from the night mode refers to transitioning the image forming apparatus 2100 from the night mode to another mode when people have returned to the office or around the time that people return to the office. Other modes include a warm-up mode for setting the fixing temperature of the heat roller 31 of the fixing apparatus 12 in the image forming apparatus 2100, a print mode for operating constituent elements involved in the printing process of the image forming apparatus 2100 and performing the printing process, a standby mode for reducing power consumption when the printing process is not being performed, and a power saving mode in which power consumption is further reduced. Normally, the image forming apparatus 2100 transitions from the night mode to the warm-up mode. Accordingly, the air cleaning operation of the air cleaning apparatus 271 is restarted when the image forming apparatus 2100 transitions to this warm-up mode.

In the warm-up mode, power is supplied to constituent elements involved in the printing process of the image forming apparatus 2100 from the main power source 2121. Also, power supply to the input/output unit 2119 and the Control Unit 2111 is continued.

Also, with the air cleaning operation of the air cleaning apparatus 271, power is supplied to the motor 2132 and the ion generating elements 285 from the power source 2135. Power supply to the input/output unit 2134, the Control Unit 2131 and the Display Unit 2133 is also continued.

The air cleaning operation of the air cleaning apparatus 271 is stopped when the image forming apparatus 2100 is set to the night mode or when a fixed time period elapses after the setting of the night mode, and the air cleaning operation of the air cleaning apparatus 271 is restarted when the image forming apparatus 2100 resumes from the night mode. This enables power consumption of the air cleaning apparatus 271 to be reduced, without particularly operating the air cleaning apparatus 271 and without in any way impairing the effects of the air cleaning apparatus 271. Also, no particular load is placed on the image forming apparatus 2100, because the air cleaning operation of the air cleaning apparatus 271 is controlled in coordination with the operation of the image forming apparatus 2100.

Next, input settings required to control the air cleaning operation of the air cleaning apparatus 271 in coordination with the operation of the image forming apparatus 2100 will be described, with reference to FIGS. 33 to 37.

These input settings are configured by displaying an input setting screen on the Display Unit 2116 of the image forming apparatus 2100, and performing input to the input setting screen by operating the touch panel of the input Operating Unit 2117. The Control Unit 2111 displays various input setting screens on the Display Unit 2116 in accordance with a preset procedure, and, when input is performed to an input setting screen by operating the touch panel of the input Operating Unit 2117, sets and stores the operation content of the air cleaning apparatus 271 to be coordinated with operation of the image forming apparatus 2100 based on this input. Then, when controlling the image forming apparatus 2100, the Control Unit 2111 reads out and executes the operation content of the air cleaning apparatus 271 to be coordinated with operation of this image forming apparatus 2100, and drives and controls the air cleaning apparatus 271.

Also, while ON/OFF of the power key 2123 of the image forming apparatus 2100 is shown on the input setting screens of FIGS. 33 to 37, the main power source 2121 and the sub power source 2122 are not completely turned on/OFF by turning this power key 21230N/OFF. Turning on the power key 2123 instructs transition from the night mode to the warm-up mode, and turning off the power key 2123 instructs setting of the night mode. Accordingly, when the power key 2123 of the image forming apparatus 2100 is turned off, the night mode is set and constituent elements involved in the printing process of the image forming apparatus 2100 are stopped, but operation of the facsimile communication unit 2115, the input/output unit 2119, and some of the functions of the Control Unit 2111 is continued.

Similarly, while ON/OFF of the operation of the air cleaning apparatus 271 is shown, this operation ON/OFF is for instructing whether or not to perform the air cleaning operation of the air cleaning apparatus 271. Accordingly, when the operation of the air cleaning apparatus 271 is turned off, the motor 2132 and the ion generating elements 285 are stopped, but operation of the input/output unit 2134, the Display Unit 2133, and some of the functions of the Control Unit 2131 is continued.

An initial setting screen (not shown) for selecting setting of the image forming apparatus 2100, setting of the air cleaning apparatus 271 or the like is displayed on the Display Unit 2116. When setting of the air cleaning apparatus 271 is selected on this initial input screen by operating the touch panel of the input Operating Unit 2117, a first input setting screen 2141 required in order to control the air cleaning operation of the air cleaning apparatus 271 such as shown in FIG. 33A is displayed on the Display Unit 2116. Operation names, operation descriptions and the like corresponding to keys 2142, 2143 and 2144 on the first input setting screen 2141 in FIG. 33A are shown in the chart of FIG. 33B.

As is clear from FIGS. 33A and 33B, the key 2142 for setting the operation of the air cleaning apparatus 271 to ON in coordination with the power key 2123 of the image forming apparatus 2100 being turned on, the key 2143 for setting the operation of the air cleaning apparatus 271 to OFF in coordination with the power key 2123 of the image forming apparatus 2100 being turned off, and the "OK" key 2144 are displayed on the first input setting screen 2141.

Here, when the key 2142 is selected on the first input setting screen 2141 on the first input setting screen 2141 of FIG. 33A by operating the touch panel of the input Operating Unit 2117, a second input setting screen 2151 such as shown in FIG. 34A is displayed on the Display Unit 2116. Operation names, operation descriptions and the like corresponding to a checkbox 2152 and keys 2153, 2154 and 2155 on the second input setting screen 2151 of FIG. 34A are shown in the chart of FIG. 34B.

As is clear from FIGS. 34A and 34B, the checkbox 2152 for turning the operation of the air cleaning apparatus 271 to ON in coordination with the power key 2123 of the image forming apparatus 2100 being turned on, the key 2153 for setting the air volume of the air cleaning apparatus 271 to "High", the key 2154 for setting the air volume of the air cleaning apparatus 271 to "Low", and the "OK" key 2155 are displayed on the second input setting screen 2151.

Figure 35A:
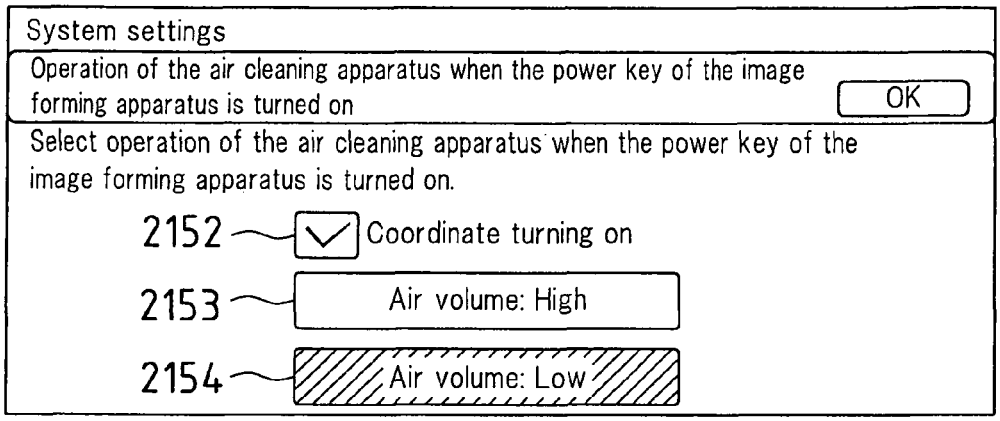
FIG. 35 is composed of FIG. 35A and FIG. 35B, FIG. 35A being a plan view showing an example of input settings on the second input setting screen, and FIG. 35B being a plan view showing another example of input settings on the second input setting screen.

For example, when the checkbox 2152 is checked and the key 2153 is selected on the second input setting screen 2151 by operating the touch panel of the input Operating Unit 2117 as shown in FIG. 35A, the operation of the air cleaning apparatus 271 is turned on in coordination with the power key 2123 of the image forming apparatus 2100 being turned on, and the air volume of the air cleaning apparatus 271 is set to "High".

Figure 35B:
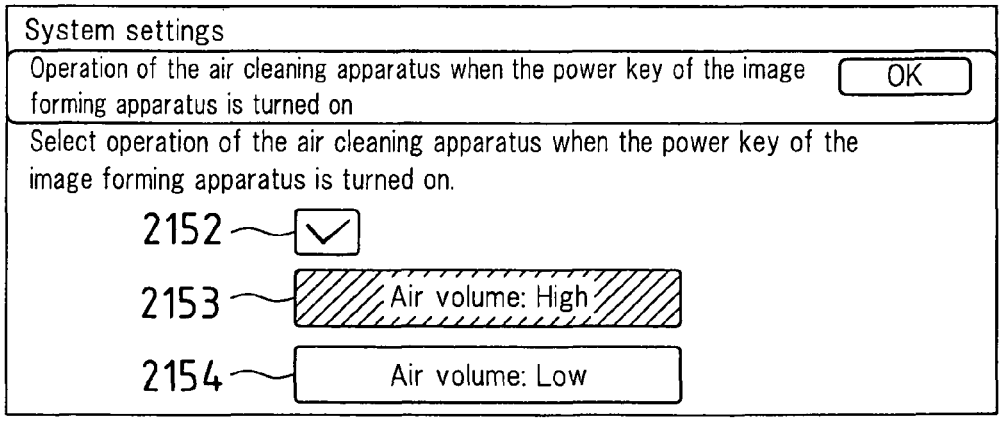

Also, when the checkbox 2152 is checked and the key 2154 is selected on the second input setting screen 2151 as shown in FIG. 35B, the operation of the air cleaning apparatus 271 is turned on in coordination with the power key 2123 of the image forming apparatus 2100 being turned on, and the air volume of the air cleaning apparatus 271 is set to "Low".

Note that when the "OK" key 2155 is selected in FIGS. 34A, 35A and 35B, display returns to the screen of FIG. 33A. Also, in the case where the "OK" key 2155 is selected without the checkbox 2152 being checked, the operation of the air cleaning apparatus 271 is set to not be switched in coordination with the power key 2123 of the image forming apparatus 2100 being turned on, and display returns to the screen of FIG. 33A.

Next, when the key 2143 is selected on the first input setting screen 2141 of FIG. 33A, a third input setting screen 2161 such as shown in FIG. 36A is displayed on the Display Unit 2116. Operation names, operation descriptions and the like corresponding to a checkbox 2162 and keys 2163 to 2167 on the third input setting screen 2161 in FIG. 36A are shown in the chart of FIG. 36B.

As is clear from FIGS. 36A and 36B, the checkbox 2162 for turning off the operation of the air cleaning apparatus 271 in coordination with the power key 2123 of the image forming apparatus 2100 being turned off, the key 2163 for immediately turning off the operation of the air cleaning apparatus 271, the key 2164 for turning off the operation of the air cleaning apparatus 271 with a timer, the keys 2165 and 2166 for arbitrarily adjusting and setting a fixed time period to be measured by the timer, and the "OK" key 2167 are displayed on the third input setting screen 2161.

Figure 37A:
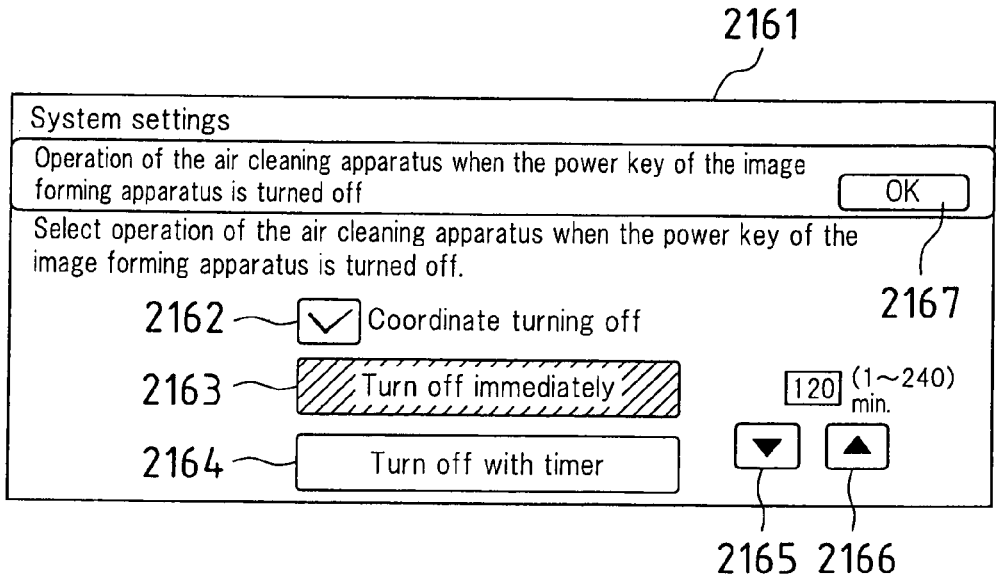
FIG. 37 is composed of FIG. 37A and FIG. 37B, FIG. 37A being a plan view showing an example of input settings on the third input setting screen, and FIG. 37B being a plan view showing another example of input settings on the third input setting screen.

For example, when the checkbox 2162 is checked and the key 2163 is selected on the third input setting screen 2161 as shown in FIG. 37A, the operation of the air cleaning apparatus 271 is set to be immediately turned off in coordination with the power key 2123 of the image forming apparatus 2100 being turned off.

Figure 37B:
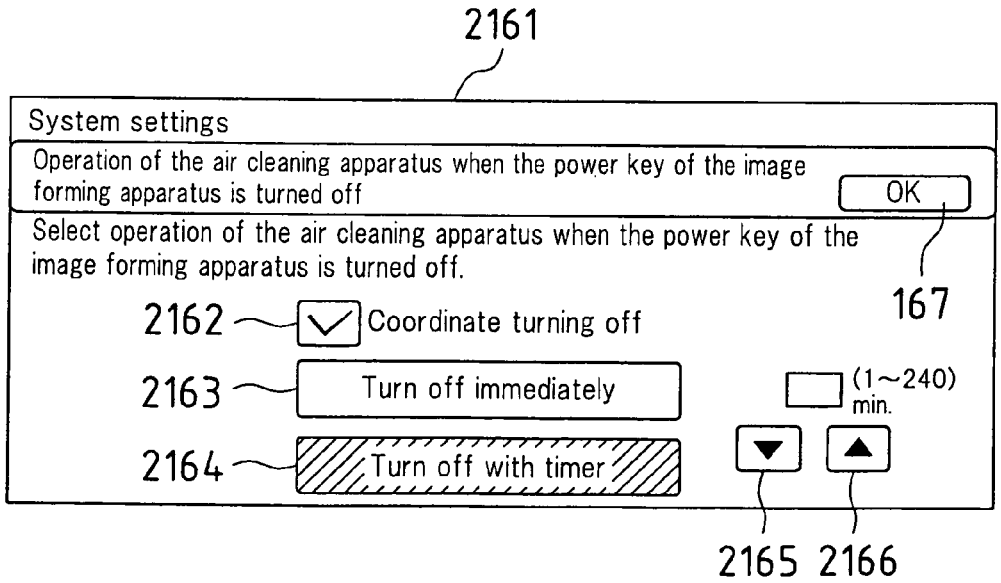

Also, when the checkbox 2162 is checked, the key 2164 is selected on the third input setting screen 2161 as shown in FIG. 37B, and the keys 2165 and 2166 are further operated to adjust the fixed time period to be measured by the timer, the timer is set to start in coordination with the power key 2123 of the image forming apparatus 2100 being turned off, and the operation of the air cleaning apparatus 271 is set to be turned off when the timer has finished measuring the fixed time period, or in other words, when the fixed time period elapses from the power-OFF time of the power key 2123 of the image forming apparatus 2100.

Note that a configuration may be adopted in which the fixed time period measured by the timer can be adjusted and set by operating a numerical keypad of the input Operating Unit 2117, instead of operating the keys 2165 and 2166 on the third input setting screen 2161.

Also, when the "OK" key 2167 is selected in FIGS. 36A, 37A and 37B, display returns to the screen of FIG. 33A. Also, in the case where the "OK" key 2167 is selected without the checkbox 2162 being checked, not switching the operation of the air cleaning apparatus 271 in coordination with the power key 2123 of the image forming apparatus 2100 being turned off is set, and display returns to the screen of FIG. 33A.

Figure 38A:
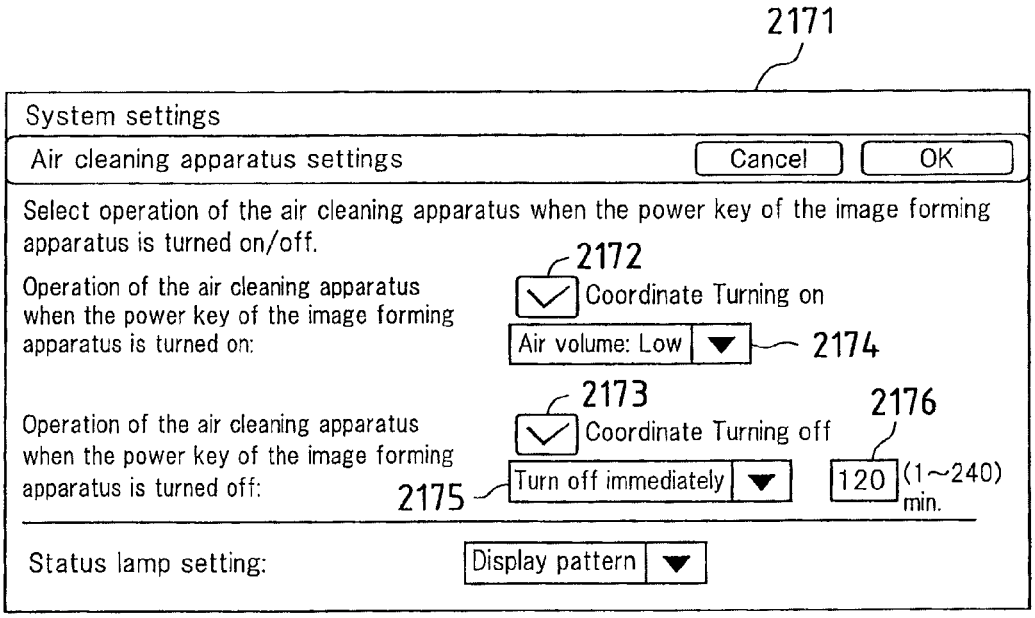
FIG. 38 is composed of FIG. 38A, FIG. 38B and FIG. 38C, FIG. 38A being a plan view showing another input setting screen for setting the air cleaning operation of the air cleaning apparatus, and FIG. 38B and FIG. 38C being charts showing operation names, operation descriptions and the like corresponding to checkboxes, selection boxes, and input boxes on the other input setting screen of FIG. 38A.

Input settings may be configured using an input setting screen 2171 such as shown in FIG. 38A, instead of the first to third input setting screens 2141, 2151 and 2161. Operation names, operation descriptions, and the like corresponding to checkboxes 2172 and 2173, selection boxes 2174 and 2175, and an input box 2176 on the input setting screen 2171 of FIG. 38A are shown in the charts of FIGS. 38B and 38C.

As is clear from FIGS. 38A, 38B, and 38C, the checkbox 2172 for turning on the operation of the air cleaning apparatus 271 in coordination with the power key 2123 of the image forming apparatus 2100 being turned on, and the selection box 2174 for setting the air volume of the air cleaning apparatus 271 to "High" or "Low" are displayed on the input setting screen 2171. When the checkbox 2172 is checked, and "High" or "Low" air volume is selected in the selection box 2174 by operating the touch panel of the input Operating Unit 2117, the operation of the air cleaning apparatus 271 is set to be turned on in coordination with the power key 2123 of the image forming apparatus 2100 being turned on, and the air volume of the air cleaning apparatus 271 is set to "High" or "Low".

Also, the checkbox 2173 for turning off the operation of the air cleaning apparatus 271 in coordination with the power key 2123 of the image forming apparatus 2100 being turned off, the selection box 2175 for setting whether or not to immediately turn off the operation of the air cleaning apparatus 271 in coordination with the power key 2123 being turned off, and the input box 2176 for inputting an arbitrary fixed time period to be measured from when the power key 2123 is turned off until when the operation of the air cleaning apparatus 271 is turned off are displayed on the input setting screen 2171. When the checkbox 2173 is checked, and turning off the operation of the air cleaning apparatus 271 immediately is selected in the selection box 2175 by operating the touch panel of the input Operating Unit 2117, the operation of the air cleaning apparatus 271 is set to be immediately turned off in coordination with the power key 2123 of the image forming apparatus 2100 being turned off. When the checkbox 2173 is checked, not turning off the operation of the air cleaning apparatus 271 immediately is selected in the selection box 2175, and an arbitrary fixed time period is input in the input box 2176 by operating the numerical keypad of the input Operating Unit 2117, the timer is set to start in coordination with the power key 2123 of the image forming apparatus 2100 being turned off, and the operation of the air cleaning apparatus 271 is set to be turned off after the timer has measured the fixed time period.

The operation of the air cleaning apparatus 271 set as described above is shown in Table 1 in an organized manner. The Control Unit 2111 of the image forming apparatus 2100 stores an item a or b and an item c or d in Table 1 as a data table, and uses this data table in controlling the air cleaning apparatus 271.

TABLE 1

| | Coordinated operation determination | Operation of air cleaning apparatus | Actual operation |
|---|---|---|---|
| a | Coordinate with power-ON of power key of image forming apparatus | Turn on<br>Set air volume to high or low | Start air cleaning operation in coordination with transition from night mode to warm-up mode |
| b | Do not coordinate with power-ON of power key of image forming apparatus | Do not switch operation | Do not switch operation of air cleaning apparatus |
| c | Coordinate with power-OFF of power key of image forming apparatus | Turn off<br>Turn timer on or off<br>Arbitrary fixed period | Stop air cleaning operation in coordination with night mode being set |
| d | Do not coordinate with power-OFF of power key of image forming apparatus | Do not switch operation | Do not switch operation of air cleaning apparatus |

Figure 39:
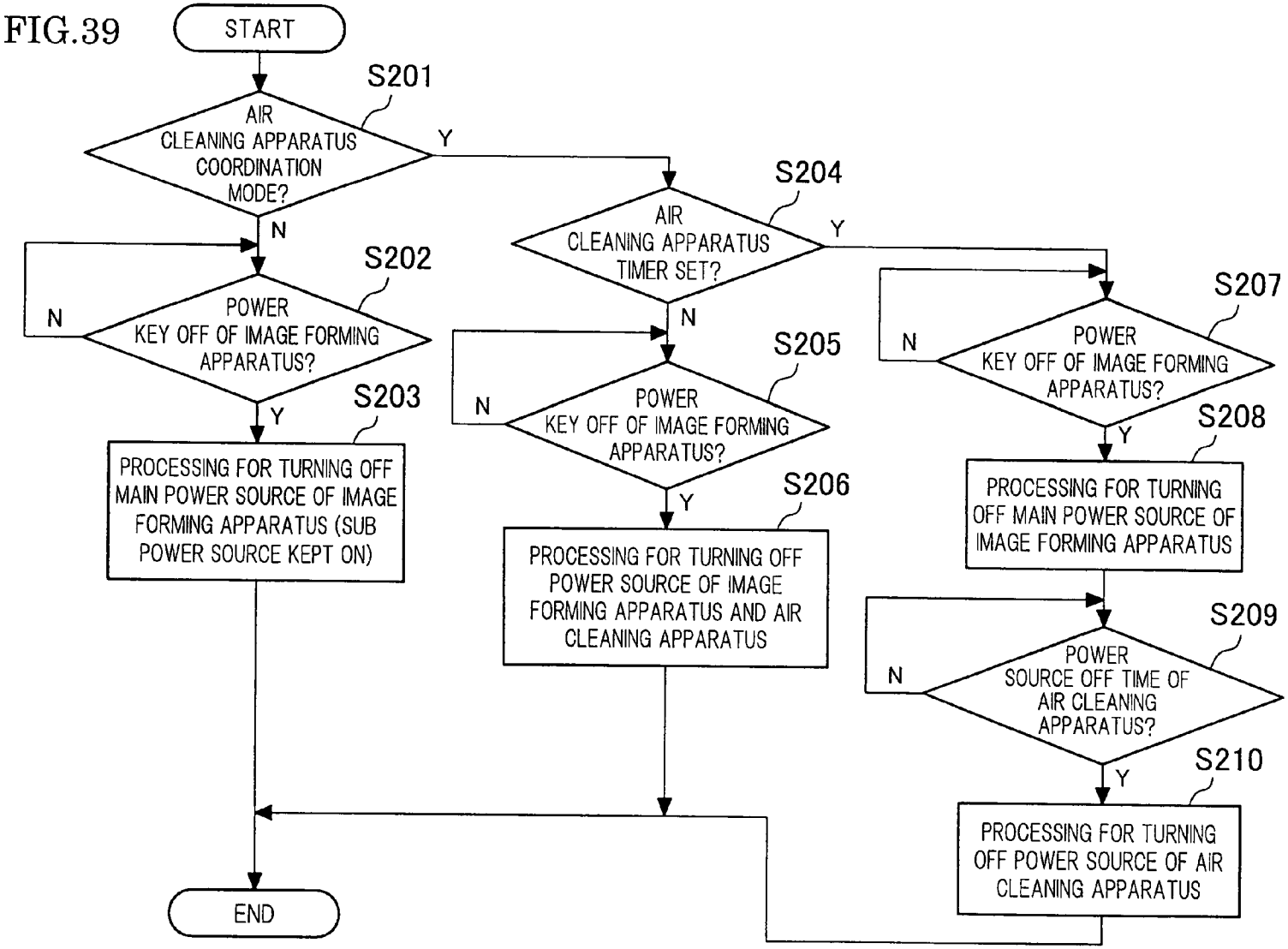
FIG. 39 is a flowchart showing a control procedure of the air cleaning apparatus by a Control Unit of the image forming apparatus when the night mode is set.

Next, a procedure according to which the Control Unit 2111 of the image forming apparatus 2100 controls the air cleaning apparatus 271 when the night mode is set will be described, with reference to the flowchart in FIG. 39.

During the daytime, the power key 2123 of the image forming apparatus 2100 is ON, and the image forming apparatus 2100 is set to one of the print mode, the standby mode, and the power saving mode. At this time, the Control Unit 2111 confirms which of "Coordinate with power-ON of power key" and "Do not coordinate with power-ON of power key" has been set, with reference to the content of the data table corresponding to item c or d in Table 1 (step S201).

For example, if "Do not coordinate with power-ON of power key" of item d has been set ("No" at step S201), the Control Unit 2111 waits for the power key 2123 of the image forming apparatus 2100 to be turned off at night (step S202), and, when the power key 2123 is turned off ("Yes" at step S202), sets the image forming apparatus 2100 to the night mode (step S203), and continues the operation of the air cleaning apparatus 271. When the image forming apparatus 2100 is in the night mode, power supply from the main power source 2121 to constituent elements involved in the printing process is stopped, power supply from the main power source 2121 to the input/output unit 2119 and the Control Unit 2111 is continued, and the sub power source 2122 is kept ON to continue power supply from the sub power source 2122 to the facsimile communication unit 2115.

If "Coordinate with power-OFF of power key" of item c has been set ("Yes" at step S201), the Control Unit 2111 confirms which of "Timer ON" and "Timer OFF" has been set, with reference to the content of the data table corresponding to item c (step S204).

If "Timer OFF" has been set ("No" at step S204), the Control Unit 2111 waits for the power key 2123 of the image forming apparatus 2100 to be turned off at night (step S205), and, when the power key 2123 is turned off ("Yes" at step S205), sets the image forming apparatus 2100 to the night mode, and stops the air cleaning operation of the air cleaning apparatus 271 (step S206). Stopping the air cleaning operation of the air cleaning apparatus 271 refers to the motor 2132 and the ion generating elements 285 being stopped, while operation of the input/output unit 2134, the Display Unit 2133, and some of the functions of the Control Unit 2131 is continued.

If "Timer ON" has been set ("Yes" at step S204), the Control Unit 2111 waits for the power key 2123 of the image forming apparatus 2100 to be turned off (step S207), and, when the power key 2123 is turned off ("Yes" at step S207), sets the image forming apparatus 2100 to the night mode (step S208). At the same time, the Control Unit 2111 acquires a fixed time period to be measured by the timer, with reference to the content of the data table corresponding to item c, and starts measuring the fixed time period with the timer. When the timer finishes measuring the fixed time period, or in other words, when the fixed time period elapses from the power-OFF time of the power key 2123 of the image forming apparatus 2100 ("Yes" at step S209), the Control Unit 2111 stops the air cleaning operation of the air cleaning apparatus 271 (step S210).

When the power key 2123 is thus turned off at night, the image forming apparatus 2100 is set to the night mode, and the air cleaning operation of the air cleaning apparatus 271 is continued or stopped. Subsequently, when the power key 2123 is turned on in the morning, the image forming apparatus 2100 transitions from the night mode to the warm-up mode. At this time, the Control Unit 2111 confirms which of "Coordinate with the power-ON of power key" and "Do not coordinate with the power-ON of power key" has been set, with reference to the content of the data table corresponding to item a or b in Table 1. For example, if "Do not coordinate with the power-ON of power key" of item b has been set, the Control Unit 2111 sets the image forming apparatus 2100 to the warm-up mode in response to the power key 2123 of the image forming apparatus 2100 being turned on, but does not restart the air cleaning operation of the air cleaning apparatus 271. If, however, the air cleaning operation of the air cleaning apparatus 271 was being performing in the night mode of the image forming apparatus 2100, this air cleaning operation is continued.

If "Coordinate with the power-ON of power key" of item a has been set, the Control Unit 2111 sets the image forming apparatus 2100 to the warm-up mode in response to the power key 2123 of the image forming apparatus 2100 being turned on, and restarts the air cleaning operation of the air cleaning apparatus 271. If the air cleaning operation of the air cleaning apparatus 271 was being performing in the night mode of the image forming apparatus 2100, this air cleaning operation is continued.

Further, the Control Unit 2111 checks the air volume setting of the air cleaning apparatus 271 with reference to the content of the data table corresponding to item a when restarting the air cleaning operation of the air cleaning apparatus 271, and, if the air volume has been set to "High", increases the rotational speed of the motor 2132 to rotationally drive the fan 282*c* at high speed, and increase the air volume of the air cleaning apparatus 271. If the air volume has been set to "Low", the Control Unit 2111 decreases the rotational speed of the motor 2132 to rotationally drive the fan 282*c* at low speed, and reduce the air volume of the air cleaning apparatus 271.

Because the air cleaning operation of the air cleaning apparatus 271 is thus stopped and restarted according to setting of the image forming apparatus 2100 to the night mode and transition from the night mode to the warm-up mode, power consumption of the air cleaning apparatus 271 can be reduced, without particularly operating the air cleaning apparatus 271, and without in any way impairing the effects of the air cleaning apparatus 271.

Incidentally, the air cleaning operation of the air cleaning apparatus 271 is turned off in response to the power key 2123 of the image forming apparatus 2100 being turned off, or in other words, in response to a key operation by the user, although in the case where the night mode or the warm-up mode is set automatically according to a preset control procedure of the image forming apparatus 2100, the air cleaning operation of the air cleaning apparatus 271 may be stopped in response to the night mode being automatically set, and the air cleaning operation of the air cleaning apparatus 271 may be restarted in response to transition from the night mode to the warm-up mode. For example, assuming that the night mode and the warm-up mode are switched in accordance with a preset time schedule of the image forming apparatus 2100, the air cleaning operation of the air cleaning apparatus 271 are stopped and restarted according to these modes.

Figure 40:
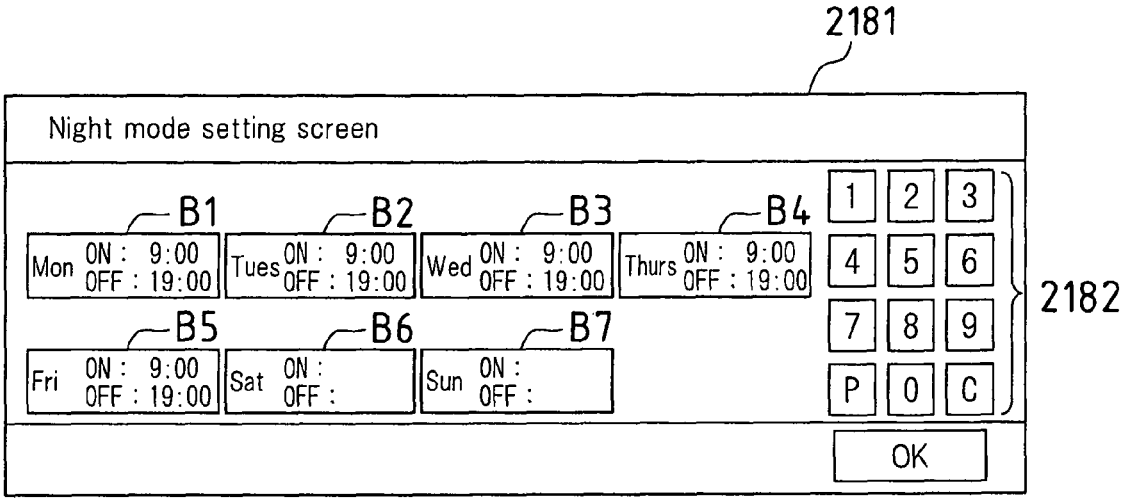
FIG. 40 shows an input setting screen for setting a time schedule for operation of the image forming apparatus.

In this case, an input setting screen 2181 such as shown in FIG. 40, for example, is displayed on the Display Unit 2116, and the time schedule is set on this input setting screen 2181. Fields B1 to B7 for setting the power ON/OFF switching times of the image forming apparatus 2100 are displayed on this input setting screen 2181 for each day of the week from Monday through Sunday. The fields B1 to B7 are sequentially selected on this input setting screen 2181 by operating the touch panel of the input Operating Unit 2117, and the times for turning power to the image forming apparatus 2100 on and off are input and set by selectively instructing numerical keypads 2182 by operating the touch panel, whenever one of the fields B1 to B7 is selected. With the field B1 for Monday, for example, "9:00" is set as the time for turning power on, and "19:00" is set as the time for turning power off. Similarly, "9:00" and "19:00" are also set as the respective times for turning power on and off in the fields B2 to B5 for Tuesday through Friday.

In the case where a time for turning power on or off has thus been set in a day field, the image forming apparatus 2100 is set to the warm-up mode at the power-ON time set for that day, and the image forming apparatus 2100 is set to the night mode at the power-OFF time.

Also, neither the time for turning power on nor off has been set in the fields B1 and B7 for Saturday and Sunday. In this case, the mode of the image forming apparatus 2100 is not switched on those days, and instead switching of the mode of the image forming apparatus 2100 is carried over to a day on which a time for turning power on or off has been set, and the mode of the image forming apparatus 2100 is switched when the power on or off time of that day arrives.

The control unit 2111 of the image forming apparatus 2100 stores a time schedule of days and times such as shown in FIG. 40, switches the night mode, the warm-up mode and the like of the image forming apparatus 2100 in accordance with this time schedule, and switches the air cleaning operation of the air cleaning apparatus 271 according to these modes.

Note that even in the case where the mode of the image forming apparatus 2100 is switched and set according to the day and time, and the air cleaning operation of the air cleaning apparatus 271 is controlled in response to this, a data table corresponding to the content of Table 1 needs to be set using the input setting screens 2141, 2151, 2161 and 2171 described previously.

Figure 41:
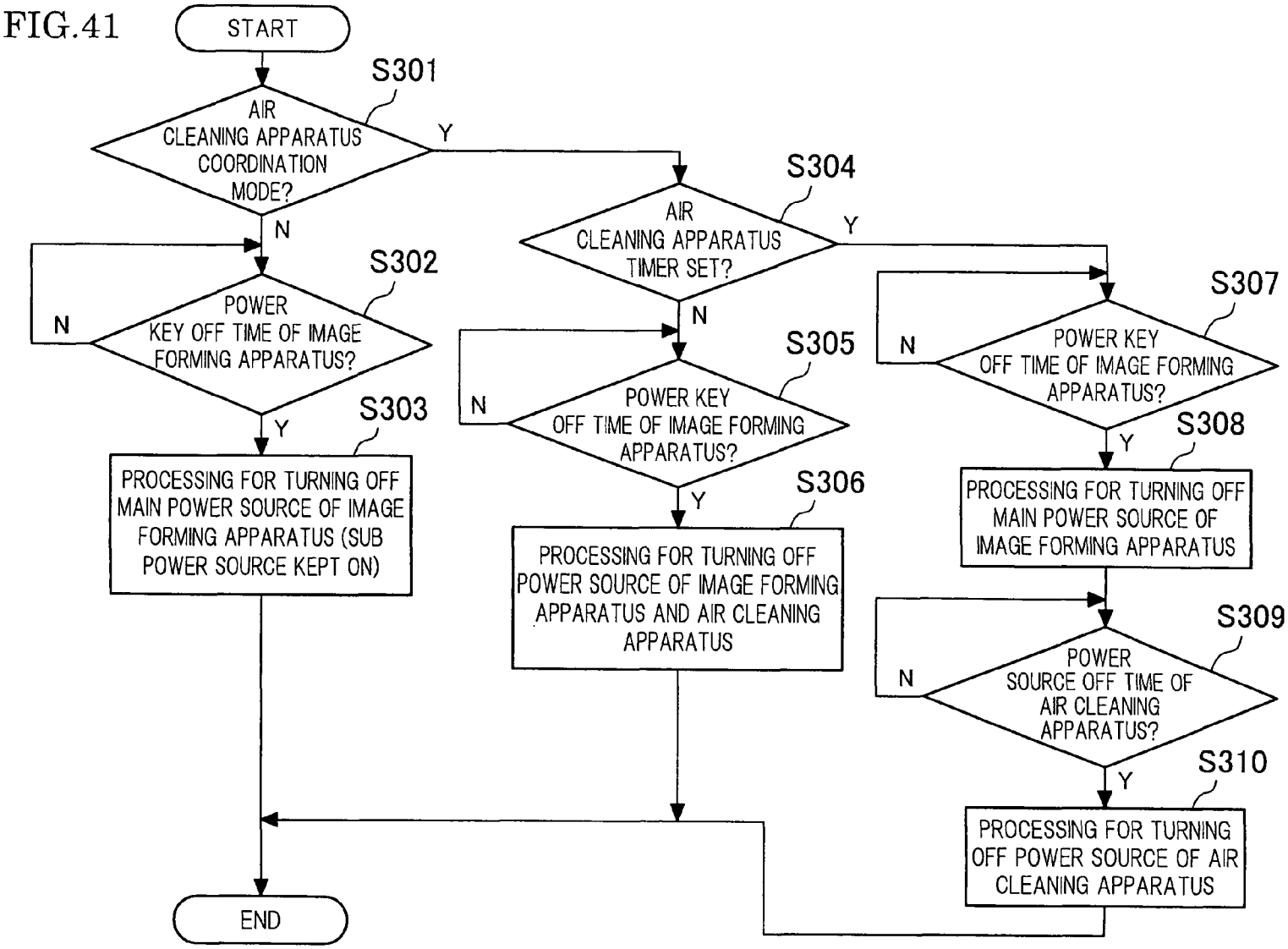
FIG. 41 is a flowchart showing a control procedure of the air cleaning apparatus by the Control Unit of the image forming apparatus in the case of following the time schedule of FIG. 40.

Next, a procedure according to which the control unit 2111 controls the air cleaning apparatus 271 when the night mode is automatically set in accordance with a preset time schedule of the image forming apparatus 2100 will be described, with reference to the flowchart of FIG. 41.

Assuming that it is now during the daytime of one of Monday through Friday, the image forming apparatus 2100 will be set to one of the print mode, the standby mode and the power saving mode. At this time, the Control Unit 2111 confirms which of "Coordinate with power-ON of power key" and "Do not coordinate with power-ON of power key" has been set, with reference to the content of the data table corresponding to item c or d in Table 1 (step S301).

For example, if "Do not coordinate with power-ON of power key" of item d has been set ("No" at step S301), the Control Unit 2111 monitors the day and time being measured by an internal clock, and waits for the measured day and time to arrive at a day and a power-OFF time in FIG. 40 (step S302).

The Control Unit 2111, when the day and time measured by the internal clock arrives at one of Monday through Friday and a power-OFF time in FIG. 40 ("Yes" at step S302), sets the image forming apparatus 2100 to the night mode (step S303), and continues the operation of the air cleaning apparatus 271.

If "Coordinate with power-OFF of power key" of item c has been set ("Yes" at step S301), the Control Unit 2111 confirms which of "Timer ON" and "Timer OFF" has been set, with reference to the content of the data table corresponding to item c (step S304).

If "Timer OFF" has been set ("No" at step S304), the Control Unit 2111 waits for the day and time measured by the internal clock to arrive at one of Monday through Friday and a power-OFF time in FIG. 40 (step S305), and, when the measured day and time arrives at one of the days and a power-OFF time ("Yes" at step S305), sets the image forming apparatus 2100 to the night mode, and stops the air cleaning operation of the air cleaning apparatus 271 (step S306).

If "Timer ON" has been set ("Yes" at step S304), the Control Unit 2111 waits for the day and time measured by the internal clock to arrive at one of Monday through Friday and a power-OFF time in FIG. 40 (step S307), and, when the measured day and time arrives at one of the days and a power-OFF time ("Yes" at step S307), sets the image forming apparatus 2100 to the night mode (step S308). At the same time, the Control Unit 2111 acquires a fixed time period to be measured by the timer, with reference to the content of the data table corresponding to item c, and starts measuring the fixed time period with the timer. When the timer finishes measuring the fixed time period ("Yes" at step S309), the Control Unit 2111 stops the air cleaning operation of the air cleaning apparatus 271 (step S310).

The image forming apparatus 2100 is thus set to the night mode, and the air cleaning operation of the air cleaning apparatus 271 is continued or stopped. Subsequently, when the image forming apparatus 2100 transitions from the night mode to the warm-up mode, the Control Unit 2111 confirms which of "Coordinate with power-ON of power key" and "Do not coordinate with power-ON of power key" has been set, with reference to the content of the data table corresponding to item a or b in Table 1. For example, if "Do not coordinate with power-ON of power key" of item b has been set, the Control Unit 2111 sets the image forming apparatus 2100 to the warm-up mode in response to the power key 2123 of the image forming apparatus 2100 being turned on, but does not restart the air cleaning operation of the air cleaning apparatus 271. If, however, the air cleaning operation of the air cleaning apparatus 271 was being performed when the image forming apparatus 2100 is in the night mode, this air cleaning operation is continued.

If "Coordinate with power-ON of power key" of item a has been set, the Control Unit 2111 sets the image forming apparatus 2100 to the warm-up mode in response to the power key 2123 of the image forming apparatus 2100 being turned on, and restarts the air cleaning operation of the air cleaning apparatus 271. If the air cleaning operation of the air cleaning apparatus 271 was being performed when the image forming apparatus 2100 is in the night mode, this air cleaning operation is continued.

Accordingly, power consumption of the air cleaning apparatus 271 can be reduced, without needing to particularly operate the air cleaning apparatus 271 to stop or restart the air cleaning operation of the air cleaning apparatus 271, and without in any way impairing the effects of the air cleaning apparatus 271.

Hereinabove, embodiments of the present invention have been described in detail, although it should be appreciated that the present invention is not limited to the embodiments, and can be embodied in other forms without departing from the gist or essential characteristics thereof. The foregoing embodiments are therefore to be considered in all respects as illustrative and not limiting. The scope of the invention is indicated by the claims rather than by the foregoing description, and all modifications and changes that come within the meaning and range of equivalency of the claims are intended to be embraced therein.

Figure 42:
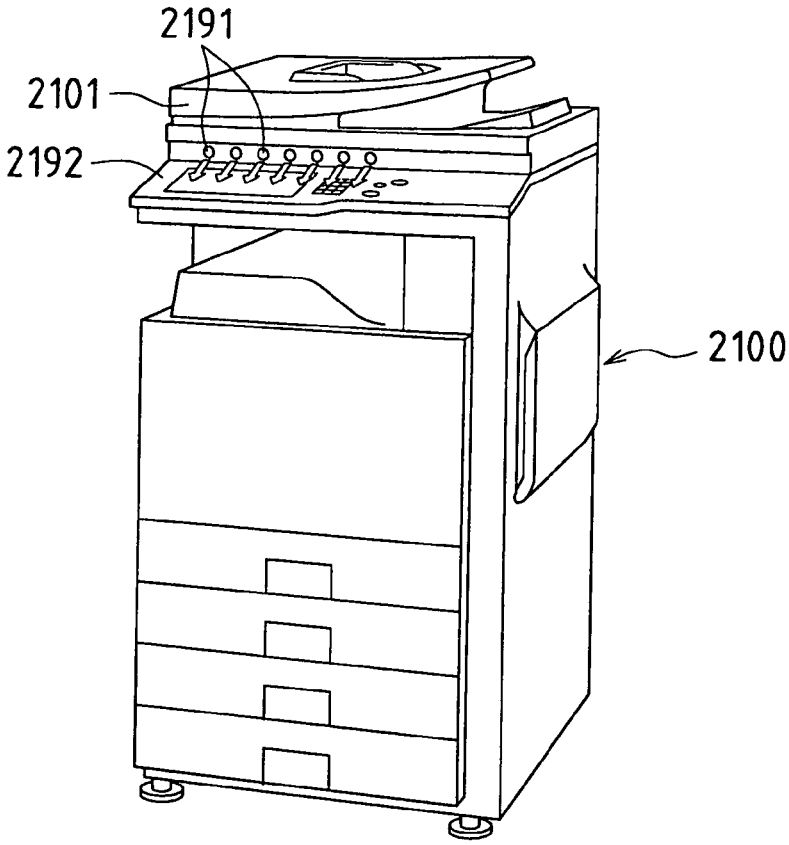
FIG. 42 is a perspective view showing another arrangement of the air cleaning apparatus.

Specifically, in the image forming systems according to the Embodiments 2 and 3, the air cleaning apparatuses 170 and 271 are disposed on the outside (above) of the casing of the image forming apparatuses 1100 and 2100, but the air cleaning apparatus may be built into the image forming apparatus. For example, as shown in FIG. 42, inlet holes (not shown) may be provided in the rear face side of the main body outer wall of the image forming apparatus 2100, a plurality of ventilation holes 2191 may be formed on the upper near side of the main body outer wall of the image forming apparatus 2100, and the air cleaning apparatus 271 may be provided on the inner side of the main body outer wall at the location of these ventilation holes 2191, and ions may be blown out from this air cleaning apparatus 271 toward an operating panel 2192 through the ventilation holes 2191 in the main body outer wall.

Thus, providing the air cleaning apparatus 271 inside the casing of the image forming apparatus 2100 makes it unnecessary to provide space for installing the air cleaning apparatus 271 outside the image forming apparatus 2100. Also, this makes it unnecessary to separately provide an independent air cleaning apparatus in the room or the like where the image forming system is installed. Accordingly, any reduction of the space that can be effectively utilized in the room or the like where the image forming system is installed can be suppressed.

In the image forming system according to the Embodiment 2, this image forming system is constituted by combining the image forming apparatus 1100 and the air cleaning apparatus 170, and the Image Forming Operation Unit power source 1102 and the Air Cleaning Operation Unit power source 172 are provided individually, but the Image Forming Operation Unit power source 1102 and the Air Cleaning Operation Unit power source 172 may be integrally constituted.

Figure 43:
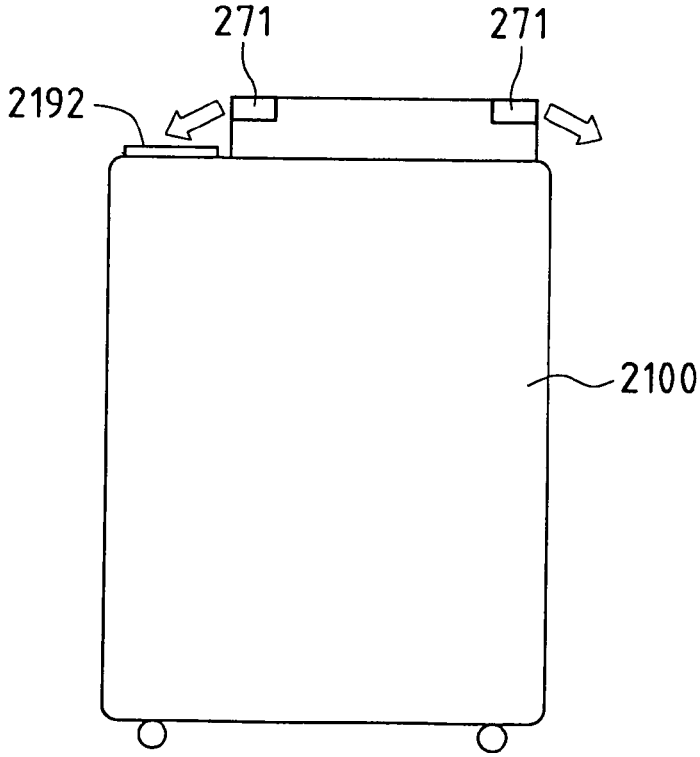
FIG. 43 is a lateral view showing a different arrangement of the air cleaning apparatus.

Also, as shown in FIG. 43, an air cleaning apparatus 271 for blowing ions onto the operating panel 2192 of the image forming apparatus 2100 and an air cleaning apparatus 271 for blowing ions out in the vicinity where the exhaust gases of the image forming apparatus 2100 are produced may be provided individually.

Further, the cleaning apparatus 271 may be provided separately rather than being integrally formed with the image forming apparatus 2100, and only the Control Unit 2131 of the air cleaning apparatus 271 and the Control Unit 2111 of the image forming apparatus 2100 may be interconnected via an input/output unit. In this case, the air cleaning apparatus 271 can be installed on the floor or in a high place such as the ceiling.

What is claimed is:

1. An image forming system comprising:

an Image Forming Operation Unit that executes an image forming operation;

an Air Cleaning Operation Unit that executes an air cleaning operation, wherein the Air Cleaning Operation Unit is provided with an ion generating function;

a power source that supplies power to the Image Forming Operation Unit and the Air Cleaning Operation Unit; and a Control Unit that has a coordinated OFF control function of coordinating a first power supply OFF control for turning off power supply from the power source to the Image Forming Operation Unit and a second power supply OFF control for turning off power supply from the power source to the Air Cleaning Operation Unit, wherein the coordinated OFF control function is configured to execute the second power supply OFF control when a preset time period elapses after executing the first power supply OFF control, wherein the image forming system is provided with a normal mode and a power saving mode in which power consumption is less than in the normal mode, and an ion emission direction of an ion emitted by the Air Cleaning Operation Unit differs between the normal mode and the power saving mode.

2. The image forming system according to claim 1, wherein the power source includes a first power source that supplies power to the Image Forming Operation Unit, and a second power source that supplies power to the Air Cleaning Operation Unit, and the first power supply OFF control is executed with respect to the first power source, and the second power supply OFF control is executed with respect to the second power source.

3. The image forming system according to claim 2, wherein the first power source, the Image Forming Operation Unit and the Control Unit constitute an image forming apparatus, and the second power source and the Air Cleaning Operation Unit constitute an air cleaning apparatus.

4. The image forming system according to claim 3, wherein the air cleaning apparatus is provided outside the image forming apparatus.

5. The image forming system according to claim 4, wherein the air cleaning apparatus is provided above the image forming apparatus.

6. The image forming system according to claim 3, wherein the air cleaning apparatus is provided inside the image forming apparatus.

7. The image forming system according to claim 1, wherein the Control Unit is provided with a plurality of types of the coordinated OFF control function.

8. The image forming system according to claim 1, wherein the Control Unit includes an Operating Unit that receives an operation from outside, and sets the time period based on the operation received by the Operating Unit.

9. The image forming system according to claim 8, wherein the Control Unit is provided with a plurality of types of the coordinated OFF control function, and selects one of the plurality of types of the coordinated OFF control function based on the operation received by the Operating Unit.

10. The image forming system according to claim 9, wherein the Control Unit is further provided with an individual OFF control function of individually executing the first power supply OFF control and the second power supply OFF control independently of each other, and executes an OFF control function selection for selecting one of the plurality of types of the coordinated OFF control function or the individual OFF control function, based on the operation received by the Operating Unit.

11. The image forming system according to claim 9, wherein the Control Unit includes a Remote Operation Reception Unit that receives a remote operation from outside via a communication function, and is further provided with an individual OFF control function of individually executing the first power supply OFF control and the second power supply OFF control independently of each other, and executes an OFF control function selection for selecting one of the plurality of types of the coordinated OFF control function or the individual OFF control function, based on the remote operation received by the Remote Operation Reception Unit.

* * * * *